US007461909B2

(12) United States Patent
Zhang et al.

(10) Patent No.: US 7,461,909 B2
(45) Date of Patent: Dec. 9, 2008

(54) MOUNTING STRUCTURE OF LIQUID SENSOR AND LIQUID CONTAINER

(75) Inventors: Junhua Zhang, Nagano (JP); Akihisa Wanibe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 411 days.

(21) Appl. No.: 11/297,563

(22) Filed: Dec. 8, 2005

(65) Prior Publication Data

US 2006/0139393 A1 Jun. 29, 2006

(30) Foreign Application Priority Data

Dec. 13, 2004 (JP) ..... P2004-359549
Dec. 13, 2004 (JP) ..... P2004-359550
Apr. 15, 2005 (JP) ..... P2005-118963
Apr. 27, 2005 (JP) ..... P2005-130601

(51) Int. Cl.
*B41J 2/195* (2006.01)

(52) U.S. Cl. ..... 347/7; 347/86; 347/68

(58) Field of Classification Search ..... 347/7, 347/86, 68, 19; 73/54.28, 252, 290 R
See application file for complete search history.

(56) References Cited

U.S. PATENT DOCUMENTS 6,536,861 B1 3/2003 Usui et al.
6,802,602 B2 10/2004 Sakai et al.
6,988,401 B2 * 1/2006 Roberjot et al. ..... 73/252
6,994,415 B2 2/2006 Asauchi et al.
7,104,116 B2 * 9/2006 Discenzo ..... 73/54.28
2003/0117450 A1 6/2003 Usui et al.

FOREIGN PATENT DOCUMENTS

CN 1274647 A 11/2000
CN 1421319 A 6/2003
CN 1478658 A 3/2004
JP 2001-146024 A 5/2001
JP 2001-146030 A 5/2001

OTHER PUBLICATIONS

U.S. Appl. No. 11/610,333, filed Dec. 13, 2006, Wanibe.
Partial European Search Report from EP 05027078.4-1251 (Sep. 21, 2007).

* cited by examiner

*Primary Examiner*—Lam S Nguyen
(74) *Attorney, Agent, or Firm*—Stroock & Stroock & Lavan LLP

(57) ABSTRACT

A mounting structure of a liquid sensor comprising: a vibration cavity forming base portion which has a first surface and a second surface opposed to each other and in which a cavity for receiving a medium as a detection target is formed to be open toward the first surface side and a bottom surface of the cavity can vibrate; a sensor including a piezoelectric element having a first electrode formed on the second surface side of the vibration cavity forming base portion, a piezoelectric layer formed on the first electrode, and a second electrode formed on the piezoelectric layer; a mounting target member which is mounted with the sensor, the mounting target member having an upstream space which communicates with the cavity through an upstream flow path and a downstream space which communicates with the cavity through a downstream flow path; and an elastic seal member which is disposed between the sensor and the mounting target member and which seals a space between the sensor and the mounting target member.

27 Claims, 28 Drawing Sheets

MOUNTING STRUCTURE OF LIQUID SENSOR AND LIQUID CONTAINER

BACKGROUND OF THE INVENTION

1. Technical Field of the Invention

The present invention relates to a liquid sensor and a liquid container having the liquid sensor, and more particularly, to a mounting structure of a liquid sensor and a liquid container which are suitable for detecting the amount of remaining liquid in a liquid jetting apparatus.

2. Description of the Related Art

As a representative example of a conventional liquid jetting apparatus, there is known an inkjet printer including an inkjet printing head for printing an image. Examples of other liquid jetting apparatuses can include an apparatus including a color-material jetting head which is used for manufacturing a color filter of a liquid crystal display or the like, an apparatus including an electrode-material (conductive paste) jetting head which is used for forming an electrode of an organic EL display, a field emission display (FED), or the like, an apparatus including a living-organic-material jetting head which is used for manufacturing a biochip, and an apparatus including a sample jetting head as a precision pipette.

In the inkjet printer which is the representative example of the liquid jetting apparatus, a carriage is mounted with an inkjet printing head having a pressurizing unit which pressurizes a pressure generating chamber and a nozzle opening for ejecting pressurized ink in ink droplets.

The inkjet printer has a structure that a printing work can be continuously performed by continuously supplying the ink in an ink container to the printing head through a flow path. The ink container is embodied as a detachable cartridge which can be replaced by a user, for example, when the ink is consumed up.

Conventionally, as a management method for ink consumption of the ink cartridge, there are known a management method in which the number of ink droplets ejected from the printing head or the amount of ink absorbed by a maintenance is integrated in software to calculate the amount of consumed ink and a method of managing the time when a predetermined amount of ink is actually consumed by mounting an electrode for detecting a liquid level in the ink cartridge.

However, the management method, in which the number of ejected ink droplets or the amount of ink is integrated in software to calculate the amount of consumed ink, has the following problems. Some heads show a weight variation in ejected ink droplets. The weight variation in ink droplets dose not have an effect on display quality. However, in consideration of the time when errors in the amount of consumed ink due to the variation are accumulated, the ink cartridge is filled with the ink together with margin ink. Accordingly, depending upon the individual ink cartridges, ink is left as much as the margin ink.

On the other hand, in the method of managing the time when the ink is consumed by the use of an electrode, the actual amount of ink can be detected, thereby managing the amount of remaining ink with high reliability. However, there are drawbacks in that kinds of ink to be detected are limited and a seal structure for an electrode becomes complicated, because detection of an ink level relies on conductivity of ink. In addition, precious metal having excellent conductivity and corrosion resistance is generally used as a material of the electrode. Therefore, manufacturing cost of the ink cartridge runs up. Further, since two electrodes need to be mounted, the number of manufacturing processes is increased, thereby increasing the manufacturing cost.

Accordingly, a device developed for solving the above-mentioned problems is disclosed as a piezoelectric device in JP-A-2001-146024 or JP-A-2001-146030. Such a piezoelectric device can reliably detect the amount of remaining liquid and does not require a complex sealing structure. The piezoelectric device can be mounted on a liquid container for use.

That is, in the piezoelectric device described in the publications, when ink exists or does not exist in a cavity facing a vibration portion of a piezoelectric device, it is possible to monitor the amount of ink remaining in an ink cartridge by the use of variation in resonance frequency of a residual vibration signal resulting from residual vibration (free vibration) of the vibration portion after compulsory vibration with driving pulses.

FIG. 27 shows an actuator constituting the above-described conventional piezoelectric device. The actuator 1106 includes a substrate 1178 having a circular opening 1161 substantially in its center, a vibration plate 1176 displaced in one surface (hereinafter, referred to as 'front surface') of the substrate 1178 so as to cover the opening 1161, a piezoelectric layer 1160 disposed on the front surface of the vibration plate 1176, an upper electrode 1164 and a lower electrode 1166 interposing the piezoelectric layer 1160 therebetween, an upper electrode terminal 1168 which is electrically connected to the upper electrode 1164, a lower electrode terminal 1170 which is electrically connected to the lower electrode 1166, and an auxiliary electrode 1172 which is arranged between the upper electrode 1164 and the lower electrode 1168 to electrically connect both of them.

Each of the piezoelectric layer 1160, the upper electrode 1164, and the lower electrode 1166 has a circular portion serving as a main body. The respective circular portions of the piezoelectric layer 1160, the upper electrode 1164, and the lower electrode 1166 constitute a piezoelectric element.

The vibration plate 1176 is formed on the front surface of substrate 1178 so as to cover the opening 1161. The vibration region, which is actually vibrated in the vibration plate 1176, is defined by the opening 1161. The cavity 1161 is formed by the part of the vibration plate 1176 facing the opening 1161 and the opening 1161 of the substrate (cavity forming member) 1178. The surface (hereinafter, referred to as 'back surface') of the substrate 1178 opposite to the piezoelectric element faces inward to the ink container. Accordingly, the cavity 1162 is constructed so as to be brought into contact the liquid (ink). In addition, the vibration plate is liquid-tight to the substrate 1178 so that liquid does not leak in the front surface of the substrate 1178 even though liquid enters the cavity 1162.

In the actuator 1106 according the above-described conventional technique, the residual vibration (free vibration) of the vibrating portion which is generated after the vibration portion is forcefully vibrated by the vibrating pulse applied to the piezoelectric element, is detected as a back electromotive force by the same piezoelectric element.

As shown in FIG. 28, the above-described conventional actuator (piezoelectric device) 1106 is mounted on the container wall of a container body 1181 of the ink cartridge 1180 and is constructed so that the cavity 1162 for receiving ink to be sensed is exposed to the ink reservoir space within the ink cartridge 1180.

However, the above-described conventional actuator (piezoelectric device) 1106 is constructed so that the cavity 1162 is exposed to the ink reservoir space within the ink cartridge 1180, as described above. Therefore, if the ink within the ink cartridge 1180 is foamed by a vibration or the like, bubbles easily enter the cavity 1162 of the actuator 1106. If the bubbles enter the cavity 1162 and accumulated therein, the resonant frequency of the residual vibration detected by the actuator 1106 becomes high so that it is erroneously determined that the liquid level passes through the position of the actuator 1106 and the amount of remaining ink becomes small, despite the fact that the amount of ink remaining in the ink cartridge 1180 is adequate.

Since the actuator 1106 is constructed so as to expose the cavity 1162 to the ink reservoir space within the ink cartridge 1180, the ink pressure within the ink reservoir space has a direct effect on the vibration plate 1176 and piezoelectric layer 1160 of the actuator 1106. Therefore, in the ink cartridge 1180 or the like, the ink within the ink reservoir space is severely vibrated by the carriage reciprocating on a printing operation, so that the ink pressure generated by the vibration has a direct effect on the actuator 1106, which results in erroneous determination.

In addition, it is also considered that a barrier for preventing a vibration or a wave of ink is formed in the position facing the actuator 1106. However, the space structure around 1106 becomes complicated and the vibration mode of the residual vibration detected by the actuator 1106 also becomes complicated as much. As a result, sensing becomes hard so as to dull detection sensitivity.

When the size of cavity 1162 of the actuator 1106 is made small so that the passing time of the ink level is precisely detected, the meniscus of ink is easily formed inside the cavity 1162. For this reason, even though liquid level has passed through the position of the cavity 1162 due to ink consumption, it is erroneously determined that the liquid level has not passed through the position of the cavity 1162 and the amount of remaining ink is adequate, because ink is accumulated in the cavity 1162.

When the sensor unit disclosed in JP-A-2001-146024 or JP-A-2001-146030 is used, the ink is allowed to freely enter the cavity opposed to the vibration plate, but the ink is not allowed to enter the space in which the piezoelectric element and the like as electrical elements are disposed. Accordingly, the spaces between the adjacent elements should be liquid-tightly sealed at the time of mounting.

As the sealing structure, there is known a structure that the sensor unit is bonded directly to the circumferential edge of an opening of the container body or a structure that the sensor unit is bonded directly to the circumferential edge of an opening of a module and then the module is mounted on the container body with an O ring therebetween. However, since the sensor unit is bonded to the circumferential edge of the opening, deviation in size makes it difficult to secure the sealing ability. In addition, when the sensor unit is bonded directly to the circumferential edge of the opening of the container body or the circumferential edge of the opening of the module, it can be easily affected by a wave motion of the ink or bubbles in the ink, thereby causing erroneous detection.

SUMMARY OF THE INVENTION

The present invention has been contrived in consideration of the above-mentioned circumstances. A first object of the invention is to provide a mounting structure of a liquid sensor and a liquid container in which detection sensitivity can be enhanced by simplifying a vibration mode and existence of liquid can be reliably determined by reducing influence of vibration from the liquid.

A second object of the invention is to provide a container having a liquid detecting function in which a sealing work at the time of mounting a sensor unit on a container body can be simply and reliably carried out without being affected by accuracy in sizes of components and which has a structure that is little affected by a wave motion of ink or bubbles in the ink. To accomplish at least one of the objects, the invention has the following configuration:

<First Aspect>

(1) A mounting structure of a liquid sensor includes: a vibration cavity forming base portion which has a first surface and a second surface opposed to each other, in which a cavity for receiving a medium as a detection target is formed to be open toward the first surface, and in which the bottom surface of the cavity can vibrate; a piezoelectric element having a first electrode formed on the second surface side of the vibration cavity forming base portion, a piezoelectric layer formed on the first electrode, and a second electrode formed on the piezoelectric layer; a sensor including a flow path forming base portion which is formed on the first surface of the vibration cavity forming base portion and which has a liquid supply path for supplying liquid as a detection target to the cavity and a liquid discharge path for discharging the liquid as a detection target from the cavity; a mounting target member which is mounted with the sensor and which has an upstream space communicating with the liquid supply path, the liquid supplied to the liquid supply path existing in the upstream space, and a downstream space communicating with the liquid discharge path, the liquid discharged from the liquid discharge path existing in the downstream space; and an elastic seal member which is disposed between the sensor and the mounting target member and which has a supply side opening allowing the liquid supply path and the upstream space to communicate with each other and a discharge side opening allowing the liquid discharge path and the downstream space to communicate with each other, and which seals a gap between the liquid supply path and the upstream space and a gap between the liquid discharge path and the downstream space.

That is, in the invention, since the flow path forming base portion which is stacked on the first surface side of the vibration cavity forming base potion and which includes the liquid supply path for supplying the liquid as the detection target to the cavity and the liquid discharge path for discharging the liquid as the detection target from the cavity are provided, the supply of the liquid to the cavity is executed through the liquid supply path and the discharge of the liquid from the cavity is executed through the liquid discharge path. Accordingly, when the sensor is mounted on the container of the liquid as the detection target, it is possible to supply the liquid to the cavity through the liquid supply path without exposing the cavity of the sensor to a space reserving the liquid as the detection target.

In this way, by allowing the liquid to flow through the liquid supply path and the liquid discharge path of the sensor at the time of consuming the liquid, the bubbles are pushed out from the cavity due to the flow of the liquid even if the bubbles enter the cavity. Accordingly, it is possible to prevent the erroneous detection of the sensor due to the staying of the bubbles in the cavity, thereby enhancing the detection accuracy. In addition, the remaining liquid is reduced, thereby causing the decrease in industrial waste.

Since the cavity need not be exposed to the liquid reserving space, it is possible to prevent a meniscus from being formed in the cavity when the liquid passes through the liquid level. Accordingly, the erroneous detection of the sensor due to the liquid remaining in the cavity can be prevented. In addition, since the cavity is not exposed to the liquid reserving space but is partitioned from the liquid reserving space by the flow path forming base portion, a difference of the residual vibration remaining on the bottom surface of the cavity when the bottom surface of the cavity is compulsorily vibrated becomes larger depending upon the variation of the liquid level or the existence or nonexistence of the liquid. Accordingly, the detection sensitivity becomes higher, thereby enhancing the detection accuracy and preventing the erroneous detection.

Further, since the elastic seal member is disposed between the sensor and the mounting target member, the elastic seal member has the supply-side opening allowing the liquid supply path to communicate with the upstream space and the discharge-side opening allowing the liquid discharge path to communicate with the downstream space, and the elastic seal member serves to seal the space between the liquid supply path and the upstream space and the space between the liquid discharge path and the downstream space, it is possible to secure the detection accuracy and also to simplify the manufacturing processes.

That is, for example, when the space between the mounting target member and the sensor is sealed with an adhesive, the adhesive can be easily pressed out into the flow path formed by the liquid supply path and the upstream space or the flow path formed by the liquid discharge path and the downstream space. Then, since the bubbles are attached to the pressed-out adhesive and are not removed well, the bubbles have an influence on the residual vibration on the bottom surface of the cavity, thereby badly affecting the detection accuracy. Therefore, it should be managed not to press out the adhesive into the flow paths, thereby complicating the bonding process.

On the contrary, in the invention, since the elastic seal member seals the space between the liquid supply path and the upstream space and the space between the liquid discharge path and the downstream space, the adhesive is not pressed out into the flow paths at all, thereby solving the decrease in detection accuracy due to the attachment of bubbles or the complication of processes for managing not to press out the adhesive.

(2) In the mounting structure of a liquid sensor according to (1), the opening of the supply-side opening of the elastic seal member may be larger than the opening of the liquid supply path of the sensor and the opening of the discharge-side opening of the elastic seal member may be larger than the opening of the liquid discharge path of the sensor. In this case, it is possible to prevent the vibration of the bottom surface of the cavity from being delivered to the elastic seal member through the liquid. Accordingly, it is possible to prevent the decrease in detection accuracy due to the influence of the vibration generated in the elastic seal member on the residual vibration of the bottom surface of the cavity.

(3) In the mounting structure of a liquid sensor according to (2), the opening diameter of the supply-side opening of the elastic seal member may be set two or more times greater than the opening diameter of the liquid supply path of the sensor and the opening diameter of the discharge-side opening of the elastic seal member may be set two or more times greater than the opening diameter of the liquid discharge path of the sensor. In this case, it is possible to effectively prevent the vibration of the bottom surface of the cavity from being delivered to the elastic seal member through the liquid. Accordingly, it is possible to prevent the decrease in detection accuracy due to the influence of the vibration generated in the elastic seal member on the residual vibration of the bottom surface of the cavity.

(4) In the mounting structure of a liquid sensor according to (2) or (3), the supply-side opening of the elastic seal member and the liquid supply path of the sensor may be disposed concentrically and the discharge-side opening of the elastic seal member and the liquid discharge path of the sensor may be disposed concentrically. In this case, even when the vibration of the bottom surface of the cavity is slightly delivered to the elastic seal member through the liquid, the vibration mode generated in the elastic seal member can be further simplified by disposing the supply-side opening and liquid supply path and the discharge-side opening and the liquid discharge path, respectively, in a concentric manner. Accordingly, it is possible to suppress the decrease in detection accuracy due to the vibration generated in the elastic seal member as much as possible.

(5) In the mounting structure of a liquid sensor according to any one of (1) to (4), the openings of the liquid supply path and the liquid discharge path may be set to the same size and the openings of the supply-side opening and the discharge-side opening may be set to the same size. In this case, the shape of the space including the liquid supply path and the liquid discharge path through which the vibration of the bottom surface of the cavity is spread is simplified and thus the vibration mode of the residual vibration remaining on the bottom surface of the cavity is also simplified. Accordingly, the simulation for the residual vibration when the bottom surface of the cavity is compulsorily vibrated can be easily performed to reduce the difference between the actual phenomenon and the designed effect. As a result, the adjustment work can be reduced or the detection accuracy can be improved.

(6) In the mounting structure of a liquid sensor according to (5), the liquid supply path and supply-side opening and the liquid discharge path and discharge-side opening may be symmetrical about the center of the cavity. In this case, the shape of the space including the liquid supply path and the liquid discharge path through which the vibration of the bottom surface of the cavity is spread is simplified and thus the vibration mode of the residual vibration remaining on the bottom surface of the cavity is also simplified. Accordingly, the simulation for the residual vibration when the bottom surface of the cavity is compulsorily vibrated can be easily performed to reduce the difference between the actual phenomenon and the designed effect. As a result, the adjustment work can be reduced or the detection accuracy can be improved.

(7) The mounting structure of a liquid sensor according to any one of (1) to (6) may further comprise a bias member for fixing the sensor to the mounting target member by biasing the sensor toward the mounting target member. In this case, the sensor can be reliably mounted on the mounting target member by the use of the biasing force of the bias member and the elastic seal member is compressed by the biasing member, thereby little causing the deformation. Accordingly, even when the vibration of the bottom surface of the cavity is slightly delivered to the elastic seal member through the liquid, the elastic seal member little vibrates. Accordingly, it is possible to effectively prevent the decrease in detection accuracy due to the vibration of the elastic seal member.

(8) The mounting structure of a liquid sensor according to any one of (1) to (7) may further comprise a holding member which is mounted on the outer circumference of the elastic seal member to hold the elastic seal member externally. In this case, the deformation of the elastic seal member toward the outer circumference is regulated by the holding member and the deformation of the elastic seal member is further suppressed when the elastic seal member is compressed by the biasing force of the bias member. Accordingly, even when the vibration of the bottom surface of the cavity is slightly delivered to the elastic seal member through the liquid, the vibration of the elastic seal member is further suppressed. Accordingly, it is possible to effectively prevent the decrease in detection accuracy due to the vibration of the elastic seal member.

(9) In the mounting structure of a liquid sensor according to any one of (1) to (8), the mounting target member may be a buffer member which has as an upstream space a supply-side buffer chamber communicating with the liquid supply path and as a downstream space a discharge-side buffer chamber communicating with the liquid discharge path. In this case, the liquid supply path and the liquid discharge path through which the liquid enters and leaves the cavity are opened to the supply-side buffer chamber and the discharge-side buffer chamber, respectively, but not opened directly to the reserving space of the liquid as the detection target. Accordingly, even when bubbles are generated due to the vibration of the liquid in the liquid reserving space, the bubbles are once trapped by the supply-side buffer chamber and little enter the cavity. Therefore, it is possible to prevent the erroneous detection of the sensor due to the staying of the bubbles in the cavity.

In addition, since the liquid supply path and the liquid discharge path through which the liquid enters and leaves the cavity are opened to the supply-side buffer chamber and the discharge-side buffer chamber, respectively, but not opened directly to the reserving space of the liquid, the pressure of the liquid in the liquid reserving space does not act directly on the cavity. Therefore, it is possible to prevent the erroneous detection of the sensor due to the staying of the bubbles in the cavity.

(10) In the mounting structure of a liquid sensor according to (9), the supply-side buffer chamber and the discharge-side buffer chamber may be symmetrical about the center of the cavity. In this case, the shape of the members forming both buffer chambers is simplified by allowing the supply-side buffer chamber and the discharge-side buffer chamber to be symmetrical, thereby facilitating the manufacturing work and accomplishing decrease in size of the members.

(11) In the mounting structure of a liquid sensor according to (9) or (10), the supply-side buffer chamber and the discharge-side buffer chamber may have a volume ten or more times greater than the volume of the cavity. In this case, since the variation in pressure of the liquid generated in the liquid reserving space of the liquid container little affects the sensor characteristic of the sensor, it is possible to prevent erroneous detection of the sensor due to the influence of pressure such as the vibration of the liquid. In addition, since the pressure in both buffer chambers is not increased due to the vibration of the bottom surface of the cavity, extra vibration is not generated and thus the vibration mode of the residual vibration remaining on the bottom surface of the cavity is simplified, thereby enhancing the detection accuracy.

(12) In the mounting structure of a liquid sensor according to any one of (9) to (11), the buffer member may be mounted on a container body having a liquid delivery opening for sending out the liquid reserved therein, the supply-side buffer chamber may constitute an important part of the inner space of the container body and may communicate with a liquid reservoir chamber reserving the liquid, and the discharge-side buffer chamber may serve as a liquid delivery space communicating with the liquid delivery opening for sending out the liquid reserved in the inner space of the container body. In this case, the liquid reserved in the liquid reservoir chamber of the container body flows in the entrance of the supply-side buffer chamber of the sensor, is discharged from the exit of the discharge-side buffer chamber, and is sent to the liquid delivery opening of the container body. In addition, the whole amount of liquid sent to the liquid delivery opening of the container body previously passes through the supply-side buffer chamber, the cavity, and the discharge-side buffer chamber of the sensor. As a result, it is possible to reliably detect consumption of the liquid.

(13) A liquid container according to the invention includes: a container body having a liquid delivery opening for sending out liquid reserved therein; and a sensor mounted on the container body so as to detect the liquid therein. The sensor includes: a vibration cavity forming base portion which has a first surface and a second surface opposed to each other and in which a cavity for receiving a medium as a detection target is opened toward the first surface and the bottom surface of the cavity can vibrate; a piezoelectric element having a first electrode formed on the second surface side of the vibration cavity forming base portion, a piezoelectric layer formed on the first electrode, and a second electrode formed on the piezoelectric layer; and a flow path forming base portion which is stacked on the first surface side of the vibration cavity forming base portion and in which a liquid supply path for supplying the liquid as a detection target to the cavity and a liquid discharge path for discharging the liquid as the detection target from the cavity are formed. The container body has an upstream space which communicates with the cavity through the liquid supply path and in which the liquid supplied to the liquid supply path exists and a downstream space which communicates with the liquid discharge path and in which the liquid discharged from the liquid discharge path. The liquid container further includes an elastic seal member which is disposed between the sensor and the container body, which has a supply-side opening allowing the liquid supply path and the upstream space to communicate with each other and a discharge-side opening allowing the liquid discharge path and the downstream space to communicate with each other, and which seals a space between the liquid supply path and the upstream space and a space between the liquid discharge path and the downstream space, respectively.

(14) A mounting structure of a liquid sensor includes: a vibration cavity forming base portion which has a first surface and a second surface opposed to each other and in which a cavity for receiving a medium as a detection target is formed to be open toward the first surface and the bottom surface of the cavity can vibrate; a sensor including a piezoelectric element having a first electrode formed on the second surface side of the vibration cavity forming base portion, a piezoelectric layer formed on the first electrode, and a second electrode formed on the piezoelectric layer; a mounting target member having an upstream space which is mounted with the sensor and which communicates with the cavity through an upstream flow path and a downstream space which communicates with the cavity through a downstream flow path; and an elastic seal member which is disposed between the sensor and the mounting target member and which seals a space between the sensor and the mounting target member. The elastic seal member is disposed in a portion other than a flow path wall of a flow path space in which the cavity, the upstream flow path, and the downstream flow path communicate with each other.

That is, in the invention, since the mounting target member having the upstream space communicating with the cavity through the upstream flow path and the downstream space communicating with the cavity through the downstream flow path are provided, the supply of the liquid to the cavity is executed through the upstream flow path and the discharge of the liquid from the cavity is executed through the downstream flow path. Accordingly, when the sensor is mounted on the container of the liquid as the detection target, it is possible to supply the liquid to the cavity through the upstream flow path without exposing the cavity of the sensor to a reserving space of the liquid as the detection target.

In this way, by allowing the liquid to flow through the upstream flow path and the downstream flow path of the sensor at the time of consuming the liquid, the bubbles are pushed out from the cavity due to the flow of the liquid even if the bubbles enter the cavity. Accordingly, it is possible to prevent the erroneous detection of the sensor due to the staying of the bubbles in the cavity, thereby enhancing the detection accuracy. In addition, the remaining liquid is reduced, thereby causing the decrease in industrial waste.

Since the cavity need not be exposed to the liquid reserving space, it is possible to prevent a meniscus from being formed in the cavity when the liquid passes through the liquid level. Accordingly, the erroneous detection of the sensor due to the liquid remaining in the cavity can be prevented. In addition, since the cavity is not exposed to the liquid reserving space but is partitioned from the liquid reserving space by the member having the upstream flow path and the downstream flow path, a difference of the residual vibration remaining on the bottom surface of the cavity when the bottom surface of the cavity is compulsorily vibrated becomes larger depending upon the variation of the liquid level or the existence or nonexistence of the liquid. Accordingly, the detection sensitivity becomes higher, thereby enhancing the detection accuracy and preventing the erroneous detection.

Further, since the elastic seal member is disposed between the sensor and the mounting target member and the elastic seal member serves to seal the space between the sensor and the mounting target member, it is possible to secure the detection accuracy and also to simplify the manufacturing processes.

That is, for example, when the space between the mounting target member and the sensor is sealed with an adhesive, the adhesive can be easily pressed out into the flow paths in which the cavity communicate with the upstream flow path and the downstream flow path. Then, since the bubbles are attached to the pressed-out adhesive and are not removed well, the bubbles have an influence on the residual vibration of the bottom surface of the cavity, thereby badly affecting the detection accuracy. Therefore, it should be managed not to press out the adhesive into the flow paths, thereby complicating the bonding process.

On the contrary, in the invention, since the elastic seal member seals the space between the sensor and the mounting target member, the adhesive is not pressed out into the flow paths at all, thereby solving the decrease in detection accuracy due to the attachment of bubbles or the complication of processes for managing not to press out the adhesive.

In addition, since the elastic seal member is disposed in a portion other than a flow path wall of a flow path space in which the cavity, the upstream flow path, and the downstream flow path communicate with each other, the vibration of the bottom surface of the cavity is not delivered to the elastic seal member through the liquid. Accordingly, it is possible to prevent the decrease in detection accuracy due to the influence of the vibration generated in the elastic seal member on the residual vibration of the bottom surface of the cavity.

That is, for example, when the elastic seal member is exposed to the flow path space between the upstream flow path or the downstream flow path and the cavity, the vibration of the bottom surface of the cavity may be delivered to the elastic seal member through the liquid to make the elastic seal member vibrate and the vibration of the elastic seal member may affect the vibration of the bottom surface of the cavity, thereby complicating the vibration mode. Accordingly, by disposing the elastic seal member in a portion other than the flow path wall of the flow path space in which the cavity, the upstream flow path, and the downstream flow path communicate with each other, such a problem can be previously prevented, thereby preventing the decrease in detection accuracy.

(15) In the mounting structure of a liquid sensor according to (14), a flow path projection in which the upstream flow path and the downstream flow path are opened may be formed in the mounting target member and the elastic seal member may seal a space between the sensor and the mounting target member at the outer circumference of the flow path projection. In this case, by opposing and then bonding the surface of the flow path projection in which the upstream flow path and the downstream flow path are opened to the cavity of the sensor, the upstream flow path and the downstream flow path are allowed to communicate with the cavity, thereby forming a flow path. Further, by sealing the surroundings of the opposite portions with the elastic seal member, it is possible to satisfactorily perform the sealing without exposing the elastic seal member to the flow path.

(16) In the mounting structure of a liquid sensor according to (14), a ring-shaped projection surrounding the openings of the upstream flow path and the downstream flow path may be formed on the surface of the flow path projection opposed to the sensor. In this case, when the surface of the flow path projection in which the upstream flow path and the downstream flow path are opened is opposed to the cavity of the sensor and the upstream flow path and the downstream flow path are allowed to communicate with the cavity to form a flow path, the ring-shaped projection comes in close contact with the sensor and thus the fine clearance due to the flatness of the bonding portions between the cavity and the flow path projection becomes very small, thereby further enhancing the sealing ability. In addition, since the contact of the elastic seal member with the liquid is almost prevented, the vibration of the elastic seal member through the liquid can be almost prevented, thereby surely preventing the decrease in detection accuracy.

(17) In the mounting structure of a liquid sensor according to any one of (14) to (16), the upstream flow path and the downstream flow path may be symmetrical about the center of the cavity. In this case, the shape of the space including the upstream flow path and the downstream flow path through which the vibration of the bottom surface of the cavity is spread can be simplified and thus the vibration mode of the residual vibration remaining on the bottom surface of the cavity can be also simplified. Accordingly, the simulation for the residual vibration when the bottom surface of the cavity is compulsorily vibrated can be easily performed to reduce the difference between the actual phenomenon and the designed effect. As a result, the adjustment work can be reduced or the detection accuracy can be improved.

(18) In the mounting structure of a liquid sensor according to any one of (14) to (17), the upstream flow path and the downstream flow path may be set to have a flow path area smaller than that of the cavity and to have such a length that fluidal mass exists therein. In this case, since an appropriate flow-path resistance is generated in the upstream flow path and the downstream flow path, it is possible to prevent the variation in pressure in the cavity due to the vibration of the bottom surface of the cavity from being spread into the upstream space or the downstream space and to generate appropriate residual vibration, thereby enhancing and securing the detection accuracy.

(19) The mounting structure of a liquid sensor according to any one of (14) to (18) may further comprise a bias member for fixing the sensor to the mounting target member by biasing the sensor toward the mounting target member. In this case, the sensor can be reliably mounted on the mounting target member by the use of the biasing force of the bias member and the elastic seal member is compressed by the biasing member, thereby little causing the deformation. Accordingly, even when the vibration of the bottom surface of the cavity is slightly delivered to the elastic seal member through the liquid, the elastic seal member little vibrates. Accordingly, it is possible to effectively prevent the decrease in detection accuracy due to the vibration of the elastic seal member.

(20) In the mounting structure of a liquid sensor according to any one of (14) to (19), the mounting target member may be a buffer member which has as an upstream space a supply-side buffer chamber communicating with the liquid supply path and as a downstream space a discharge-side buffer chamber communicating with the liquid discharge path. In this case, the upstream flow path and the downstream flow path through which the liquid enters and leaves the cavity are opened to the supply-side buffer chamber and the discharge-side buffer chamber, respectively, but not opened directly to the reserving space of the liquid as the detection target. Accordingly, even when the bubbles are generated due to the vibration of the liquid in the liquid reserving space, the bubbles are once trapped by the supply-side buffer chamber and little enter the cavity. Therefore, it is possible to prevent the erroneous detection of the sensor due to the staying of the bubbles in the cavity.

In addition, since the upstream flow path and the downstream flow path through which the liquid enters and leaves the cavity are opened to the supply-side buffer chamber and the discharge-side buffer chamber, respectively, but not opened directly to the liquid reserving space, the pressure of the liquid in the liquid reserving space does not act directly on the cavity. Therefore, it is possible to prevent the erroneous detection of the sensor due to the staying of the bubbles in the cavity.

(21) In the mounting structure of a liquid sensor according to (20), the supply-side buffer chamber and the discharge-side buffer chamber may be symmetrical about the center of the cavity. In this case, the shape of the members forming both buffer chambers is simplified by allowing the supply-side buffer chamber and the discharge-side buffer chamber to be symmetrical, thereby facilitating the manufacturing work and accomplishing decrease in size of the members.

(22) In the mounting structure of a liquid sensor according to (20) or (21), the supply-side buffer chamber and the discharge-side buffer chamber may have a volume ten or more times greater than the volume of the cavity. In this case, since the variation in pressure of the liquid generated in the liquid reserving space of the liquid container little affects the sensor characteristic of the sensor, it is possible to prevent erroneous detection of the sensor due to the influence of pressure such as the vibration of the liquid. In addition, since the pressure in both buffer chambers is not increased due to the vibration of the bottom surface of the cavity, extra vibration is not generated and thus the vibration mode of the residual vibration remaining on the bottom surface of the cavity is simplified, thereby enhancing the detection accuracy.

(23) In the mounting structure of a liquid sensor according to any one of (20) to (22), the buffer member may be mounted on a container body having a liquid delivery opening for sending out the liquid reserved therein, the supply-side buffer chamber may constitute an important part of the inner space of the container body and may communicate with a liquid reservoir chamber reserving the liquid, and the discharge-side buffer chamber may serve as a liquid delivery space communicating with the liquid delivery opening for sending out the liquid reserved in the inner space of the container body. In this case, the liquid reserved in the liquid reservoir chamber of the container body flows in the entrance of the supply-side buffer chamber of the sensor, is discharged from the exit of the discharge-side buffer chamber, and is sent to the liquid delivery opening of the container body. In addition, the whole amount of liquid sent to the liquid delivery opening of the container body previously passes through the supply-side buffer chamber, the cavity, and the discharge-side buffer chamber of the sensor. As a result, it is possible to reliably detect the consumption of liquid.

(24) A liquid container according to the invention includes: a container body having a liquid delivery opening for sending out liquid reserved therein; and a sensor mounted on the container body so as to detect the liquid therein. The sensor includes: a vibration cavity forming base portion which has a first surface and a second surface opposed to each other and in which a cavity for receiving a medium as a detection target is opened toward the first surface and the bottom surface of the cavity can vibrate; and a piezoelectric element having a first electrode formed on the second surface side of the vibration cavity forming base portion, a piezoelectric layer formed on the first electrode, and a second electrode formed on the piezoelectric layer. The container body has an upstream space communicating with the cavity through the upstream flow path and a downstream space communicating with the cavity through the downstream flow path. The liquid container further includes an elastic seal member which is disposed between the sensor and the container body and which seals a space between the sensor and the container body. The elastic seal member is disposed in a portion other than a flow path wall of a flow path space in which the upstream flow path and the downstream flow path communicate with the cavity.

<Second Aspect>

(1) A liquid container having a liquid detecting function includes: a container body having a liquid reservoir therein, a delivery path for sending out liquid from the reservoir, and a sensor receiving portion disposed in the delivery path; a sensor unit which is mounted on the sensor receiving portion and which detects the liquid; a buffer chamber which is disposed in the container body, is adjacent to the sensor receiving portion through a sensor receiving wall, and is disposed in the delivery path so as to communicate with the upstream side and the downstream side of the delivery path; a ring-shaped seal member having elasticity and sealing a space between the sensor unit and the sensor receiving wall; and a pressurizing spring for pressurizing the sensor unit against the sensor receiving wall to crush the seal member and to give a surface pressure necessary for the sealing to the seal member, the sensor unit, and the sensor receiving wall.

According to the invention, the ring-shaped seal member having elasticity is disposed between the sensor unit and the sensor receiving wall and the space between the sensor unit and the sensor receiving wall is sealed while crushing the seal member by pressurizing the sensor unit against to the sensor receiving wall with the pressurizing spring. Accordingly, when the sensor unit is separately assembled in advance and then the sensor unit is fitted into the container body, the assembly can be performed more simply than the case that the adhesive is used. In addition, since the deviation in size between the components can be absorbed by the use of the elasticity of the seal member, it is possible to satisfactorily perform the sealing work with simple assembly. Further, since a liquid reserving space sealed with the seal member is secured in the front (the opening side) of the sensor cavity, it is little affected by the wave motion of ink or the bubbles in the ink.

(2) The liquid container according to (1), the sensor unit may include a sensor chip for detecting the liquid, a sensor base for supporting the sensor chip, and a unit base for supporting the sensor base. The pressurizing spring may serve to give a pressurizing force to the unit base through the sensor base or the sensor chip.

The pressurizing force of the pressurizing spring is applied to the unit base through the sensor base or the sensor chip. Accordingly, for example, when the pressurizing force of the pressurizing spring is applied to the sensor chip, the surface pressure of the sealing surfaces between the sensor chip and the sensor base and between the sensor base and the unit base can be together enhanced, thereby enhancing the sealing ability therebetween. For example, when the pressurizing force of the pressurizing spring is applied to the sensor base, the surface pressure of the sealing surface between the sensor base and the unit base can be together enhanced, thereby enhancing the sealing ability therebetween. In the latter, since an unnecessary weight need not be applied to the sensor chip, the detection characteristic is little affected.

(3) In the liquid container according to (2), the sensor chip may have a sensor cavity for receiving the liquid as a detection target, in which the bottom surface of the sensor cavity is opened so as to receive the liquid, the top surface is closed with a vibration plate, and a piezoelectric element is disposed on the top surface of the vibration plate. The sensor base may be a metal base body for mounting and fixing the sensor chip thereto. The unit base may be a resin base body for mounting and fixing the sensor base thereto and the bottom surface thereof is opposed to the sensor receiving wall with the seal member when the sensor unit is mounted on the sensor receiving portion. A liquid reserving space communicating with the sensor cavity may be formed in the sensor base and the unit base and a flow path communicating with the liquid reserving space and the buffer chamber at the inside of the ring-shaped seal member may be provided in the sensor receiving wall.

(4) In the liquid container according to any one of (1) to (3), the pressurizing spring may be received between the wall of the sensor receiving portion opposed to the sensor unit and the sensor unit with a compressed posture.

According to the invention, since the pressurizing spring is received in the sensor receiving portion with a compressed posture, the assembly work can be finished only by inserting the pressurizing spring into the sensor receiving portion together with the sensor unit.

(5) In the liquid container according to any one of (1) to (4), a pressing cover may be disposed above the sensor chip and the pressurizing force of the pressurizing spring may be given to the sensor base or the sensor chip through the pressing cover.

According to the invention, since the pressing cover is disposed above the sensor chip, it is possible to protect the sensor chip. In addition, since the weight of the pressurizing spring is applied to the sensor chip or the sensor base through the pressing cover, the degree of freedom in combination of the pressurizing spring and the sensor chip or the sensor base can be enhanced.

(6) In the liquid container according to any one of (1) to (5), a recessed portion may be formed on the top surface of the unit base and the sensor base is received in the recessed portion, the sensor chip and the sensor base may be fixed to each other and sealed with an adhesive layer disposed on the top surface of the sensor base, and the sensor base and the unit base may be fixed to each other and sealed with an adhesive film of which the inner circumference is bonded to the top surface of the sensor base with the adhesive layer therebetween and of which the outer circumference is bonded to the top surface wall around the recessed portion of the unit base.

According to the invention, only by inserting the sensor base mounted with the sensor chip into the unit base from the upside and bonding the adhesive film onto the top surfaces of two arranged components, that is, on both top surfaces of the sensor base and the unit base, the fixation and sealing between two components made of different materials (the metal sensor base and the resin unit base) can be simultaneously carried out. Accordingly, the workability of assembly is very excellent. Since the adhesive film is bonded to two components, the sealing between the components can be carried out without being affected by the size accuracy of the components. For example, when the adhesive film is heated, pressed, and then fused by the use of a mass production machine, the sealing ability can be improved only by managing the temperature and pressure of the mass production machine, thereby accomplishing the stabilization at the time of mass production. Since the adhesive film having a large influence on the sealing ability can be easy in applicability and excellent in space efficiency, it is possible to accomplish the decrease in size of the sensor unit.

(7) In the liquid container according to (6), the top surface of the sensor base may protrude upwardly from the recessed portion of the unit base and the adhesive film may be bonded to the top surface of the sensor base at a position higher than the bonding position on the top surface wall around the recessed portion of the unit base.

According to the invention, since the height of the film bonding surface on the unit base is set lower than the height of the film bonding surface on the sensor base, the sensor base can be pressed with the adhesive film by a level difference, thereby strengthening the fixing force of the sensor base to the unit base. They may be provided without level difference.

(8) In the liquid container according to any one of (1) to (5), the sensor base and the unit base may have an entrance-side flow path and an exit-side flow path for the sensor cavity, respectively, as the liquid reserving space. The container body may have an upstream buffer chamber communicating with the upstream side of the delivery path and the entrance-side flow path and a downstream buffer chamber communicating with the downstream side of the delivery path and the exit-side flow path, as the buffer chamber. The liquid flowing from the upstream side of the delivery path may be supplied to the sensor cavity through the upstream buffer chamber and the entrance-side flow path and may be discharged to the downstream side of the delivery path through the exit-side flow path and the downstream buffer chamber from the sensor cavity.

According to the invention, since the liquid flowing from the upstream side of the delivery path in the container body is supplied to the sensor cavity through the upstream buffer chamber and the entrance-side flow paths of the unit base and the sensor base and may be discharged to the downstream side of the delivery path through the exit-side flow paths of the sensor base and the unit base and the downstream buffer chamber from the sensor cavity, the liquid always flows in the sensor cavity. Accordingly, it is possible to prevent the erroneous detection due to the staying of the liquid or bubbles in the sensor cavity.

(9) A liquid container having a liquid detecting function includes: a container body having a liquid reservoir therein and a delivery path for sending out liquid from the reservoir; a sensor receiving portion disposed in the container body in the vicinity of the end of the delivery path; a sensor unit which is disposed in the sensor receiving portion so as to detect the liquid; a buffer chamber which is disposed in the container body, is adjacent to the sensor receiving portion through a sensor receiving wall, and is disposed in series in the delivery path so as to communicate with the upstream side and the downstream side of the delivery path; a ring-shaped seal member having elasticity and sealing a space between the sensor unit and the sensor receiving wall; and a pressurizing spring for pressurizing the sensor unit against the sensor receiving wall to crush the seal member and to give a surface pressure necessary for the sealing to the seal member, the sensor unit, and the sensor receiving wall. The sensor unit includes: a sensor chip having a sensor cavity for receiving the liquid as a detection target, in which the bottom surface of the sensor cavity is opened so as to receive the liquid, the top surface is closed with a vibration plate, and a piezoelectric element is disposed on the top surface of the vibration plate; a metal sensor base for mounting and fixing the sensor chip thereto; and a resin unit base for mounting and fixing the sensor base thereto, in which the bottom surface thereof is opposed to the sensor receiving wall with the seal member therebetween when the sensor unit is mounted on the sensor receiving portion. A liquid reserving space communicating with the sensor cavity is formed in the sensor base and the unit base and a flow path communicating with the liquid reserving space and the buffer chamber at the inside of the ring-shaped seal member is provided in the sensor receiving wall. The pressurizing spring serves to give the pressurizing force only to the unit base through a force delivering path bypassing the sensor base and the sensor chip of the sensor unit.

According to the invention, the ring-shaped seal member having elasticity is disposed between the sensor unit and the sensor receiving wall and the space between the sensor unit and the sensor receiving wall is sealed while crushing the seal member by pressurizing the sensor unit against the sensor receiving wall with the pressurizing spring. Accordingly, when the sensor unit is separately assembled in advance and then the sensor unit is fitted into the container body, the assembly work can be performed more simply than the case that the adhesive is used. In addition, since the deviation in size between the components can be absorbed by the use of the elasticity of the seal member, it is possible to satisfactorily perform the sealing work with simple assembly. Further, since a liquid reserving space sealed with the seal member is secured in the front (the opening side) of the sensor cavity, it is little affected by the wave motion of ink or the bubbles in the ink. Furthermore, since the pressurizing force of the pressurizing spring is applied directly to the unit base opposed to the sensor receiving wall, the pressurizing force can be prevented from acting on the sensor base or the sensor chip, thereby enhancing the detection accuracy.

(10) In the liquid container having a liquid detecting function according to (9), the pressurizing spring may be received between the wall of the sensor receiving portion opposed to the sensor unit and the sensor unit with a compressed posture.

According to the invention, since the pressurizing spring is received in the sensor receiving portion with a compressed posture, the assembly work can be finished only by inserting the pressurizing spring into the sensor receiving portion together with the sensor unit.

(11) In the liquid container having a liquid detecting function according to (9) or (10), a pressing cover may be disposed above the unit base to cover the sensor chip without contacting the sensor chip and the sensor base and the pressurizing force of the pressurizing spring may be given to the unit base through the pressing cover.

According to the invention, since the pressing cover is disposed above the unit base, it is possible to protect the sensor chip and the sensor base. In addition, since the weight of the pressurizing spring is applied to the unit base through the pressing cover, the degree of freedom in combination of the pressurizing spring and the unit base can be enhanced.

(12) In the liquid container having a liquid detecting function according to (9), a cover member for covering the sensor chip and the sensor base is mounted above the unit base without directly contacting the unit base, the cover member is fixed to the container body with a screw, and the pressurizing spring is interposed between the cover member and the unit base with a compressed posture.

According to the invention, since the pressing cover is disposed above the unit base, it is possible to protect the sensor chip and the sensor base. In addition, since the cover member is fixed to the container body with screws and the pressurizing spring is disposed between the cover member and the unit base with a compressed posture, it is possible to compactly assemble the pressurizing spring.

(13) In the liquid container having a liquid detecting function according to (12), the pressurizing spring may be composed of a leaf spring and the leaf spring may be formed integrally with a terminal plate electrically connected to an electrode of the sensor chip.

According to the invention, since the pressurizing spring is composed of a leaf spring and the leaf spring is formed integrally with a terminal plate electrically connected to an electrode of the sensor chip, it is possible to perform a compact assembly work and to reduce the number of components, thereby reducing the number of assembly steps.

(14) In the liquid container having a liquid detecting function according to any one of (9) to (13), a recessed portion may be formed on the top surface of the unit base and the sensor base may be received in the recessed portion. The sensor chip and the sensor base may be fixed to each other and sealed with an adhesive layer disposed on the top surface of the sensor base. The sensor base and the unit base may be fixed to each other and sealed with an adhesive film of which the inner circumference is bonded to the top surface of the sensor base with the adhesive layer therebetween and of which the outer circumference is bonded to the top surface wall around the recessed portion of the unit base.

According to the invention, only by inserting the sensor base mounted with the sensor chip into the unit base from the upside and bonding the adhesive film onto the top surfaces of two arranged components, that is, on both top surfaces of the sensor base and the unit base, the fixation and sealing between two components made of different materials (the metal sensor base and the resin unit base) can be simultaneously carried out. Accordingly, the workability of assembly is very excellent. Since the adhesive film is bonded to two components, the sealing between the components can be carried out without being affected by the size accuracy of the components. For example, when the adhesive film is heated, pressed, and then fused by the use of a mass production machine, the sealing ability can be improved only by managing the temperature and pressure of the mass production machine, thereby accomplishing the stabilization at the time of mass production. Since the adhesive film having a large influence on the sealing ability can be easy in applicability and excellent in space efficiency, it is possible to accomplish the decrease in size of the sensor unit.

(15) In the liquid container having a liquid detecting function according to (14), the top surface of the sensor base may protrude upwardly from the recessed portion of the unit base and the adhesive film may be bonded to the top surface of the sensor base at a position higher than the bonding position on the top surface wall around the recessed portion of the unit base.

According to the invention, since the height of the film bonding surface on the unit base is set lower than the height of the film bonding surface on the sensor base, the sensor base can be pressed with the adhesive film by a level difference, thereby strengthening the fixing force of the sensor base to the unit base. They may be provided without level difference.

(16) In the liquid container having a liquid detecting function according to any one of (9) to (15), the sensor base and the unit base may have an entrance-side flow path and an exit-side flow path for the sensor cavity, respectively, as the liquid reserving space, the container body may have an upstream buffer chamber communicating with the upstream side of the delivery path and the entrance-side flow path and a downstream buffer chamber communicating with the downstream side of the delivery path and the exit-side flow path, as the buffer chamber, the liquid flowing from the upstream side of the delivery path may be supplied to the sensor cavity through the upstream buffer chamber and the entrance-side flow path and is discharged to the downstream side of the delivery path through the exit-side flow path and the downstream buffer chamber from the sensor cavity.

According to the invention, since the liquid flowing from the upstream side of the delivery path in the container body is supplied to the sensor cavity through the upstream buffer chamber and the entrance-side flow paths of the unit base and the sensor base and is discharged to the downstream side of the delivery path through the exit-side flow paths of the sensor base and the unit base and the downstream buffer chamber from the sensor cavity, the liquid always flows through the sensor cavity. Accordingly, it is possible to prevent the erroneous detection due to the staying of the liquid or bubbles in the sensor cavity.

DETAILED DESCRIPTION OF THE INVENTION

Figure 1:
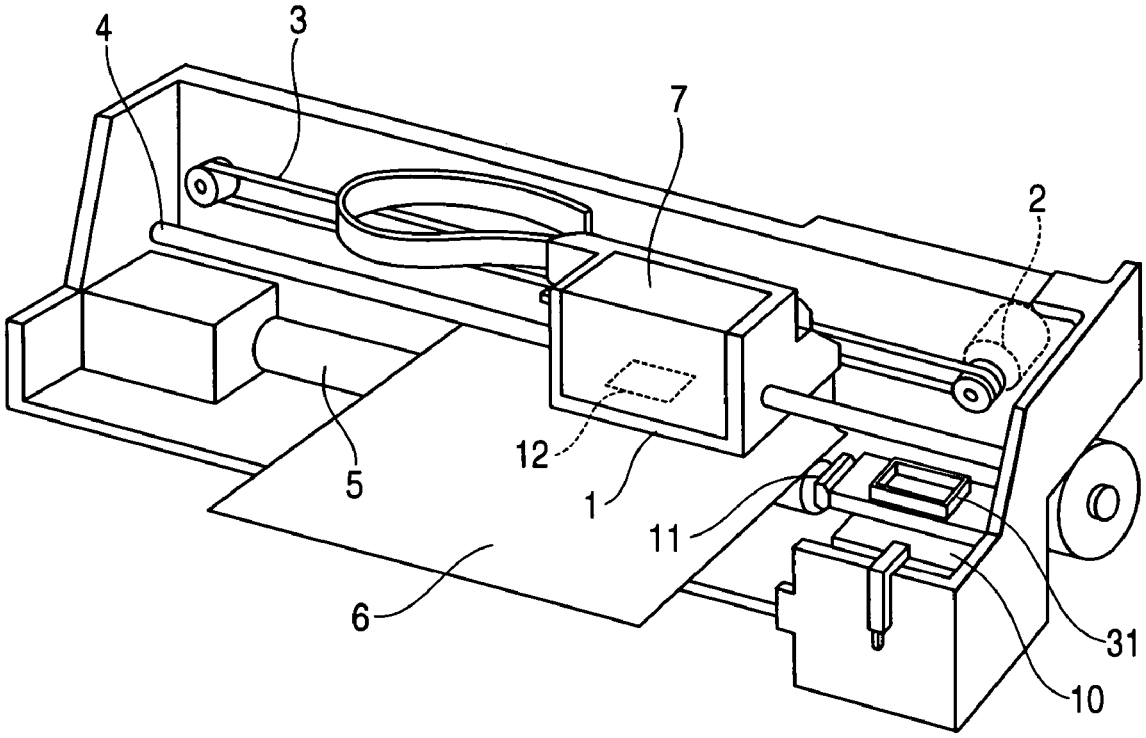
FIG. 1 is a perspective view illustrating a schematic configuration of an inkjet printer employing an ink cartridge having a liquid sensor according to the present invention.

FIG. 1 shows a schematic configuration of an inkjet printer (liquid jetting apparatus) employing an ink cartridge having a liquid sensor according to the present invention. In FIG. 1, reference numeral 1 denotes a carriage. The carriage 1 is guided to a guide member 4 through a timing belt 3 which is actuated by a carriage motor 2 and reciprocates in the axis direction of a platen 5.

A side of the carriage 1 facing a recording paper 6 is mounted with an inkjet printing head 12 and an ink cartridge 7 for supplying ink to the printing head 12 is detachably fitted thereon.

At a home position (the right side in the figure) which is a non-printing region of the printer, a cap member 31 is disposed. When the printing head 12 mounted on the carriage 1 moves to the home position, the cap member 31 is pressed against a nozzle forming surface of the printing head 12 to form a closed space between the cap member and the nozzle forming surface. A pump unit 10 for applying a negative pressure to the closed space formed by the cap member 31 to perform a cleaning work or the like is disposed below the cap member 31.

In the vicinity of the printing region of the cap member 31, a wiping unit 11 having an elastic plate such as rubber or the like is disposed so as to advance and retreat, for example, in the horizontal direction with respect to the moving locus of the printing head 12. Therefore, when the carriage 1 reciprocates toward the cap member 31, the nozzle forming surface of the printing head 12 can be wiped off as needed.

Now, a mounting structure of a liquid sensor according to a first aspect of the invention will be described with reference to the drawings.

Figure 2:
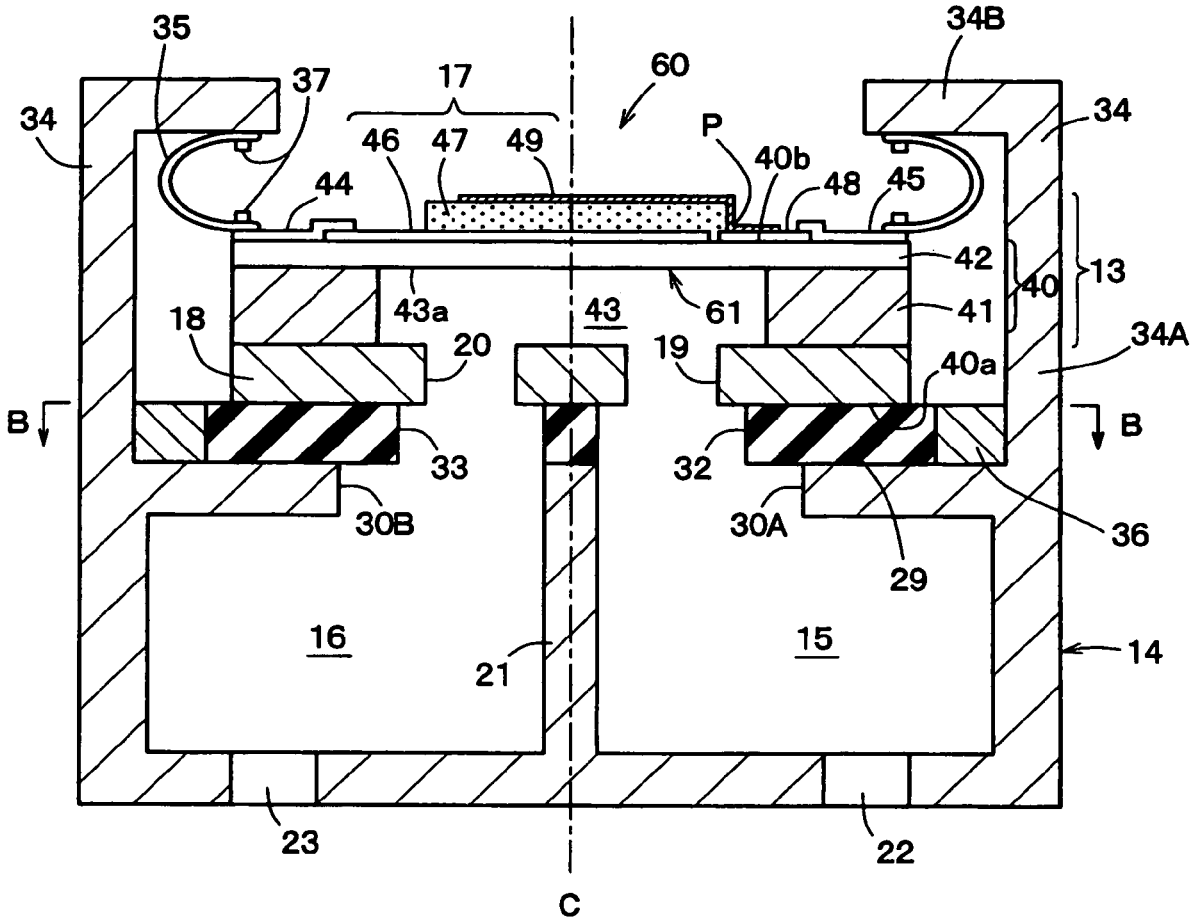
FIG. 2 is a cross-sectional view illustrating a liquid sensor employing a mounting structure according to a first embodiment of a first aspect of the invention, which is taken along Line A-A of FIG. 3.
Figure 3:
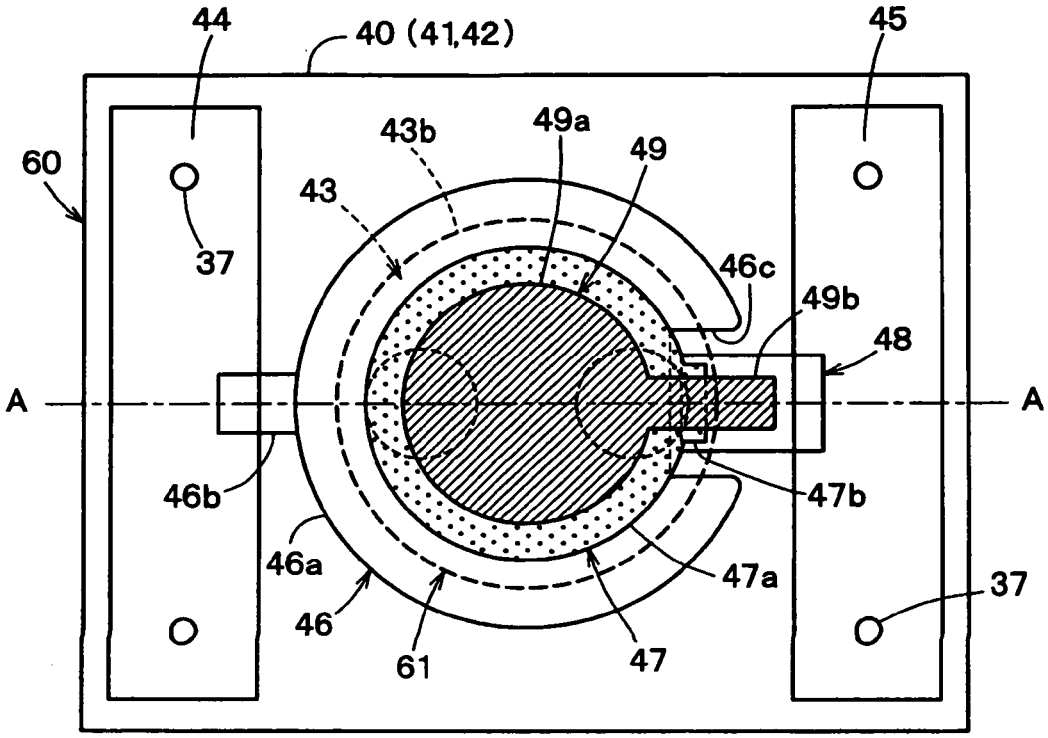
FIG. 3 is a diagram illustrating a sensor unit of the liquid sensor, where (a) is a plan view and (b) is a bottom view.
Figure 3:
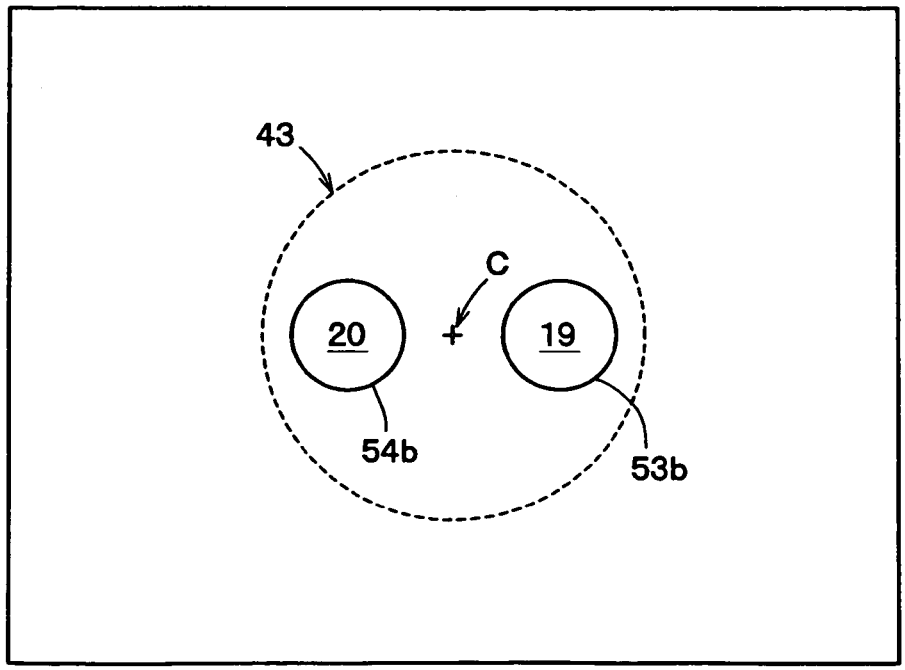
Figure 4:
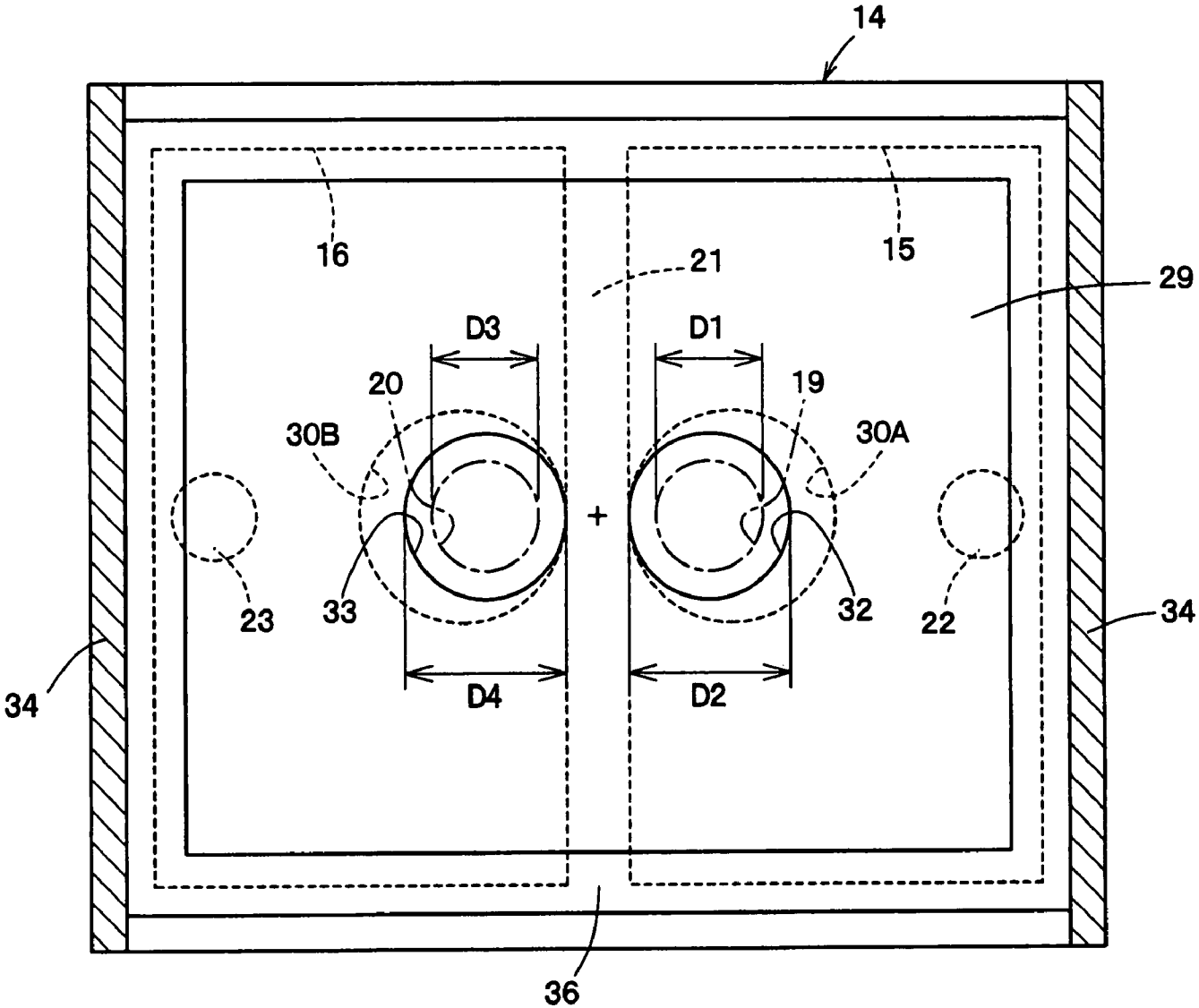
FIG. 4 is a cross-sectional view of a buffer portion of the liquid sensor, which is taken along Line B-B of FIG. 2.

FIG. 2 is a cross-sectional view illustrating a liquid sensor 60 employing a mounting structure according to a first embodiment of the first aspect of the invention. FIG. 3 is a diagram illustrating a sensor unit (sensor) 13 of the liquid sensor 60 and FIG. 4 is a diagram illustrating a buffer portion and an elastic seal member 29 constituting the liquid sensor 60.

In the present embodiment, the liquid sensor 60 is constituted by the entire elements shown in FIG. 2, which includes the sensor unit 13 corresponding to the sensor according to the invention and the buffer portion 14 corresponding to the mounting target member according to the invention and the liquid sensor 60 is mounted on a container body 72 to be described later, thereby constituting an ink cartridge 70.

The liquid sensor 60 includes a sensor unit 13 having a cavity 43 and a buffer portion (mounting target member) 14 having a supply-side buffer chamber (upstream space) and a discharge-side buffer chamber (downstream space) 16 which communicate with the cavity 43.

The sensor unit 13 is mounted on the top surface of the buffer portion 14 with the elastic seal member 29 therebetween and the space between the sensor unit 13 and the buffer portion 14 is sealed with the elastic seal member 29. The sensor unit 13 is pressed and fixed onto the top surface of the buffer portion 14 by means of a sensor fixing member 34 and a bias member 35 having a hook shape formed on the top surface of the buffer portion 14.

The sensor unit 13 in which a vibration plate 42 is stacked on a cavity plate 41 includes a vibration cavity forming base portion 40 having a first surface 40*a* and a second surface 40*b* which are opposed to each other, a piezoelectric element 17 stacked on the side of the second surface 40*b* of the vibration cavity forming base portion 40, and a flow path forming plate (flow path forming base portion) 18 stacked on the side of the first surface 40*a* of the vibration cavity forming base portion 40.

In the vibration cavity forming base portion 40, the cavity 43 for receiving a medium (ink) to be sensed is defined by a cylindrical space so as to be opened to the first surface 40*a* and a bottom portion 43*a* of the cavity 43 is formed so as to be vibrated by the vibration plate 42. In other words, an outline of an actually vibrated portion in the entire vibration plate 42 is defined by the cavity 43. On both ends of the vibration cavity forming base portion 40 on the side of the second surface 40*b*, a lower electrode terminal 44 and an upper electrode terminal 45 are formed.

On the second surface 40*b* of the vibration cavity forming base portion 40, a lower electrode (a first electrode) 46 is formed, which has a body portion 46*a* having a substantially circular shape and an extension portion 46*b* extending toward the lower electrode terminal 44 from the body portion 46*a* to be connected to the lower electrode terminal 44. The center of the substantially circular body portion 46*a* of the lower electrode 46 is brought into line with the center axis C of the cavity 43.

The substantially circular body portion 46*a* of the lower electrode 46 is formed so as to have a larger diameter than that of the circular cavity 43 and to cover the substantially entire portion of the region corresponding to the cavity 43. Further, the substantially circular body portion 46*a* of the lower electrode 46 includes a notched portion 46*c* which is formed further inward from a position corresponding to a circumferential edge 43*b* of the cavity 43.

A piezoelectric layer 47 is stacked on the lower electrode 46 and the piezoelectric layer 47 includes a circular body portion 47*a* with a smaller diameter than that of the cavity 43 and a projected portion 47*b* projected from the body portion 47*a* in the range of the region corresponding to the cavity 43. As can be seen from FIG. 2, the entire portion of the piezoelectric layer 47 belongs to the range of the region corresponding to the cavity 43. In other words, the piezoelectric layer 47 does not have nay portion extending across the position corresponding to the circumferential edge 43*b* of the cavity 43.

The center of the body portion 47*a* of the piezoelectric layer 47 is brought into line with the center axis C of the cavity 43. The substantially entire portion of the body portion 47*a* of the piezoelectric layer 47 is stacked on the lower electrode 46, except for the portion corresponding to the notched portion 46*c* of the lower electrode 46.

An auxiliary electrode 48 is formed on the second surface 40*b* of the vibration cavity forming base portion 40. The auxiliary electrode 48 extends over the position corresponding to the circumferential edge 43*b* of the cavity 43 to the inside of the region corresponding to the cavity 43 from the outside of the region corresponding to the cavity 43. A portion of the auxiliary electrode 48 is positioned inside the notched portion 46*c* of the lower electrode (the first electrode) 46 to support the projected portion 47*b* of the piezoelectric layer 47 and the peripheral portion thereof from the side of the second surface 40*b* of the vibration cavity forming base portion 40. The auxiliary electrode 48 is preferably made of the same material as the lower electrode 46 and has the same thickness as the lower electrode 46. By supporting the projected portion 47*b* of the piezoelectric layer 47 and the peripheral portion thereof from the side of the second surface 40*b* of the vibration cavity forming base portion 40 by the use of the auxiliary electrode 48, a level difference is not generated in the piezoelectric layer 47 and thus it is possible to prevent decrease in mechanical strength.

The circular body portion 49*a* of the upper electrode (second electrode) 49 is stacked on the piezoelectric layer 47 and the upper electrode 49 has a diameter smaller than that of the body portion 47*a*. The upper electrode 49 has an extension portion 49*b* which is projected from the body portion 49*a* and is connected to the auxiliary electrode 48. As can be seen from FIG. 2, a position P where the extension portion 49*b* of the upper electrode 49 first comes in contact with the auxiliary electrode 48 is positioned in the region corresponding to the cavity 43.

The respective body portions of the lower electrode 46, the piezoelectric layer 47, and the upper electrode 49 constitute a piezoelectric element 17.

As can be seen from FIG. 3, the upper electrode 49 is electrically connected to an upper electrode terminal 45 through the auxiliary electrode 48. In this way, by connecting the upper electrode 49 to the upper electrode terminal 45 through the auxiliary electrode 48, the level difference resulting from the total thickness of the piezoelectric layer 47 and the lower electrode 46 can be absorbed by both of the upper electrode 49 and the auxiliary electrode 48. Accordingly, it is possible to prevent the mechanical strength from being reduced due to a large level difference in the upper electrode 49.

The body portion 49*a* of the upper electrode 49 has a circular shape and the center thereof is brought into line with the center axis C of the cavity 43. The body portion 49*a* of the upper electrode 49 has a diameter smaller than those of the body portion 47*a* of the piezoelectric layer 47 and the cavity 43.

In this way, the body portion 47*a* of the piezoelectric layer 47 is interposed between the body portion 49*a* of the upper electrode 49 and the body portion 46*a* of the lower electrode 46. Accordingly, the piezoelectric layer 47 can be effectively deformed and actuated.

The body portion 49*a* of the upper electrode 49 has the smaller diameter among the body portion 46*a* of the lower electrode 46 and the body portion 49*a* of the upper electrode 49 electrically connected to the piezoelectric layer 47. Therefore, the body portion 49*a* of the upper electrode 49 determines the range of the portion where the piezoelectric effect is generated from the piezoelectric layer 47.

The respective centers of the body portion 47*a* of the piezoelectric layer 47, the body portion 49*a* of the upper electrode 49, and the body portion 46*a* of the lower electrode 46 are brought into line with the center axis C of the cavity 43. In addition, the center axis C of the cylindrical cavity 43 determining the range of the portions where the vibration plate 42 can vibrate is positioned in the center of the whole liquid sensor 60.

The portion of the vibration plate 42 which is defined by the cavity 43 and can vibrate, the portion of the body portion 46*a* of the lower electrode 46 corresponding to the cavity 43, and the portions of the body portion 47*a* and the extension portion 47*b* of the piezoelectric layer 47 and the body portion 49*a* and the extension portion 49*b* of the upper electrode 49 corresponding to the cavity 43 constitute the vibration portion 61 of the liquid sensor 60. The center of the vibration portion 61 of the liquid sensor 60 is brought into line with the center of the liquid sensor 60.

The body portion 47*a* of the piezoelectric layer 47, the body portion 49*a* of the upper electrode 49, the body portion 46*a* of the lower electrode 46, and the portion which can vibrate among the vibration plate 42 (the portion corresponding to the bottom surface 43*a* of the cavity 43) have a circular shape and the whole piezoelectric layer 47, that is, the body portion 47*a* and the extension portion 47*b* of the piezoelectric layer 47, is disposed inside the region corresponding to the cavity 43. Accordingly, the vibration portion 61 of the liquid sensor 60 is substantially symmetric about the center of the liquid sensor 60.

The liquid sensor 60 according to the present embodiment includes a flow path forming plate (flow path forming base portion) 18 stacked on and bonded to the first surface 40*a* of the vibration cavity forming base portion 40.

An ink supply path (liquid supply path) 19 for supplying ink as a detection target to the cavity 43 and an ink discharge path (liquid discharge path) 20 for discharging the ink as the detection target from the cavity 43 are formed in the flow path forming plate 18. The ink supply path 19 and the ink discharge path 20 have the same size and shape, that is, a cylindrical shape.

The ink supply path 19 and the ink discharge path 20 formed in the flow path forming plate 18 are formed in the region corresponding to the circular cavity 43 and the ink supply path 19 and the ink discharge path 20 are disposed to be symmetric about the center axis C of the cavity 43. Accordingly, the cavity 43, the space including the ink supply path 19, and the ink discharge path 20 is symmetric about the center axis C of the cavity 43 in the region between the ink supply path 19 and the ink discharge path 20.

The ink supply path 19 and the ink discharge path 20 have a flow path area smaller than that of the cavity 43. That is, in the present embodiment, one ink supply path 19 and one ink discharge path 20 are formed in one cavity 43 and the flow path area of any one flow path (the ink supply path 19 or the ink discharge path 20) is set smaller than half an area of the cavity 43. The ink supply path 19 and the ink discharge path 20 have a length so that fluidal mass of liquid exists therein.

On the other hand, the liquid sensor 60 includes a buffer portion having a supply-side buffer chamber 15 which communicates with the ink supply path 19 and in which the ink supplied to the ink supply path 19 exists and a discharge-side buffer chamber 16 which communicates with the ink discharge path 20 and in which the ink discharged from the ink discharge path 20 exists.

The buffer portion 14 has a rectangular shape slightly greater than the liquid sensor 60 as seen in the plan view as a whole. The inside of the buffer portion 14 is divided into two spaces having the same size and shape by a partition wall 21 disposed at the center thereof. One is the supply-side buffer chamber 15 and the other is discharge-side buffer chamber 16.

An inflow opening 22 for allowing the ink to flow in the supply-side buffer chamber 15 and an outflow opening 23 for allowing the ink to flow out of the discharge-side buffer chamber 16 are formed in the surface of the buffer portion 14 opposite to the surface on which the sensor unit 13 is mounted. An upper opening 30A for supplying the ink flowing in the supply-side buffer chamber 15 to the cavity 43 through the ink supply path 19 and an upper opening 30B for discharging the ink in the cavity 43 to the supply-side buffer chamber 15 through the ink discharge path 20 are formed in the surface of the buffer portion 14 on which the sensor unit 13 is mounted.

The elastic seal member 29 is interposed between the sensor unit 13 and the buffer portion 14. The elastic seal member 29 includes a supply-side opening 32 allowing the ink supply path 19 and the supply-side buffer chamber 15 to communicate with each other and a discharge-side opening 33 allowing the ink discharge path 20 and the discharge-side buffer chamber 16 to communicate with each other and seals the space between the ink supply path 19 and the supply-side buffer chamber 15 and the space between the ink discharge path 20 and the discharge-side buffer chamber 16.

The elastic seal member 29 may be made of an elastic material such as rubber and elastomer and may be preferably made of a vibration-proof elastic material that polymers having a three-dimensional network structure are mixed with oil and appropriate hardness, loss characteristic, and spring constant are set.

The elastic seal member 29 has a rectangular plate shape slightly larger than the sensor unit 13 as a whole and slightly smaller than the buffer portion 14. A synthetic-resin holding member 36, which has a quadrangular section and a quadrangular frame shape so as to hold the elastic seal member 29, is fitted to the outer circumference of the elastic seal member 29. The holding member 36 has a height substantially equal to the thickness of the elastic seal member 29 and positions the elastic seal member 29 at a predetermined position on the top surface of the buffer portion 14 by bringing the left and right ends into contact with the left and right sensor fixing members 34.

On the other hand, the sensor fixing members 34 having a hook shape, which extend upwardly and of which the ends are bent inwardly, are formed on the left and right ends of the top surface of the buffer portion 14. The sensor fixing member 34 is provided by rising a plate-shaped vertical piece 34A extending vertically in FIG. 2 on the left and right sides of the top surface of the buffer portion 14. A plate-shaped horizontal piece 34B is bent inwardly in a hook shape from the end of the vertical piece 34A.

Positioning projections 37 for positioning the bias member 35 are formed on the bottom surfaces of the horizontal pieces 34B of the sensor 35 fixing members 34 and the top surfaces of the lower electrode terminal 44 and the upper electrode terminal 45. The bias members 35 are formed of a U-shaped leaf spring which falls horizontally and insertion holes (not shown) into which the projections are inserted are formed in the vicinity of the U-shaped free ends fallen horizontally.

According to this structure, the elastic seal member 29 into which the holding members 36 are externally inserted is mounted on the top surface of the buffer portion 14, the sensor unit 13 is mounted thereon, the U-shaped bias members 35 fallen horizontally are inserted between the horizontal pieces 34B of the sensor fixing members 34 and the top surface of the sensor unit 13 while compressing the bias members, the insertion holes of the bias members 35 are fitted to the horizontal pieces 34B of the sensor fixing members 34 and the projections on the top surface of the sensor unit 13. Accordingly, the sensor unit 13 can be positioned at an appropriate position on the elastic seal member 29, the sensor unit 13 is biased toward the buffer portion 14 with the biasing force of the bias members 35, and then the sensor unit is pressed and fixed to the top surface of the buffer portion 14. By the use of the pressurizing force, the sealing property between the ink supply path 19 and the supply-side buffer chamber 15 and between the ink discharge path 20 and the discharge-side buffer chamber 16 is maintained by the elastic seal member 29.

In this state, the supply-side opening 32 and the discharge-side opening 33 of the elastic seal member 29 are disposed on the upper openings 30A and 30B of the buffer portion 14, respectively. The ink supply path 19 and the ink discharge path 20 of the sensor unit 13 are disposed on the supply-side opening 32 and discharge-side opening 33 of the elastic seal member 29, respectively.

According to the configuration described above, the ink in the cartridge which is the detection target flows in the supply-side buffer chamber 15 from the inflow opening 22 and then is supplied to the cavity 43 through the upper opening 30A, the supply-side opening 32, and the ink supply path 19. The ink supplied to the cavity 43 is discharged to the discharge-side buffer chamber 16 through the ink discharge path 20, the discharge-side opening 33, and the upper opening 30B and then is discharged from the discharge-side buffer chamber 16 through the outflow opening 23.

The ink supply path 19 and the ink discharge path 20 have the same size of a cylindrical shape as described above. The supply-side opening 32 and the discharge-side opening 33 are formed in a substantially circular opened space and have the same shape and size in the present embodiment.

The opening of the supply-side opening 32 of the elastic seal member 29 is set larger than the opening of the ink supply path 19 of the sensor unit 13. Similarly, the opening of the discharge-side opening 33 of the elastic seal member 29 is set larger than the opening of the ink discharge path 20 of the sensor unit 13. Here, a ratio of the opening diameters D1 and D3 of the ink supply path 19 and the ink discharge path 20 of the sensor unit and the opening diameters D2 and D4 of the supply-side opening 32 and the discharge-side opening 33 of the elastic seal member 29 can be set appropriately. However, it is preferable that the opening diameter D2 of the supply-side opening 32 of the elastic seal member 29 is set two or more times greater than the opening diameter D1 of the ink supply path 19 of the sensor unit 13 and the opening diameter D4 of the discharge-side opening 33 of the elastic seal member 29 is set two or more times greater than the opening diameter D3 of the ink discharge path 20 of the sensor unit 13.

In the present embodiment, the supply-side opening 32 of the elastic seal member 29 and the liquid supply path 19 of the sensor unit 13 are disposed concentrically and the discharge-side opening 33 of the elastic seal member 29 and the liquid discharge path 20 of the sensor unit 13 are disposed concentrically. The space formed by the ink supply path 19, the supply-side opening 32, the ink discharge path 20, and the discharge-side opening 33 is symmetrical about the center axis C of the cavity 43.

In the present embodiment, the supply-side buffer chamber 15, the upper opening 30A, the discharge-side buffer chamber 16, and the upper opening 30B of the liquid sensor 60 are symmetrical about the center axis C of the cavity 43. In other words, the space formed by the cavity 43, the ink supply path 19, the ink discharge path 20, the supply-side opening 32, the discharge-side opening 33, the upper openings 30A and 30B, the supply-side buffer chamber 15, and the discharge-side buffer chamber 16 is symmetrical about the center axis C of the cavity 43.

The volumes of the supply-side buffer chamber 15 and the discharge-side buffer chamber 16 of the liquid sensor 60 are set to have at least ten times greater than the volume of the cavity 43.

Among the members included in the liquid sensor 60, the cavity plate 41, the vibration plate 42, and the flow path forming plate 18 are made of the same material and integrally formed by being sintering with one another. As such, a plurality of substrates is sintered to form a body, handling of the liquid sensor 60 becomes easy. Further, since the respective members are made of the same material, a crack can be prevented from occurring due to the difference among their linear expansion coefficients.

As a material of the piezoelectric layer 47, it is preferable that lead zirconate titanate (PZT), lead lanthanum zirconate titanate (PLZT), or a leadless piezoelectric film is used. As a material of the cavity plate 41, zirconia or alumina is preferably used. Further, for the vibration plate 42, the same material as that of the cavity plate 41 is preferably used. The upper electrode 49, lower electrode 46, upper electrode terminal 45 and lower electrode terminal 44 can be made of metallic materials such as gold, silver, copper, platina, aluminum, nickel, and the like, which have a conductivity.

Figure 5:
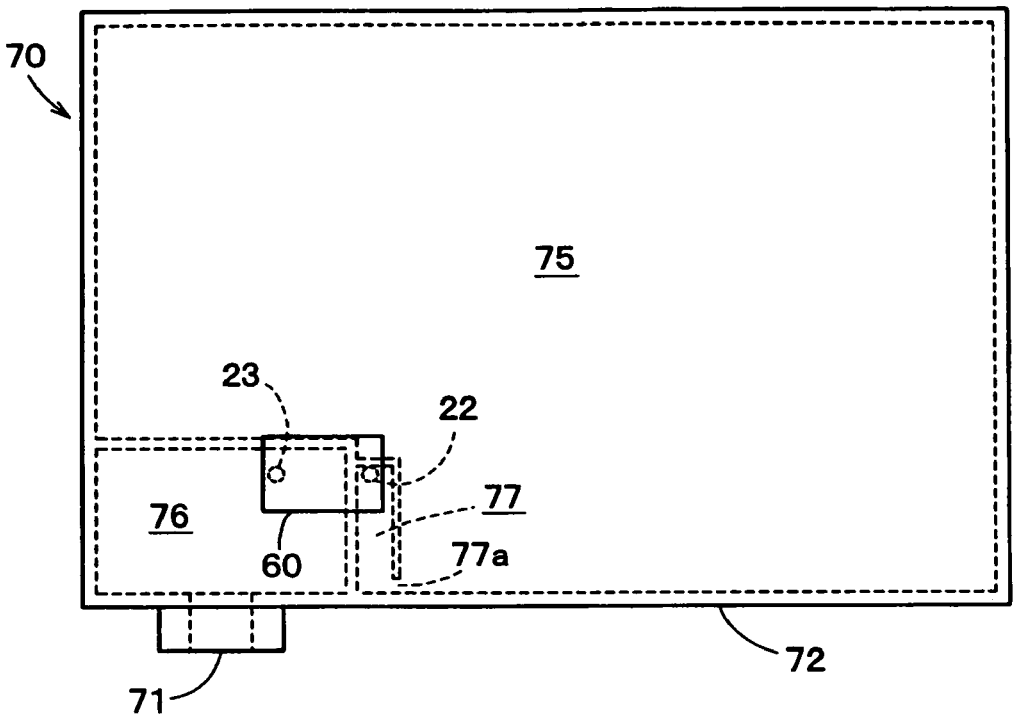
FIG. 5 is a diagram illustrating an ink cartridge having the liquid sensor, where (a) is a side view and (b) is a front view.
Figure 5:
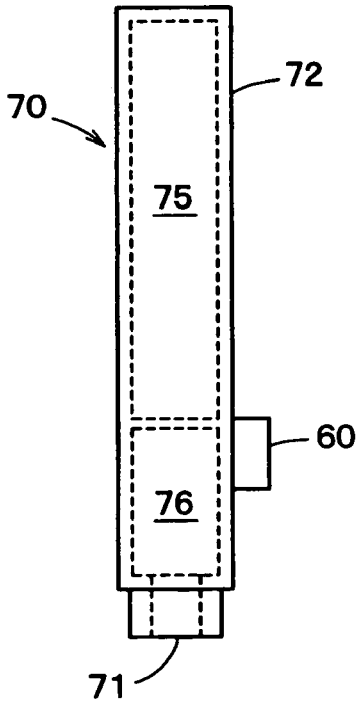
Figure 6:
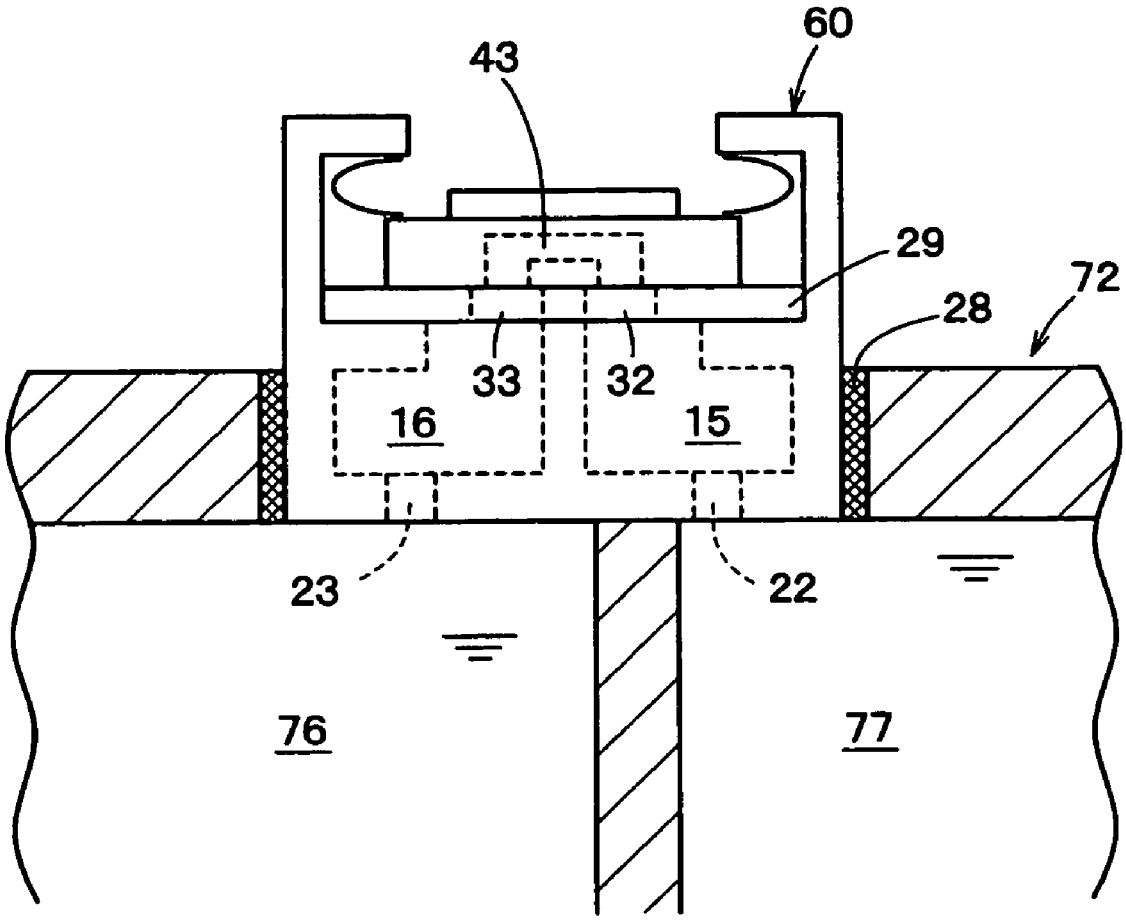
FIG. 6 is an enlarged cross-sectional view illustrating a mounting portion for the liquid sensor of the ink cartridge.

FIG. 5 is a diagram illustrating the ink cartridge 70 of the present invention including the liquid sensor and FIG. 6 is a diagram illustrating an example of the liquid sensor mounted on the ink cartridge 70.

FIG. 5 shows the ink cartridge (liquid container) 70 with the liquid sensor 60 mounted thereon. The ink cartridge 70 includes a container body 72 having an ink outlet port (liquid outlet port) 71 for delivering the ink reserved inside to the outside.

As shown in FIG. 6, the liquid sensor 60 as a whole is mounted on the container body 72. On a rectangular opening 26 formed on a wall surface 27 of the container body 72, the buffer portion 14 is fixed in a liquid-tight manner by an adhesive 28 or the like. In this case, the sensor portion 13 of the liquid sensor 60 is disposed outside the container body 72 so that an inflow opening 22 and an outflow opening 23 of the buffer portion 14 are opened inside the container body 72.

The inside of the container body 72(refer back to FIG. 5) is partitioned into a main reservoir chamber(liquid reservoir chamber) 75, which constitutes the major part of the entire inner space of the container body 72 to reserve ink, and a sub reservoir chamber(liquid delivery space) 76 having a smaller volume than the main reservoir chamber 75. The main reservoir chamber 75 is separated from the sub reservoir chamber 76. The sub reservoir chamber 76 is positioned in the side which is closer to the ink outlet port 71 than to the main reservoir chamber 75 in the flow direction of ink when the ink is consumed.

The inflow opening 22 of the liquid sensor 60 is opened so as to communicate with the main reservoir chamber 75, the outflow opening 23 is disposed so as to be opened into the sub reservoir chamber 76 which is the liquid delivery space. Accordingly, the supply side buffer chamber 15 constitutes the major part of the inner space of the container body 72 to communicate with the main reservoir chamber 75 for reserving liquid. Further, the discharge side buffer chamber 16 is disposed so as to communicate with the liquid delivery space in the inner space of the container body 72. The liquid delivery space communicates with the ink outlet port 71 for delivering the ink reserved inside to the outside.

A closed auxiliary flow path 77 is formed inside the main reservoir chamber 75, and, an auxiliary flow path entrance 77*a* is formed at a lower end of the auxiliary flow path 77. The auxiliary flow path entrance 77*a* is positioned at the lower end inside the main reservoir chamber 75. Further, the inflow opening 22 of the liquid sensor 60 communicates with the upper end of the auxiliary flow path 77 to constitute an exit of the auxiliary flow path 77.

As described above, the inflow opening 22 of the liquid sensor 60 communicates with the main reservoir chamber 75 through the auxiliary flow path 77, and the outflow opening 23 communicates with the ink outlet port 71 through the sub reservoir chamber 76. Accordingly, the ink reserved in the main reservoir chamber 75 flows in the supply side buffer chamber 15 from the inflow opening 22 via the auxiliary flow path 77 to be supplied to the cavity 43 through the upper opening 30A, the supply side opening 32 and the ink supply path 19. Then, the ink supplied to the cavity 43 is discharged into the discharge side buffer chamber 16 through the ink discharge flow path 20, the discharge side opening 33 and upper opening 30B, and the ink is discharged from the ink outlet port 71 via the outflow opening 23 and the sub reservoir chamber 76 from the discharge side buffer chamber 16, to be finally supplied to the printing head 12.

In the present embodiment having such a configuration, the entire ink delivered to the ink outlet port 71 through the sub reservoir chamber 76 passes through the ink supply path 19 and the ink discharge path 20 of the liquid sensor 60 in advance.

As described above, the liquid sensor 60 and the ink cartridge 70 according to the present embodiment include the vibration cavity forming base portion 40 which is formed with ink supply path 19 for supplying ink to the cavity 43 and the ink discharge path 20 for discharging ink from the cavity 43, so that the ink supply into the cavity 43 is performed through the ink supply path 19 and the ink discharge from the cavity 43 is performed through the ink discharge path 20. Therefore, when the liquid sensor 60 is mounted on the ink cartridge 70 or the like, the cavity 43 of the liquid sensor 60 is no directly exposed to the ink reservoir space and ink can be supplied to the cavity 43 through the ink supply path 19.

Further, since the cavity 43 does not need to be exposed to the ink storage space, meniscus can be prevented from being formed inside the cavity 43 when ink passes through the liquid level. Accordingly, erroneous detection of the liquid sensor 60 can be prevented, which is caused by the ink remaining inside the cavity 43. Furthermore, the cavity 43 is not exposed toward the ink reservoir space, but is enclosed from the ink reservoir space by the flow path forming plate 18. Therefore, due to a change of ink level, the existence of ink and the like, a difference in the residual vibration remaining in the vibration portion 61 becomes large when the vibration portion 61 is forced to be vibrated, so that detection sensitivity becomes high to enhance detection precision and to prevent erroneous detection.

In addition, since the elastic seal member 29 is disposed between the sensor unit 13 and the buffer portion 14, has a supply-side opening 32 allowing the liquid supply path 19 and the supply-side buffer chamber 15 to communicate with each other and a discharge-side opening 33 allowing the liquid discharge path 20 and the discharge-side buffer chamber 16 to communicate with each other, and seals a gap between the liquid supply path 19 and the supply-side buffer chamber 15 and a gap between the liquid discharge path 20 and the discharge-side buffer chamber 16, it is possible to secure the detection accuracy and to simplify the manufacturing processes.

That is, for example, when the space between the buffer portion 14 and the sensor unit 13 is sealed with an adhesive, the adhesive can be easily pressed out into the flow path formed by the liquid supply path 19 and the supply-side buffer chamber 15 or the flow path formed by the liquid discharge path 20 and the discharge-side buffer chamber 16. Then, since the bubbles are attached to the pressed-out adhesive and are not removed well, the bubbles have an influence on the residual vibration of the vibration portion 61 of the cavity 43, thereby badly affecting the detection accuracy. Therefore, it should be managed not to press out the adhesive into the flow paths, thereby complicating the bonding process.

On the contrary, in the present embodiment, since the elastic seal member 29 seals the space between the liquid supply path 19 and the supply-side buffer chamber 15 and the space between the liquid discharge path 20 and the discharge-side buffer chamber 16, the adhesive is not pressed out into the flow paths at all, thereby solving the decrease in detection accuracy due to the attachment of bubbles or the complication of processes for managing not to press out the adhesive.

In the present embodiment, the opening of the supply-side opening 32 of the elastic seal member 29 is larger than the opening of the liquid supply path 19 of the sensor unit 13 and the opening of the discharge-side opening 33 of the elastic seal member 29 is larger than the opening of the liquid discharge path 20 of the sensor unit 13. Specifically, the opening diameter D2 of the supply-side opening 32 of the elastic seal member 29 is set two or more times greater than the opening diameter D1 of the ink supply path 19 of the sensor unit 13 and the opening diameter D4 of the discharge-side opening 33 of the elastic seal member 29 is set two or more times greater than the opening diameter D3 of the ink discharge path 20 of the sensor unit 13. For this reason, it is possible to effectively prevent the vibration of the bottom surface of the cavity 43 from being delivered to the elastic seal member 29 through the liquid. Accordingly, it is possible to effectively prevent the decrease in detection accuracy due to the influence of the vibration generated in the elastic seal member 29 on the residual vibration of the bottom surface of the cavity 43.

In the present embodiment, the supply-side opening 32 of the elastic seal member 29 and the liquid supply path 19 of the sensor unit 13 are disposed concentrically and the discharge-side opening 33 of the elastic seal member 29 and the liquid discharge path 20 of the sensor unit 13 are disposed concentrically. Accordingly, even when the vibration of the bottom surface of the cavity 43 is slightly delivered to the elastic seal member 29 through the ink, the vibration mode generated in the elastic seal member 29 can be further simplified by disposing the supply-side opening 32 and liquid supply path 19 and the discharge-side opening 33 and liquid discharge path 20, respectively, in a concentric manner. Accordingly, it is possible to suppress the decrease in detection accuracy due to the vibration generated in the elastic seal member 29 as much as possible.

In the present embodiment, the openings of the liquid supply path 19 and the liquid discharge path 20 are set to the same size and shape and the openings of the supply-side opening 32 and the discharge-side opening 33 are set to the same size and shape. In addition, the supply-side opening 32 and liquid supply path 19 and the discharge-side opening 33 and liquid discharge path 20 are symmetric about the center axis C of the cavity 43. For this reason, the shape of the space including the liquid supply path 19, the supply-side opening 32, the liquid discharge path 20, the discharge-side opening 33, and the cavity 43 through which the vibration of the bottom surface of the cavity 43 is spread is simplified and thus the vibration mode of the residual vibration remaining on the bottom surface of the cavity 43 is also simplified. Accordingly, the simulation for the residual vibration when the bottom surface of the cavity is compulsorily vibrated can be easily performed to reduce the difference between the actual phenomenon and the designed effect. As a result, the adjustment work can be reduced or the detection accuracy can be improved.

Since the space constituting the cavity 43 is substantially circular, the space shape of the cavity 43 through which the vibration of the bottom surface of the cavity 43 is more simplified and thus the vibration mode of the residual vibration remaining on the bottom surface of the cavity 43 is also simplified. Accordingly, the simulation for the residual vibration when the bottom surface of the cavity 43 is compulsorily vibrated can be easily performed to reduce the difference between the actual effect and the designed effect. As a result, the adjustment work can be reduced or the detection accuracy can be improved.

Since the ink supply path 19 and the ink discharge path 20 are set to have a flow path area smaller than that of the cavity 43 and to have such a length that fluidal mass exists therein, an appropriate flow-path resistance is generated in the ink supply path 19 and the ink discharge path 20. Accordingly, it is possible to prevent the variation in pressure in the cavity 43 due to the vibration of the bottom surface of the cavity 43 from being spread into both buffer chambers 15 and 16 and to generate appropriate residual vibration, thereby enhancing and securing the detection accuracy.

In the present embodiment, since there is further provided a bias member 35 for fixing the sensor unit 13 to the buffer portion 14 by biasing the sensor unit 13 toward the buffer portion 14, the sensor unit 13 can be reliably mounted on the buffer portion 14 by the use of the biasing force of the bias member 35 and the elastic seal member 29 is compressed by the biasing member, thereby little causing the deformation. Accordingly, even when the vibration of the bottom surface of the cavity 43 is slightly delivered to the elastic seal member 29 through the liquid, the elastic seal member 29 little vibrates. In addition, since the holding member 36 mounted on the outer circumference of the elastic seal member 29 to hold the elastic seal member 29 from the periphery thereof, the deformation of the elastic seal member 29 toward the outer circumference is regulated by the holding member 36 and the deformation of the elastic seal member 29 is further suppressed when the elastic seal member 29 is compressed by the biasing force of the bias member 35. Accordingly, even when the vibration of the bottom surface of the cavity 43 is slightly delivered to the elastic seal member 29 through the liquid, the vibration of the elastic seal member 29 is further suppressed. Therefore, it is possible to effectively prevent the decrease in detection accuracy due to the vibration of the elastic seal member 29.

In the present embodiment, the mounting target member is a buffer portion 14 which has as an upstream space a supply-side buffer chamber 15 communicating with the liquid supply path 19 and as a downstream space a discharge-side buffer chamber 16 communicating with the liquid discharge path 20. Therefore, the ink supply path 19 and the ink discharge path 20 through which the liquid enters and leaves the cavity 43 are opened to the supply-side buffer chamber 15 and the discharge-side buffer chamber 16, respectively, but not opened directly to the ink reserving space of the container body 72. Accordingly, even when the bubbles are generated due to the vibration of the ink in the ink reserving space, the bubbles are once trapped by the supply-side buffer chamber 15 or the discharge-side buffer chamber 16 and little enter the cavity 43. Therefore, it is possible to prevent the erroneous detection of the liquid sensor 60 due to the staying of the bubbles in the cavity 43. Further, since the liquid sensor 60 is disposed in the vicinity of the bottom portion of the ink cartridge 70, the effect of preventing the invasion of bubbles is enhanced.

In addition, since the ink supply path 19 and the ink discharge path 20 through which the liquid enters and leaves the cavity 43 are opened to the supply-side buffer chamber 15 and the discharge-side buffer chamber 16, respectively, but not opened directly to the ink reserving space of the container body 72, the pressure of the ink in the ink reserving space of the ink cartridge 70 does not act directly on the cavity 43. Therefore, it is possible to prevent the erroneous detection of the liquid sensor 60 due to the influence of pressure from the vibration of ink.

Since the supply-side buffer chamber 15 and the discharge-side buffer chamber 16 of the liquid sensor 60 are symmetrical about the center axis C of the cavity 43, the shape of the members forming both buffer chambers 15 and 16 is simplified by allowing the supply-side buffer chamber 15 and the discharge-side buffer chamber 16 to be symmetrical, thereby facilitating the manufacturing work and accomplishing decrease in size of the members.

In addition, since the supply-side buffer chamber 15 and the discharge-side buffer chamber 16 of the liquid sensor 60 have a volume ten or more times greater than the volume of the cavity 43, the variation in pressure of the ink generated in the ink reserving space of the ink cartridge 70 little affects the sensor characteristic of the liquid sensor 60. Accordingly, it is possible to prevent erroneous detection of the liquid sensor 60 due to the influence of pressure such as the vibration of the ink. In addition, since the pressure in both buffer chambers 15 and 16 is not increased due to the vibration of the bottom surface of the cavity 43, extra vibration is not generated and thus the vibration mode of the residual vibration remaining on the bottom surface of the cavity 43 is simplified, thereby enhancing the detection accuracy.

The buffer portion 14 is mounted on the container body 72 having an ink outlet port 71 for sending out the ink reserved therein, the supply-side buffer chamber 15 constitutes a main part of the inner space of the container body 72 and communicates with a main reservoir chamber 75 reserving the ink, and the discharge-side buffer chamber 16 communicates with a sub reservoir chamber 76 which is an ink delivery space communicating with the ink outlet port 71 for sending out the ink reserved in the inner space of the container body 72. Accordingly, the ink reserved in the main reservoir chamber 75 of the container body 72 flows in the entrance of the supply-side buffer chamber 15 of the liquid sensor 60, is discharged from the exit of the discharge-side buffer chamber 16, and is sent to the ink outlet port 71 of the container body 72. In addition, the whole amount of ink sent to the ink outlet port 71 of the container body 72 previously passes through the supply-side buffer chamber 15, the cavity 43, and the discharge-side buffer chamber 16 of the liquid sensor 60. As a result, it is possible to reliably detect consumption of the liquid.

According to the liquid sensor 60, since the ink discharge path 20 is formed to correspond to the corresponding region of the cavity 43, it is possible to satisfactorily discharge the bubbles entering the cavity 43.

In the ink cartridge 70, the inside of the container body 72 is partitioned into a main reservoir chamber 75 and a sub reservoir chamber 76 isolated from each other, the main reservoir chamber 75 and the sub reservoir chamber 76 communicate with each other through the inflow opening 22 and the outflow opening 23 of the liquid sensor 60, and the cavity 43 of the liquid sensor 60 is disposed on the top surface of the sub reservoir chamber 76.

For this reason, since the time when the ink in the main reservoir chamber 75 runs out can be accurately detected by the liquid sensor 60, a user can be informed that ink is running out. Further, based on the amount of ink within the sub reservoir chamber 76, which is previously sensed, a user can be informed how many pages can be printed with the remaining ink. Therefore, it can be prevented that a printing paper is wasted when ink runs out on the way of printing the printing paper.

Additionally, according to the described-above ink cartridge 70, a closed auxiliary flow path 77 is formed inside the main reservoir chamber 75, the auxiliary flow path inlet 77*a* of the auxiliary flow path 77 is disposed in the lower end of the main reservoir chamber 75, and the inflow opening 22 of the liquid sensor 60 communicates with the upper end of the auxiliary flow path 77. For this reason, the bubbles produced in the main reservoir chamber 75 hardly enter the auxiliary flow path 77 and can be prevented from entering the cavity 43 of the liquid sensor 60.

According to the above-described ink cartridge 70, the inside of the sub reservoir chamber 76 is filled with ink until all the ink in the main reservoir chamber 75 is consumed. Therefore, even when vibration is applied to the ink cartridge 70, the liquid level in the sub reservoir chamber 76 does not shake as long as ink remains in the main reservoir chamber 75. Accordingly, erroneous detection of the liquid sensor 60 caused by the shake of the liquid level can be prevent from occurring.

Further, according to the above-described liquid sensor 60, the range where the vibration portion 61 comes in contact with ink is limited to the range corresponding to the cavity 43. Therefore, pinpoint detection of ink can be performed, so that the ink level can be sensed with high precision.

Since the substantially entire region corresponding to the cavity 43 is covered with the body portion 46*a* of the lower electrode 46, the difference between the deformation mode at the time of a forced vibration and the deformation mode at the time of a free vibration becomes small. Further, since the vibration portion 61 of the liquid sensor 60 is formed symmetrically with respect to the center of the liquid sensor 60, the rigidity of the vibration portion 61 is nearly isotropic, as seen from the center.

For this reason, an unnecessary vibration caused by structural asymmetry is suppressed, and the output reduction of the back electromotive force is prevented, which is caused by the difference between the deformation mode at the time of a forced vibration and the deformation mode at the time of a free vibration. Accordingly, the detection precision for the resonant frequency of the residual vibration in the vibration portion 61 of the liquid sensor 60 is enhanced, and the detection of the residual vibration of the vibration portion 61 becomes easy.

Further, since the substantially entire portion of the region corresponding to the cavity 43 is covered with the body portion 46*a* of the lower electrode 46 having a larger diameter that the cavity 43, a necessary vibration is prevented from being produced, which is caused by the positional deviation of the lower electrode 46 in manufacturing. AS a result, the deterioration of detection precision can be prevented.

Further, the entire piezoelectric layer 47, which is inherently brittle, is disposed inside the region corresponding to the cavity 43 and does not exist in the position corresponding to the peripheral edge 43*b* of the cavity 43. For this reason, the occurrence of a crack of piezoelectric film is prevented in the position corresponding to the peripheral edge of the cavity.

Figure 7:
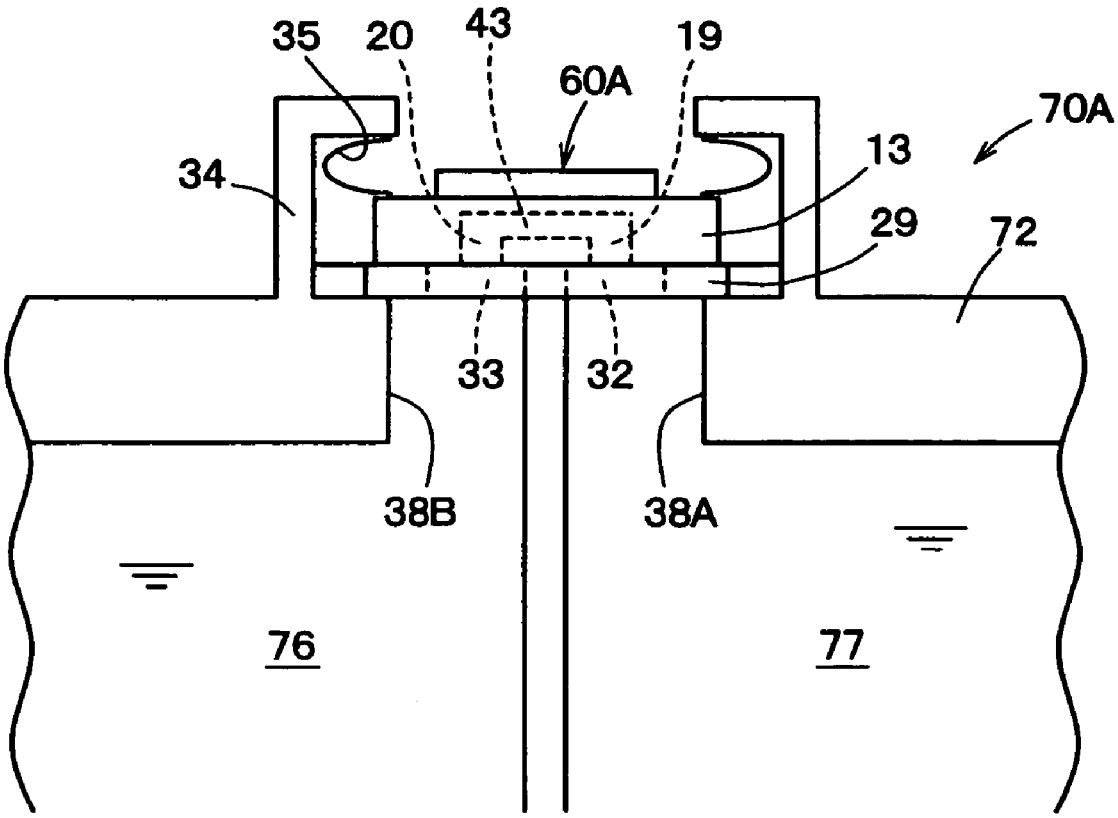
FIG. 7 is a diagram illustrating an ink cartridge employing a mounting structure according to a second embodiment of the first aspect of the invention.

FIG. 7 show an ink cartridge mounted with a liquid sensor according to a second embodiment of the first aspect of the present invention.

In the ink cartridge 70A, the liquid sensor 60A includes only the sensor unit 13, not the buffer portion 14. In the ink cartridge 70A, an upstream opening 38A allowing the ink supply path 19 of the sensor unit 13 and the auxiliary flow path 77 of the container body 72 to communicate with each other and a downstream opening 38B allowing the ink discharge path 20 of the sensor unit 13 and the sub reservoir chamber 76 of the container body 72 to communicate with each other are formed in the wall of the container body 72. A sensor fixing member 34 for fixing the sensor unit is formed on the outer side surface of the container body 72 and the elastic seal member 29 and the sensor unit 13 are positioned and fixed to the outer side surface of the container body 72, similarly to the first embodiment.

In the present embodiment, the auxiliary flow path 77 serves as the upstream space, that is, buffer chamber, and the sub reservoir chamber 76 serves as the downstream space, that is, buffer chamber. Other structures are similar to the first embodiment and like elements are denoted by like reference numerals. The present invention has advantages similar to the first embodiment.

Figure 8:
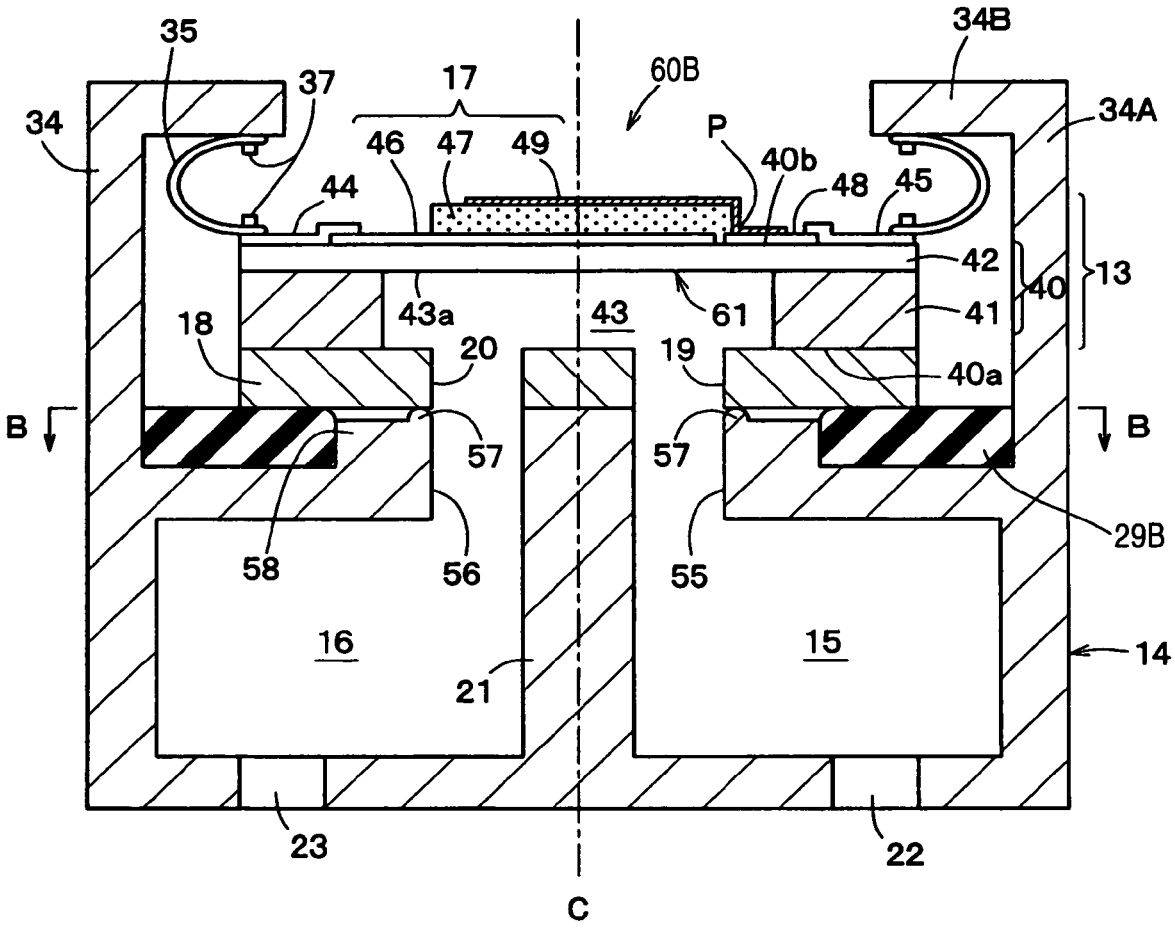
FIG. 8 is a cross-sectional view illustrating a liquid sensor employing a mounting structure according to a third embodiment of the first aspect of the invention, which is taken along Line A-A of FIG. 9.
Figure 9:
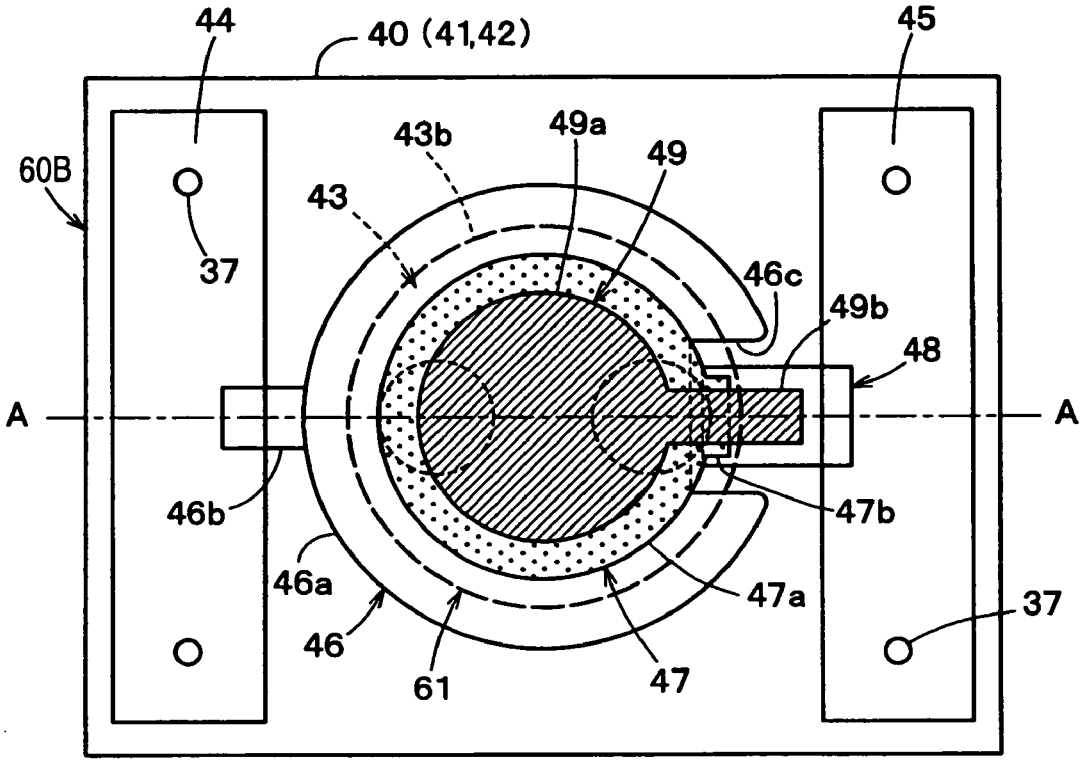
FIG. 9 is a diagram illustrating a sensor unit of the liquid sensor, where (a) is a plan view and (b) is a bottom view.
Figure 9:
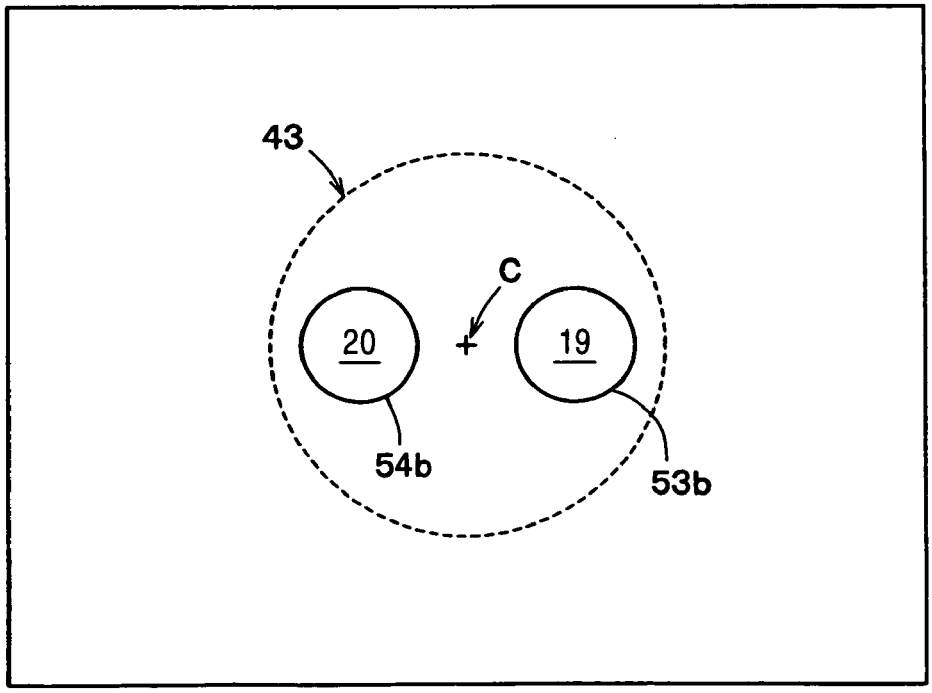
Figure 10:
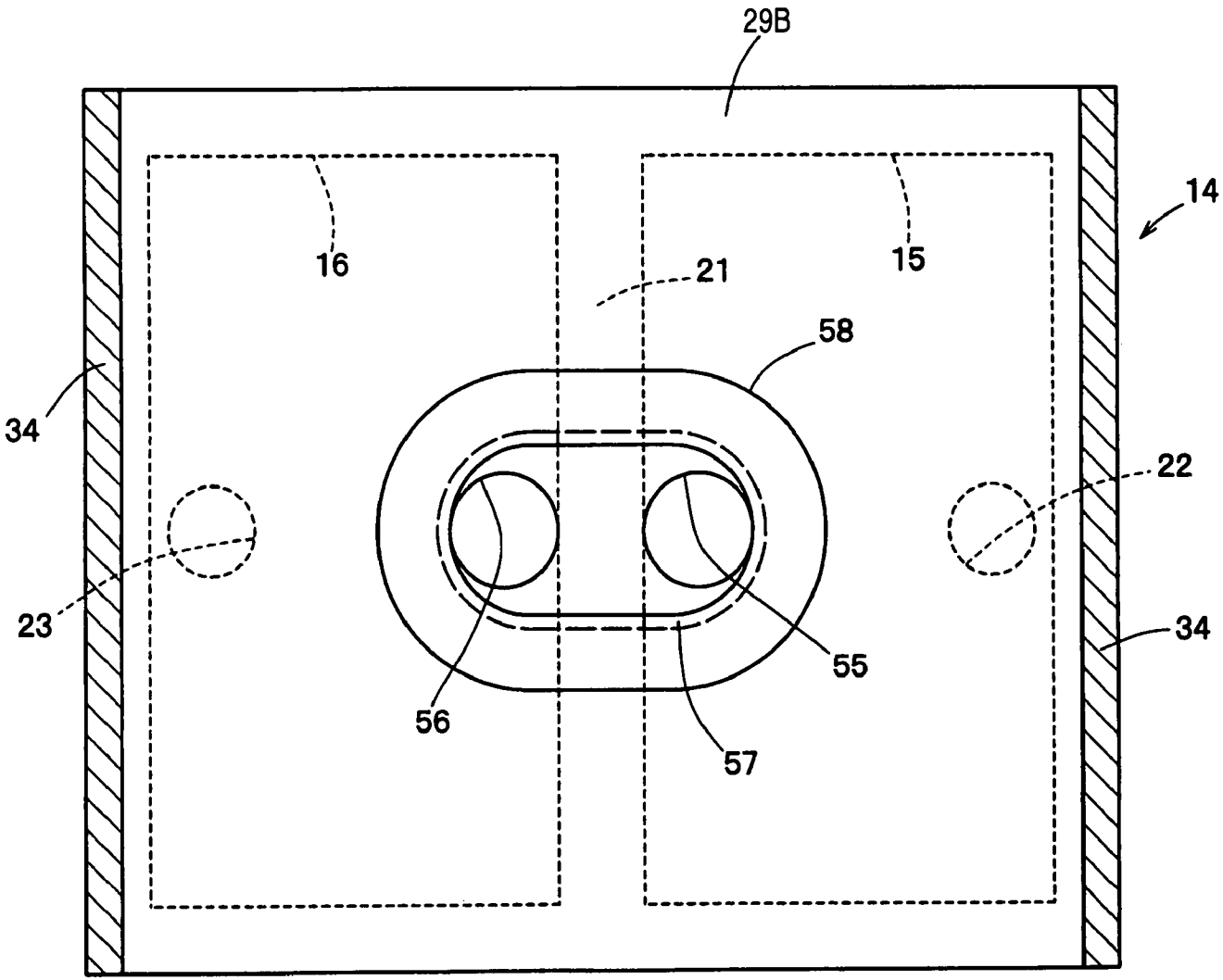
FIG. 10 is a cross-sectional view of a buffer portion of the liquid sensor, which is taken along Line B-B of FIG. 8.

FIG. 8 shows a liquid sensor 60B according to a third embodiment of the first aspect of the invention. FIG. 9 is a diagram illustrating a sensor unit 13 of the liquid sensor 60B and FIG. 10 is a diagram illustrating a buffer portion 14 of the liquid sensor 60B.

The liquid sensor 60B is different from the first embodiment in that a flow path projection 58 in which the upstream flow path 55 and the downstream flow path 56 are opened is protruded from the surface of the buffer portion 14 opposed to the sensor unit 13. Other structures are similar to the first embodiment and like elements are denoted by like reference numerals.

Specifically, the flow path projection 58 has a trapezoidal shape like a track as seen in the plan view and the upstream flow path 55 and downstream flow path 56 are opened on the mounting surface. A ring-shaped projection 57 surrounding both openings of the upstream flow path 55 and the downstream flow path 56 is formed on the surface of the flow path projection 58 opposed to the sensor unit 13. The ring-shaped projection 57 has the same track shape as the planar shape of the flow path projection 58 and the upstream flow path 55 and the downstream flow path 56 are opened inside the ring-shaped projection 57.

Because of existence of the ring-shaped projection 57, when the surface in which the upstream flow path 55 and the downstream flow path 56 of the flow path projection 58 is pressed against the sensor unit 13, the ring-shaped projection 57 is slightly deformed to come in close contact with the flow path forming plate 18 of the sensor unit 13. Consequently, the fine gap resulting from the flatness of the bonding portion between the bottom surface of the flow path forming plate 18 or the top surface of the flow path projection 58 is reduced very small.

In the state that the sensor unit 13 is mounted on the top surface of the buffer portion 14 such that the front surface of the flow path projection 58 and the bottom surface of the sensor unit 13 are opposed to each other, the elastic seal member 29B is interposed between the sensor unit 13 and the buffer portion 14 so as to seal the space between the sensor unit 13 and the buffer portion 14 at the outer circumference thereof.

The elastic seal member 29B has a rectangular plate shape slightly larger than the sensor unit 13 as a whole and slightly smaller than the buffer portion 14. A track-shaped opening into which the flow path projection 58 is inserted is formed at the center of the elastic seal member 29B. The thickness of the elastic seal member 29B is larger than the height of the flow path projection 58. Accordingly, by pressing the sensor unit 13 against the buffer portion 14, the elastic seal member is compressed to seal the space between the sensor unit 13 and the buffer portion 14.

The elastic seal member 29B may be made of an elastic material such as rubber and elastomer and may be preferably made of a vibration-proof elastic material (Micro Network Controlled Structure) that polymers having a three-dimensional network structure are mixed with oil and appropriate hardness, loss characteristic, and spring constant are set.

On the other hand, the sensor fixing members 34 having a hook shape, in which the end extending upwardly is bent inwardly, are formed on the left and right sides of the top surface of the buffer portion 14. The sensor fixing member 34 is provided by rising a plate-shaped vertical piece 34A extending vertically in FIG. 8 on the left and right sides of the top surface of the buffer portion 14. A plate-shaped horizontal piece 34B is bent inwardly in a hook shape from the end of the vertical piece 34A.

Positioning projections 37 for positioning the bias member 35 are formed on the bottom surfaces of the horizontal pieces 34B of the sensor fixing members 34 and the top surfaces of the lower electrode terminal 44 and the upper electrode terminal 45 of the sensor unit 13. The bias member 35 is formed of a U-shaped leaf spring which falls horizontally and insertion holes (not shown) into which the projections are inserted are formed in the vicinity of the U-shaped free ends fallen horizontally.

According to this structure, the elastic seal member 29B is mounted on the top surface of the buffer portion 14, the sensor unit 13 is mounted thereon, the U-shaped bias members 35 fallen horizontally are inserted between the horizontal pieces 34B of the sensor fixing members 34 and the top surface of the sensor unit 13 while compressing the bias members, the insertion holes of the bias members 35 are fitted to the horizontal pieces 34B of the sensor fixing members 34 and the projections on the top surface of the sensor unit 13. Accordingly, the sensor unit 13 can be positioned at an appropriate position on the elastic seal member 29B, the sensor unit 13 is biased toward the buffer portion 14 with the biasing force of the bias members 35, and then the sensor unit is pressed and fixed to the top surface of the buffer portion 14. By the use of the pressurizing force, the sealing property between the ink supply path 19 and the supply-side buffer chamber 15 and between the ink discharge path 20 and the discharge-side buffer chamber 16 is maintained by the elastic seal member 29B.

The upstream flow path 55 and the downstream flow path 56 are formed in a substantially cylinder-shaped flow path space and have the same size and shape. The openings of the upstream flow path 55 and the downstream flow path 56 are matched with the openings of the ink supply path 19 and the ink discharge path 20. In the present embodiment, a liquid supply path is formed by the ink supply path 19 and the upstream flow path 55 and a liquid discharge path is formed by the ink discharge path 20 and the downstream flow path 56.

According to such a configuration, the ink in the ink cartridge as the detection target flows in the supply-side buffer chamber 15 from the inflow opening 22 and is supplied to the cavity 43 through the upstream flow path 55 and the ink supply path 19. The ink supplied to the cavity 43 is discharged to the discharge-side buffer chamber 16 through the ink discharge path 20 and the downstream flow path 56 and is discharged from the discharge-side buffer chamber 16 through the outflow opening 23.

Any one of the ink supply path 19 and the ink discharge path 20 formed in the above-described flow path forming plate is formed inside the region corresponding to the circular cavity 43, and the upstream flow path 55 and the downstream flow path 56 are disposed symmetrically with respect to the center axis C of cavity 43. Accordingly, the space, which is defined by the cavity 43, the ink supply path 19, the upstream flow path 55, the downstream flow path 56 and the ink discharge path 20, is formed symmetrically with respect to the center axis C of the cavity 43 which exists in the region interposed between the ink supply path 19 and the ink discharge path 20.

As the ink supply path 19 and the ink discharge path 20, the upstream flow path 55 and the downstream flow path 56 are narrowed with respect to the cavity 43, respectively and arranged to have a fluid weight of the liquid inside. That is, in this embodiment, one upstream flow path and one downstream flow path are formed for a cavity 43 and the area of one flow path (upstream flow path 55 or downstream flow path 56) is set to be less than the half of the cavity 43, at most. And the length of the upstream 55 and downstream flow path 55 is set to have a fluid weight of the liquid inside.

The supply side buffer chamber 15 and the discharge side buffer chamber 16 of the liquid sensor 60B are symmetrical about the center axis of the cavity 43. In other words, the space defined by the cavity 43, the ink supply path 19, the ink discharge path 20, the inflow flow path 24, the discharge flow path 25, the supply side buffer chamber 15, and the discharge buffer chamber 16 is formed symmetrically with respect to the center axis C of the cavity 43.

The volume of the supply-side buffer chamber 15 and the volume of the discharge-side buffer chamber 16 of the liquid sensor 60B described above are set to have a volume at least ten times larger than the volume of the cavity 43, each.

Among the members included in the liquid sensor 60B, particularly the cavity plate 41, the vibration plate 42, and the flow path forming plate 18 are made of the same material and integrally formed by being sintered with one another. As such, since a plurality of substrates is sintered to be integrated, handling of the liquid sensor 60B becomes easy. Further, since the respective members are made of the same material, a crack can be prevented from occurring due to the difference among their linear expansion coefficients.

As a material of the piezoelectric layer 47, it is preferable that lead zirconate titanate (PZT), lead lanthanum zirconate titanate (PLZT), or a leadless piezoelectric film is used. As a material of the cavity plate 41, zirconia or alumina is preferably used. Further, for the vibration plate 42, the same material as that of the cavity plate 41 is preferably used. The upper electrode 49, the lower electrode 46, the upper electrode terminal 45 and the lower electrode 44 can be made of metallic materials such as gold, silver, copper, platina, aluminum, nickel, and the like, which have a conductivity.

Figure 11:
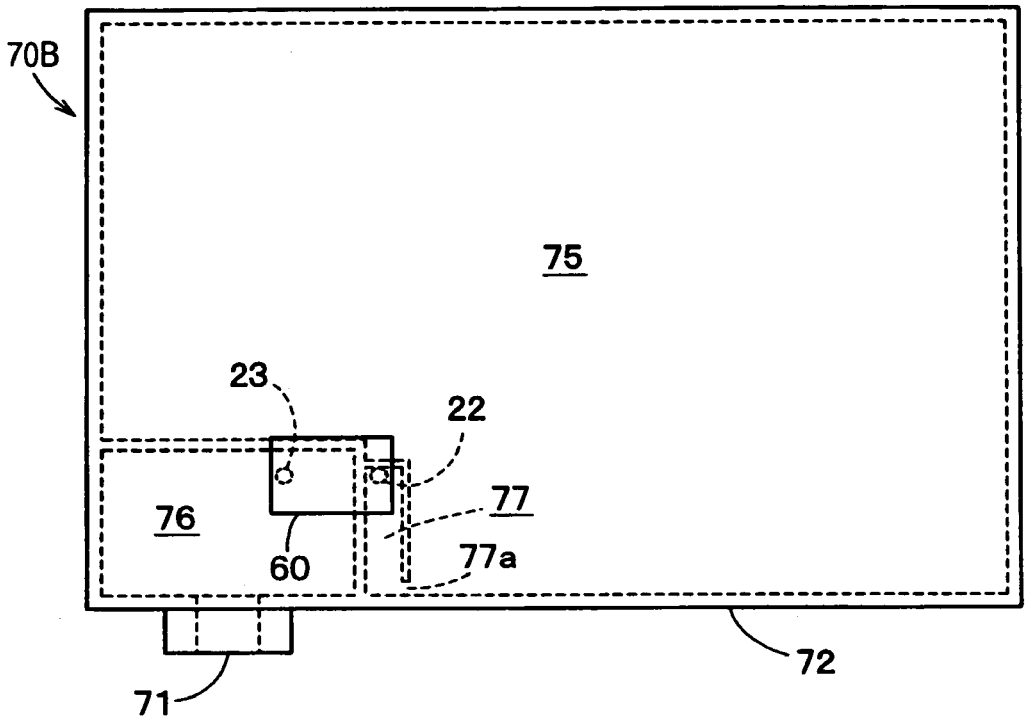
FIG. 11 is a diagram illustrating an ink cartridge having the liquid sensor, where (a) is a side view and (b) is a front view.
Figure 11:
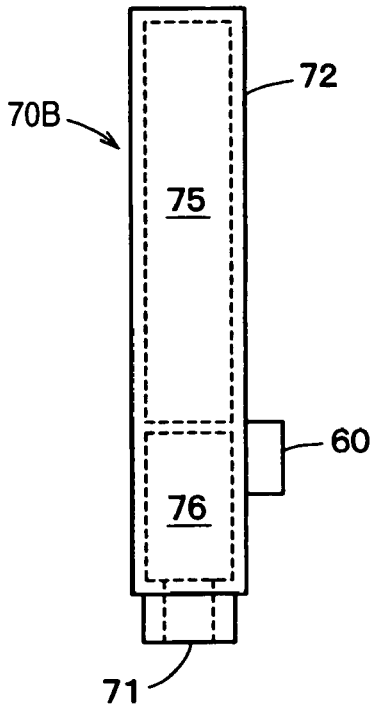
Figure 12:
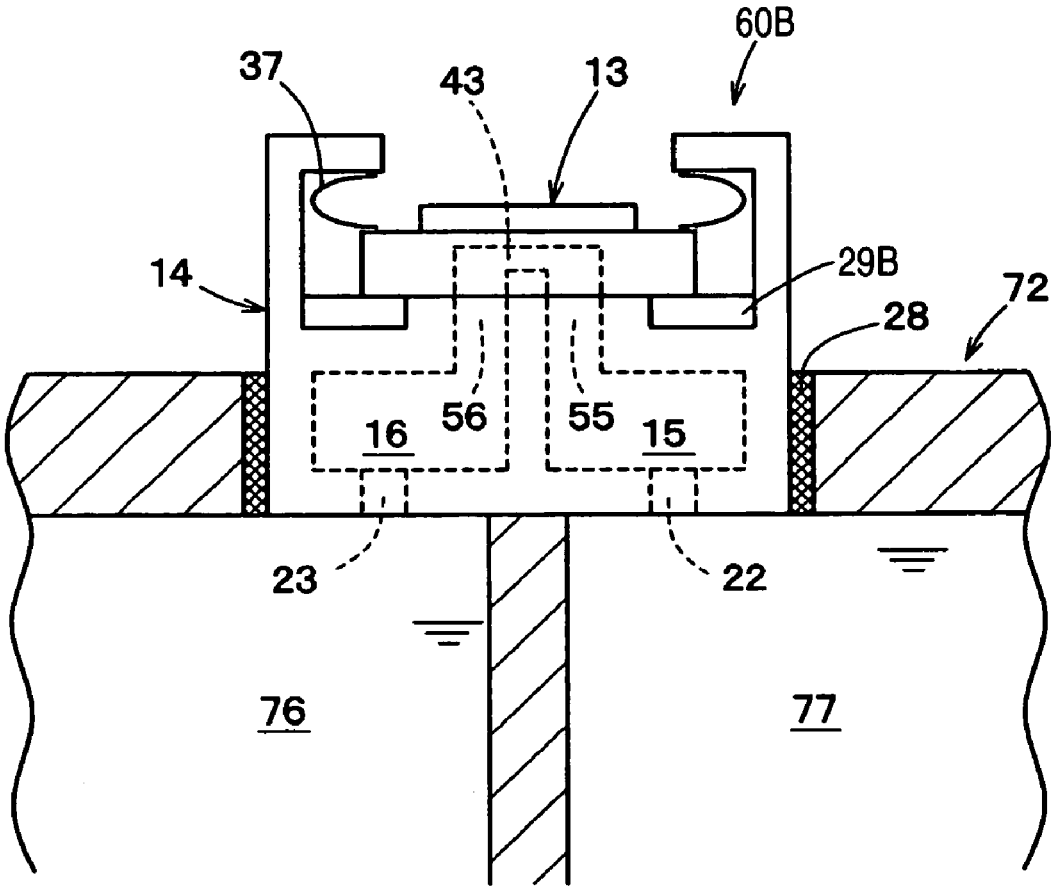
FIG. 12 is an enlarged cross-sectional view illustrating a mounting portion for the liquid sensor of the ink cartridge.

FIG. 11 is a diagram illustrating the ink cartridge of the present invention including the liquid sensor and FIG. 12 is a diagram illustrating an example of the liquid sensor mounted on the ink cartridge.

FIG. 11 shows the ink cartridge (liquid container) 70B with the liquid sensor 60B mounted thereon. The ink cartridge 70B includes a container body 72 having an ink outlet port (liquid outlet port) 71 for delivering the ink reserved inside to the outside.

As shown in FIG. 12, the liquid sensor 60B as a whole is mounted on the container body 72. On a rectangular opening 26 formed on a wall surface 27 of the container body 72, the buffer portion 14 is fixed in a liquid-tight manner by an adhesive 28 or the like. In this case, the sensor portion 13 of the liquid sensor 60B is disposed outside the container body 72 so that an inflow opening 22 and a discharge opening 23 of the buffer portion 14 are opened inside the container body 72.

The inside of the container body 72 (refer back to FIG. 5) is partitioned into a main reservoir chamber (liquid reservoir chamber) 75, which constitutes the major part of the entire inner space of the container body 72 to reserve ink, and a sub reservoir chamber (liquid crystal space) 76 having a smaller volume than the main reservoir chamber 75. The main reservoir chamber 75 is separated from the sub reservoir chamber 76. The sub reservoir chamber 76 is positioned in the side which is closer to the ink delivery opening 71 than to the main reservoir chamber 75 in the flow direction of ink when the ink is consumed.

The inflow opening 22 of the liquid sensor 60B is opened so as to communicate with the main reservoir chamber 75, and the discharge opening 23 is opposed so as to be opened into the sub reservoir chamber 76 which is the liquid delivery space. Accordingly, the supply side buffer chamber 15 constitutes the major part of the inner space of the container body 72 to communicate with the main reservoir 75 for reserving liquid. Further, the discharge side buffer chamber 16 is disposed so as to communicate with the liquid delivery space in the inner space of the container body 72.

The liquid delivery space communicates with the ink delivery opening 71 for delivering the ink reserved inside to the outside.

A closed auxiliary flow path 77 is formed inside the main reservoir chamber 75, and, an auxiliary flow path entrance 77*a* is formed at a lower end of the auxiliary flow path entrance 77*a* is formed at a lower end of the auxiliary flow path 77. The auxiliary flow path entrance 77*a* is positioned at the lower end inside the main reservoir chamber 75. Further, the inflow opening 22 of the liquid sensor 60B communicates with an upper end of the auxiliary flow path 77 to constitute an exit of the auxiliary flow path 77.

As described above, the inflow opening 22 of the liquid sensor 60B communicates with the main reservoir chamber 75 through the auxiliary flow path 77, and the discharge opening 23 communicates with the ink delivery opening 71 through the sub reservoir chamber 76. Accordingly, the ink reserved in the main reservoir chamber 75 flows in the supply side buffer chamber 15 from the inflow opening 22 via the auxiliary flow path 77 to be supplied to the cavity 43 through the upper opening 30A, the supply side opening 32 and the ink supply path 19. Then, the ink supplied to the cavity 43 is discharged into the discharge side buffer chamber 16 through the ink discharge flow path 20 the discharge side opening 33 and the upper opening 30B, and the ink is discharged from the ink delivery opening 71 via the discharge opening 23 and the sub reservoir chamber 76 from the discharge side buffer chamber 16, to be finally supplied to the printing head 12.

In the present embodiment having such a configuration, all the ink delivered to the ink delivery opening 71 through the sub reservoir chamber 76 passes through the ink supply path 19 and the ink discharge path 20 of the liquid sensor 60B in advance.

As described above, the liquid sensor 60B and the ink cartridge 70B according to the present embodiment include the buffer 14 comprising the supply-side buffer room 15 communicating with the vibration cavity 43 through the upstream flow path 55 and the supply path 19 and the discharge buffer room 16 communicating with the vibration cavity 43 through the downstream flow path 56, so that the ink supply into the cavity 43 is performed through the upstream flow path 55 and the ink supply path 19 and the ink discharge from the cavity 43 is performed through the ink discharge path 20.

Therefore, when the liquid sensor 60B is mounted on the ink cartridge 70B or the like, the cavity 43 of the liquid sensor 60B is not directly exposed to the ink reservoir space and ink can be supplied to the cavity 43 through the upstream flow path 55 or the ink supply path 19.

As such, it is configured that ink flows inside the upstream flow path 55, the ink supply path 19 and the downstream flow path 56, and the ink discharge path 20 of the liquid sensor 60B when ink is consumed. Therefore, even if bubbles enter the cavity 43, the bubbles are pushed out of the inside of the cavity 43 by the ink flow. As a result, erroneous detection of the liquid sensor 60B can be prevented, which is caused by the bubbles accumulated inside the cavity 43. As such, the detection precision of the liquid sensor 60B is enhanced and remaining liquid decreases to lead to reduced industrial waste.

Further, since the cavity 43 does not need to be exposed to the ink storage space, meniscus can be prevented from being formed inside the cavity 43 when ink passes through the liquid level. Accordingly, erroneous detection of the liquid sensor 60B can be prevented, which is caused by the ink remaining inside the cavity 43. Furthermore, the cavity 43 is not exposed toward the ink reservoir, but is enclosed from the ink reservoir by the flow path forming plate 18. Therefore, due to a change of ink level, the existence of ink and the like, a difference in the residual vibration remaining in the vibration portion 61 becomes large when the vibration portion 61 is forced to be vibrated, so that detection sensitivity becomes high to enhance detection precision and to prevent erroneous detection.

Further, since the elastic seal member 29B for sealing the space between the sensor unit 13 and the buffer portion 14 is disposed between the sensor unit 13 and the buffer portion 14, it is possible to secure the detection accuracy and also to simplify the manufacturing processes.

That is, for example, when the space between the buffer portion 14 and the sensor unit 13 is sealed with an adhesive, the adhesive can be easily pressed out into the flow path of the flow path space in which the cavity 43 communicates with the upstream flow path 55 and the downstream flow path 56. Then, since the bubbles are attached to the pressed-out adhesive and are not removed well, the bubbles have an influence on the residual vibration on the bottom surface of the cavity 43, thereby badly affecting the detection accuracy. Therefore, it should be managed not to press out the adhesive into the flow paths, thereby complicating the bonding process.

On the contrary, in the present embodiment, since the elastic seal member 29B seals the space between the sensor unit 13 and the buffer portion 14, the adhesive is not pressed out into the flow paths at all, thereby solving the decrease in detection accuracy due to the attachment of bubbles or the complication of processes for managing not to press out the adhesive.

In addition, since the elastic seal member 29B is disposed in a portion other than a flow path wall of the flow path space in which the cavity 43, the upstream flow path 55, and the downstream flow path 56 communicate with each other, the vibration of the bottom surface of the cavity 43 is not delivered to the elastic seal member 29B through the liquid. Accordingly, it is possible to prevent the decrease in detection accuracy due to the influence of the vibration generated in the elastic seal member 29B on the residual vibration of the bottom surface of the cavity 43.

That is, for example, when the elastic seal member 29B is exposed to the flow path space between the upstream flow path 55 or the downstream flow path 56 and the cavity 53, the vibration of the bottom surface of the cavity 43 is delivered to the elastic seal member 29B through the liquid to make the elastic seal member vibrate and the vibration of the elastic seal member 29B affects the vibration of the bottom surface of the cavity 43, thereby complicating the vibration mode. Accordingly, by disposing the elastic seal member 29B in a portion other than the flow path wall of the flow path space in which the cavity 43, the upstream flow path 55, and the downstream flow path 56 communicate with each other, such a problem can be previously prevented, thereby preventing the decrease in detection accuracy.

A flow path projection 58 in which the upstream flow path 55 and the downstream flow path 56 are opened is formed in the buffer portion and the elastic seal member 29B seals the space between the sensor unit 13 and the buffer portion 14 at the outer circumference of the flow path projection 58. Accordingly, by opposing and then bonding the surface of the flow path projection 58 in which the upstream flow path 55 and the downstream flow path 56 are opened to the cavity 43 of the sensor unit 13, the upstream flow path 55 and the downstream flow path 56 are allowed to communicate with the cavity 43, thereby forming a flow path. Further, by sealing the surroundings of the opposed portions with the elastic seal member 29B, it is possible to satisfactorily perform the sealing without exposing the elastic seal member 29B to the flow path.

The ring-shaped projection 57 surrounding the openings of the upstream flow path 55 and the downstream flow path 56 is formed on the surface of the flow path projection 58 opposed to the sensor unit 13. Accordingly, when the surface of the flow path projection 58 in which the upstream flow path 55 and the downstream flow path 56 are opened is opposed to the cavity 43 of the sensor unit 13 and the upstream flow path 55 and the downstream flow path 56 are allowed to communicate with the cavity 43 to form a flow path, the ring-shaped projection 57 comes in close contact with the sensor unit 13 and thus the fine clearance due to the flatness of the bonding portions between the cavity 43 and the flow path projection 58 becomes very small, thereby further enhancing the sealing ability. In addition, since the contact of the elastic seal member 29B with the liquid is almost prevented, the vibration of the elastic seal member 29B through the liquid can be almost prevented, thereby surely preventing the decrease in detection accuracy.

In the present embodiment, the upstream flow path 55 and the downstream flow path 56 are symmetrical about the center axis C of the cavity 43. Accordingly, the shape of the space including the upstream flow path 55 and the downstream flow path 56 through which the vibration of the bottom surface of the cavity 43 is spread can be simplified and thus the vibration mode of the residual vibration remaining on the bottom surface of the cavity 43 can be also simplified. Accordingly, the simulation for the residual vibration when the bottom surface of the cavity 43 is compulsorily vibrated can be easily performed to reduce the difference between the actual effect and the designed effect. As a result, the adjustment work can be reduced or the detection accuracy can be improved.

Similarly, the ink supply path 19 and supply-side opening 32 and the ink discharge path 20 and discharge-side opening 33 are symmetrical about the center axis C of the cavity 43. Accordingly, the simulation for the residual vibration when the bottom surface of the cavity 43 is compulsorily vibrated can be easily performed to reduce the difference between the actual effect and the designed effect. As a result, the adjustment work can be reduced or the detection accuracy can be improved.

Since the space constituting the cavity 43 has a substantially cylinder shape, the space shape of the cavity 43 through the vibration of the bottom surface of the cavity 43 is spread is further simplified and thus the vibration mode of the residual vibration remaining on the bottom surface of the cavity 43. Accordingly, the simulation for the residual vibration when the bottom surface of the cavity 43 is compulsorily vibrated can be easily performed to reduce the difference between the actual effect and the designed effect. As a result, the adjustment work can be reduced or the detection accuracy can be improved.

Furthermore, in the present embodiment, the upstream flow path 55 and the downstream flow path 56 are set to have a flow path area smaller than that of the cavity 43 and to have such a length so that fluidal mass of liquid exists therein. Accordingly, since an appropriate flow-path resistance is generated in the upstream flow path 55 and the downstream flow path 56, it is possible to prevent the variation in pressure in the cavity 43 due to the vibration of the bottom surface of the cavity 43 from being spread into the supply-side buffer chamber 15 or the discharge-side buffer chamber 16 and to generate appropriate residual vibration, thereby enhancing and securing the detection accuracy.

In addition, the ink supply path 19 and the ink discharge path 20 are set to have a flow path area smaller than that of the cavity 43 and to have such a length so that fluidal mass of liquid exists therein. Accordingly, since an appropriate flow-path resistance is generated in the ink supply path 19 and the ink discharge path 20, it is possible to prevent the variation in pressure in the cavity 43 due to the vibration of the bottom surface of the cavity 43 from being spread into both buffer chambers 15 and 16 and to generate appropriate residual vibration, thereby enhancing and securing the detection accuracy.

In the present embodiment, the bias member 35 for fixing the sensor unit 13 to the buffer portion 14 by biasing the sensor unit 13 toward the buffer portion 14. Accordingly, the sensor unit 13 can be reliably mounted on the buffer portion 14 by the use of the biasing force of the bias member 35 and the elastic seal member 29B is compressed by the biasing force to come in close contact with the sensor unit 13 or the buffer portion 14, thereby surely performing the sealing work. Since the elastic seal member 29B is compressed by the biasing force and the deformation thereof is little generated. Accordingly, even when the vibration of the bottom surface of the cavity 43 is slightly delivered to the elastic seal member 29B through the liquid, the elastic seal member 29B little vibrates. Accordingly, it is possible to effectively prevent the decrease in detection accuracy due to the vibration of the elastic seal member 29B.

In the present embodiment, since the mounting target member is a buffer member which has as an upstream space the supply-side buffer chamber 15 communicating with the cavity 43 through the upstream flow path 55 and as a downstream space the discharge-side buffer chamber 16 communicating with the cavity 43 through the downstream flow path 56, the upstream flow path 55 and the downstream flow path 56 through which the ink enters and leaves the cavity 43 are opened to the supply-side buffer chamber 15 and the discharge-side buffer chamber 16, respectively, but not opened directly to the reserving space of the liquid as the detection target. Accordingly, even when the bubbles are generated due to the vibration of the ink in the ink reserving space, the bubbles are once trapped by the supply-side buffer chamber 15 or the discharge-side buffer chamber 16 and little enter the cavity 43. Therefore, it is possible to prevent the erroneous detection of the liquid sensor 60B due to the staying of the bubbles in the cavity 43. Since the liquid sensor 60B is disposed in the vicinity of the bottom portion of the ink cartridge 70B, the effect of preventing the invasion of bubbles is further enhanced.

Further, since the ink supply path 55 and the ink discharge path 56, through witch ink flows in and from the cavity 43, are not opened directly to the ink reservoir space of the container body 72 but are opened respectively into the supply side buffer chamber 15 and the discharge side buffer chamber 16, the ink pressure generated in the ink reservoir space within the ink cartridge 70B does not act directly on the cavity 43. Therefore, erroneous detection of the liquid sensor 60B caused by the influence of the pressure due to the vibration of ink can be prevented.

Since the supply side buffer chamber 15 and the discharge side buffer chamber 16 of the liquid sensor 60B is formed symmetrically with respect to the center axis C of the cavity 43, the shape of the members constituting the butter chambers 15 and 16 can be made simple, manufacture becomes easy, and the members can be miniaturized.

When the supply side buffer chamber 15 and the discharge side buffer chamber 16 of the liquid sensor 60B respectively have a least ten times larger volume than the cavity 43, the pressure variation of ink generated in the ink reservoir space within the ink cartridge 70B does not exert an influence on the sensor characteristics of the liquid sensor 60B, so that erroneous detection of the liquid sensor 60B caused by the influence of the pressure due to the vibration of ink can be prevented. Further, since the pressure within the two buffer chambers 15 and 16 does not increase due to the vibration of the bottom surface of the cavity 43, an unnecessary vibration is not generated and the vibration mode of the residual vibration remaining on the bottom surface of the cavity 43 is made simple, which makes it possible to enhance detection precision.

The supply side buffer chamber 15 communicates with the main reservoir chamber 75 which constitutes the major part of the inner space of the container body 72 to reserve ink, and the discharge side buffer chamber 16 communicates with the sub reservoir chamber 76 which is a liquid delivery space which communicates the ink delivery opening 71 for delivering the ink reserved inside the container body 72 to the outside. Therefore, the ink reserved in the main reservoir chamber 75 of the container body 72 flows from the entrance of the supply side buffer chamber 15 of the liquid sensor 60B to be discharged from the exit of the discharge side buffer chamber 16 to be finally delivered to the ink delivery opening 71 of the container body 72. Further, all the ink to be delivered to the ink delivery opening 71 of the container body 72 passes through the supply side buffer chamber 15, the cavity 43, and the discharge side buffer chamber 16 of the liquid sensor 60B in advance, so that the consumption of ink can be sensed reliably.

Further, according to the above-described liquid sensor 60B, the ink discharge path 56 is formed in accordance with the region corresponding to the cavity 43, so that the bubbles which enter the cavity can be discharged reliably.

Additionally in the ink cartridge 70B, the inside of the container body 72 is partitioned into the main reservoir chamber 75 and the sub reservoir chamber 76 which are separated from each other, and communicates with the main reservoir chamber 75 and the sub reservoir chamber 76 through the inflow opening 22 and the outflow opening 23 of the liquid sensor 60B so that the cavity 43 of the liquid sensor 60B is disposed at the upper end of the sub reservoir chamber 76.

Consequently, since the liquid sensor 60B can detect when the ink in the main reservoir chamber 75 runs out, a user can be informed that ink is running out. Further, based on the amount of ink within the sub reservoir chamber 76, which is previously sensed, a user can be informed how many pages can be printed with the remaining ink. Therefore, it can be prevented that a printing paper is wasted when ink runs out on the way of printing the printing paper.

Additionally, according to the described-above ink cartridge 70B, the closed auxiliary flow path 77 is formed inside the main reservoir chamber 75, the auxiliary flow path 77*a* of the auxiliary flow path 77 is disposed in the lower end of the main reservoir chamber 75, and the inflow opening 22 of the liquid sensor 60B communicates with the upper end of the auxiliary flow path 77. For this reason, the bubbles produced in the main reservoir chamber 75 hardly enter the auxiliary flow path 77 and can be prevented from entering the cavity 43 of the liquid sensor 60B.

According to the above-described ink cartridge 70B, the inside of the sub reservoir chamber 76 is filled with ink until all the ink within the main reservoir chamber 75 is consumed. Therefore, the liquid level in the sub reservoir chamber 76 does not shake as long as ink remains in the main reservoir chamber 75. Accordingly, erroneous detection of the liquid sensor 60B caused by the shake of the liquid level can be prevent from occurring.

Further, according to the above-described liquid sensor 60B, the range where the vibration portion 61 comes in contact with ink is limited to the range corresponding to the cavity 43. Therefore, pinpoint detection of ink can be performed, so that ink level can be sensed with high precision.

Since the substantially entire region corresponding to the cavity 43 is covered with the body portion 46*a* of the lower electrode 46, the difference between the deformation mode at the time of a forced vibration and the deformation mode at the time of a free vibration becomes small. Further, since the vibration portion 61 of the liquid sensor 60B is formed symmetrically with respect to the center of the liquid sensor 60B, the rigidity of the vibration portion 61 is nearly isotropic, as seen from the center.

For this reason, an unnecessary vibration caused by structural asymmetry is suppressed from being produced, and the output reduction of the back electromotive force is prevented, which is caused by the difference between the deformation mode at the time of a forced vibration and the deformation mode at the time of a free vibration. Accordingly, the detection precision for the resonant frequency of the residual vibration in the vibration portion 61 of the liquid sensor 60B is enhanced, and the detection of the residual vibration of the vibration portion 61 becomes easy.

Further, since the substantially entire portion of the region corresponding to the cavity 43 is covered with the body portion 46*a* of the lower electrode 46 having a larger diameter that the cavity 43, a necessary vibration is prevented from being produced, which is caused by the positional deviation of the lower electrode 46 in manufacturing. AS a result, the deterioration of detection precision can be prevented.

Further, the entire piezoelectric layer 47, which is inherently brittle, is disposed inside the region corresponding to the cavity 43 and does not exist in the position corresponding to the peripheral edge 43*b* of the cavity 43. For this reason, the occurrence of a crack of piezoelectric film is prevented in the position corresponding to the peripheral edge of the cavity.

Figure 13:
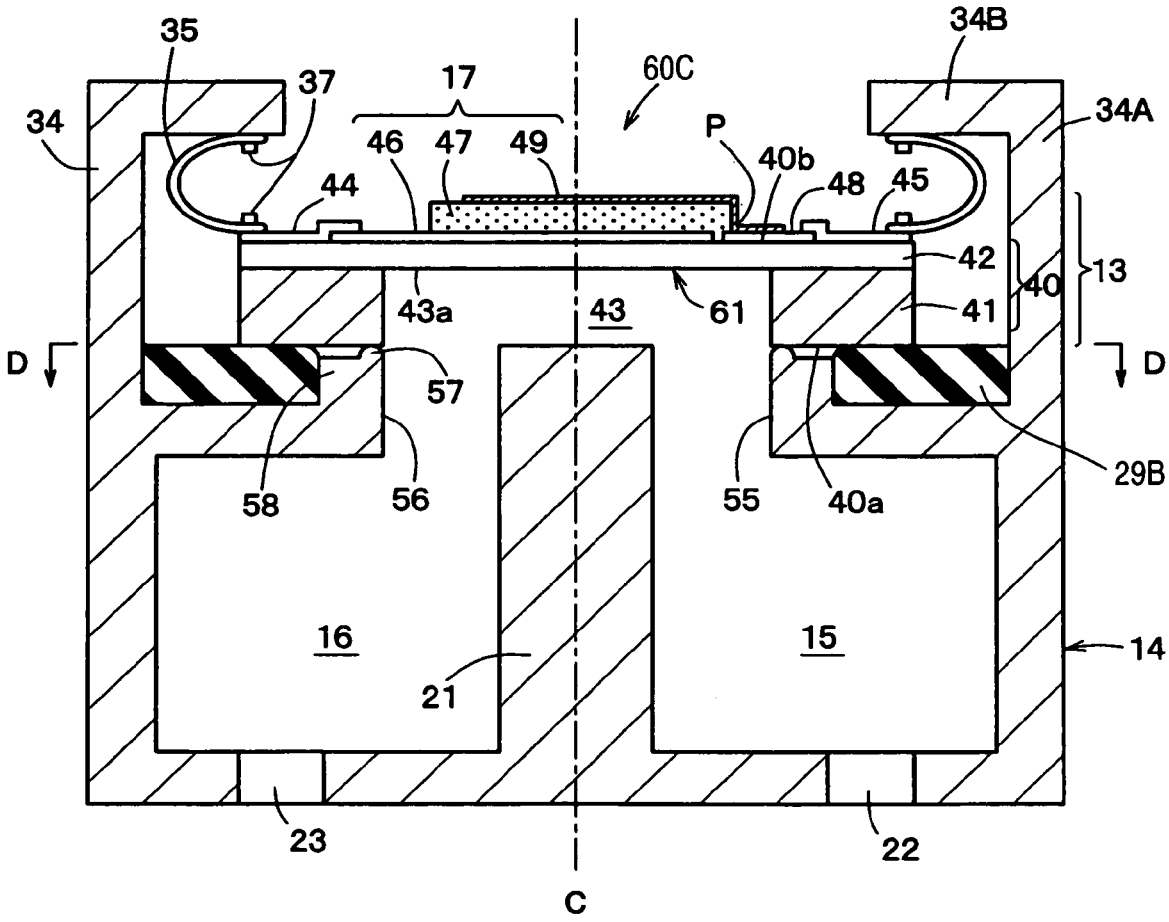
FIG. 13 is a diagram illustrating a liquid sensor employing a mounting structure according to a fourth embodiment of the first aspect of the invention.
Figure 14:
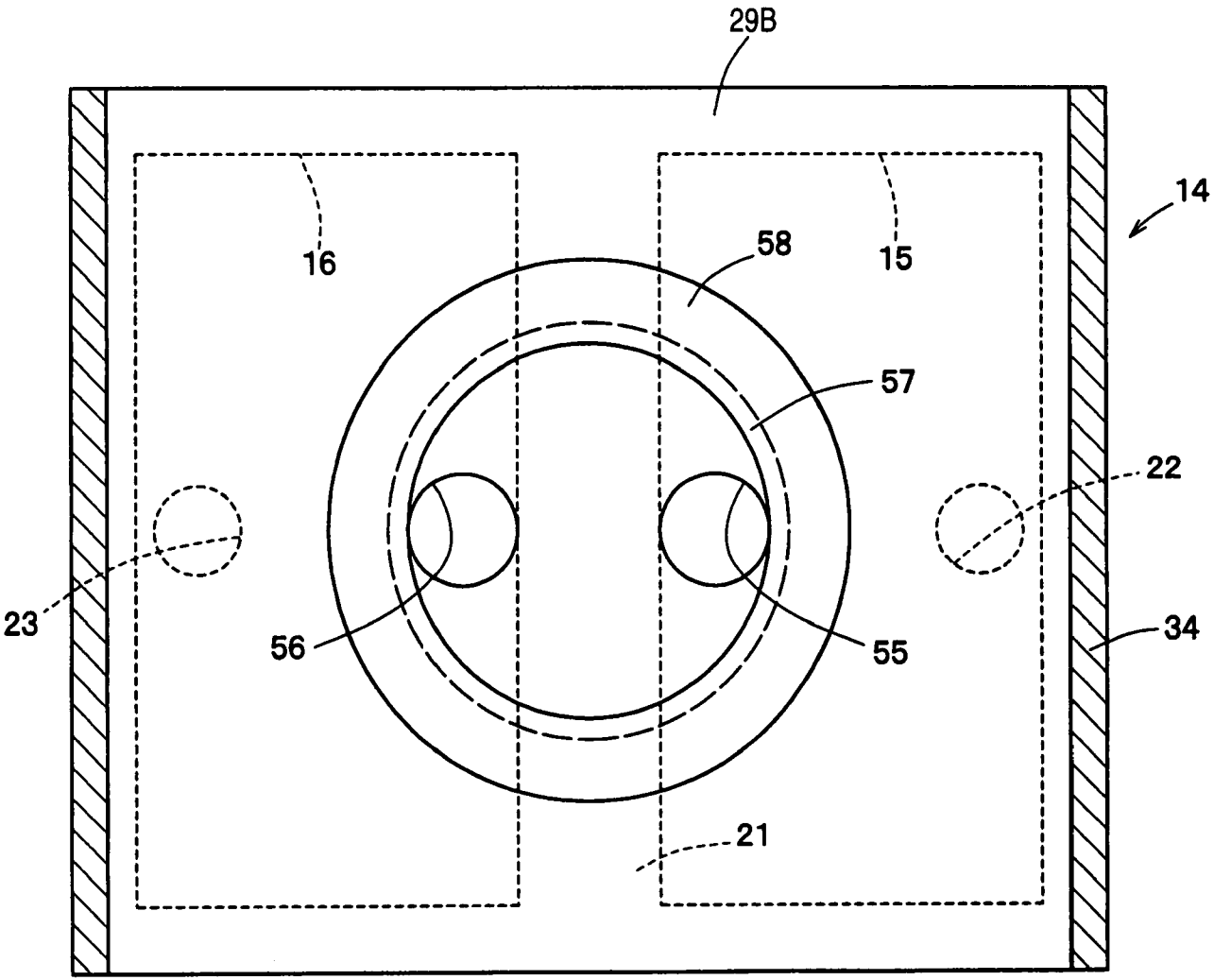
FIG. 14 is a cross-sectional view of a buffer portion according to the fourth embodiment, which is taken along Line D-D of FIG. 13.

FIGS. 13 and 14 show a liquid sensor 60C according to a fourth embodiment of the present invention.

In the present embodiment, the sensor unit 13 does not include the flow path forming plate 18 and the upstream flow path 55 and the downstream flow path 56 directly communicate with the cavity 43 of which the bottom surface is opened. That is, substantially the circular flow path projection 58 is formed on the top surface of the buffer portion 14 and the upstream flow path 55 and the downstream flow path 56 are formed to come in contact with the inner circumference of the cavity 43 as seen in a plan view. A ring-shaped projection having a circular shape slightly greater than the opening edge of the cavity 43 is formed. A circular opening is formed in the elastic seal member 29B so as to insert the circular flow path projection 58 into the circular opening. The vertex of the flow path projection 58 of the buffer portion 14 is opposed and fixed to the bottom surface of the cavity 41 of the sensor unit 13.

According to the fourth embodiment, since the flow path forming plate 18 is omitted, the number of components is reduced as much, thereby decreasing the size of the sensor unit. In addition, since the upstream flow path 55 and the downstream flow path 56 are formed in the portion close to the inner circumferential edge of the cavity 43, disturbance or clogging of the ink is reduced at the time of supplying or discharging the ink and the ink flows smoothly, thereby enhancing the discharge property of bubbles. Other structures are similar to the third embodiment and like elements are denoted by like reference numerals. The fourth embodiment has the advantages similar to those of the third embodiment.

Figure 15:
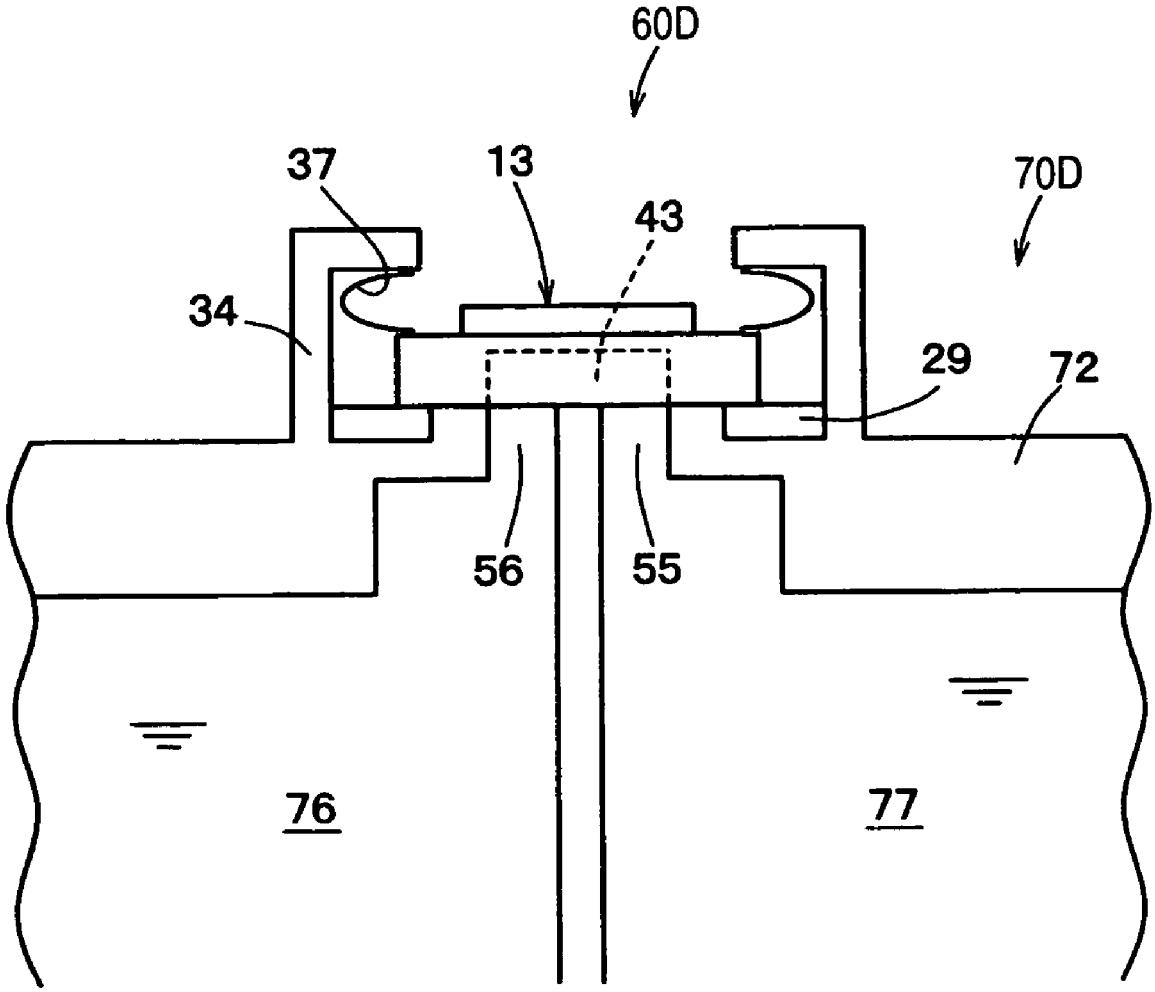
FIG. 15 is a diagram illustrating an ink cartridge employing a mounting structure according to a fifth embodiment of the first aspect of the invention.

FIG. 15 shows an ink cartridge according to a fifth embodiment of the invention.

In the ink cartridge 70D, a liquid sensor 60D does not include the buffer portion 14 and includes only the sensor unit 13. In the ink cartridge 70D, the upstream flow path 55 allowing the cavity 43 of the sensor unit 13 to communicate with the auxiliary flow path 77 of the container body 72 and the downstream flow path 56 allowing the cavity 43 of the sensor unit 13 to communicate with the sub reservoir chamber 76 of the container body 72 are formed in the wall of the container body 72. The sensor fixing member 34 for fixing the sensor unit 13 is formed on the outer side surface of the container body 72, and the elastic seal member 29B and the sensor unit 13 are positioned and fixed onto the outer side surface of the container body 72, similarly to the first and second embodiments described above.

In the present embodiment, the auxiliary flow path 77 serves as the upstream space, that is, a buffer chamber, and the sub reservoir chamber 76 serves as the downstream space, that is, a buffer chamber. Other structures are similar to the third and fourth embodiments and like elements are denoted by like reference numerals. The present embodiment has the advantages similar to those of the third and fourth embodiments.

Next, an operation of detecting liquid in the liquid container shown in the above-mentioned embodiments according to the first aspect will be described with reference to the liquid container according to the first embodiment.

In the ink cartridge 70 having the above-mentioned liquid sensor 60, when the ink remains sufficiently in the container body 72 and the sub reservoir chamber 76 is filled with the ink, the cavity 43 is filled with the ink. On the other hand, when the ink in the container body 72 of the ink cartridge 72 is consumed and no ink remains in the main reservoir chamber 75, the liquid level in the sub reservoir chamber 76 is lowered. When the liquid level is lowered below the cavity 43 of the liquid sensor 60, no ink exists in the cavity 43.

Therefore, the liquid sensor 60 detects the difference in acoustic impedance due to variation in the state. Accordingly, the liquid sensor 60 can detect whether the ink remains sufficiently in the container body 72 or when the ink is consumed more than a predetermined amount.

More specifically, in the liquid sensor 60, a voltage is applied between the upper electrode 49 and the lower electrode 46 through the upper electrode terminal 45 and the lower electrode terminal 44. Then, an electric field is generated in a portion between the upper electrode 49 and the lower electrode 46. The piezoelectric layer 47 is deformed with the electric field. Flexural vibration occurs in a vibration region of the vibration plate 42 (region corresponding to the bottom surface 43*a* of the cavity 43) due to the deformation of the piezoelectric layer 47. In this way, the piezoelectric layer 47 is compulsorily deformed and then the application of voltage is stopped, the flexural vibration remains in the vibration portion 61 of the liquid sensor 60.

The residual vibration is free vibration of the vibration portion 61 of the liquid sensor 60 and the medium in the cavity 43. Therefore, by allowing the voltage applied to the piezoelectric layer 47 to have a pulse waveform or a rectangular waveform, it is possible to easily obtain resonance between the vibration portion 61 and the medium after the application of the voltage. The residual vibration is vibration of the vibration portion 61 of the liquid sensor 6 and accompanies the deformation of the piezoelectric layer 47. For this reason, the piezoelectric layer 47 generates the back electromotive force with the residual vibration. The back electromotive force is detected externally through the upper electrode 49, the lower electrode 46, the upper electrode terminal 45, and the lower electrode terminal 44. Since the resonance frequency can be specified by the detected back electromotive force, it is possible to detect the existence of ink in the container body 72 of the ink cartridge 70 on the basis of the resonance frequency.

Figure 16:
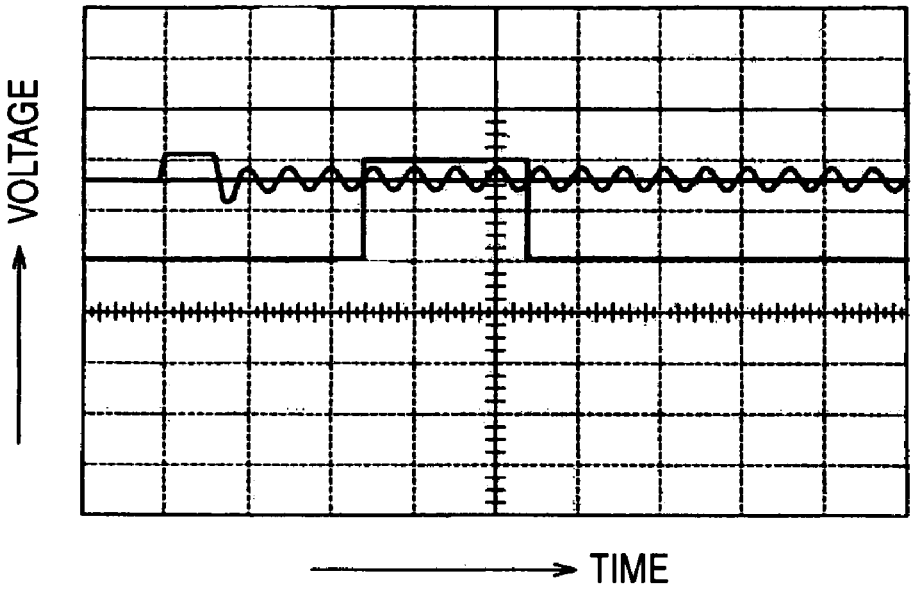
FIG. 16 is a diagram illustrating a waveform of a driving pulse and a waveform of a back electromotive force in a liquid sensor according to an embodiment of the invention, where (a) is a waveform diagram illustrating a case that ink exists in a cavity and (b) is a waveform diagram illustrating a case that the ink does not exist in the cavity.
Figure 16:
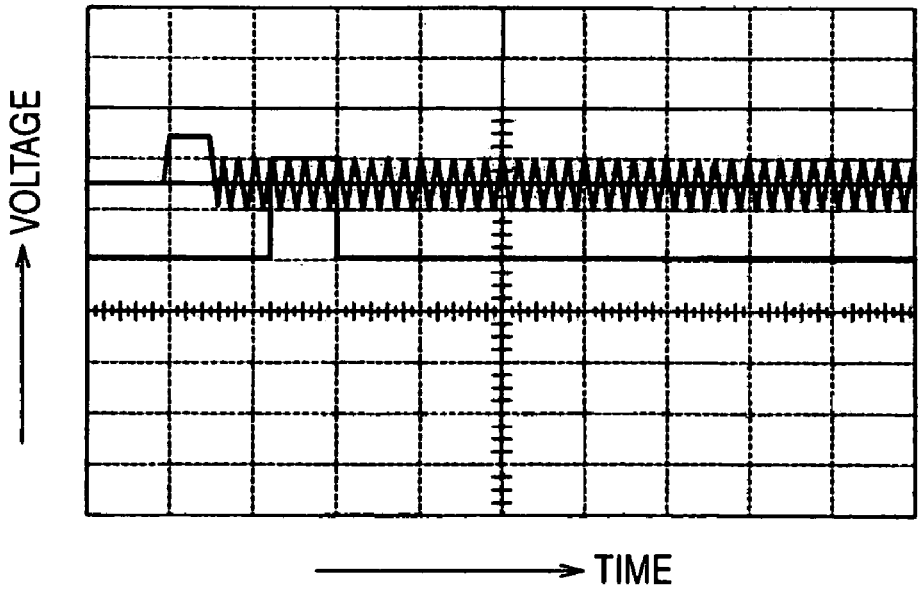

FIGS. 16(*a*) and 16(*b*) illustrate a waveform of the residual vibration (free vibration) of the vibration portion 61 of the liquid sensor 60 and a method of measuring the residual vibration when the vibration portion 61 is compulsorily vibrated by supplying a driving signal to the liquid sensor 60. FIG. 16(*a*) shows a waveform when the ink exists in the cavity 43 o the liquid sensor 60 and FIG. 16(*b*) shows a waveform when no ink exists in the cavity 43 of the liquid sensor 60.

In FIGS. 16(*a*) and 16(*b*), the axis of ordinate denotes a driving pulse applied to the liquid sensor 60 and a voltage of the back electromotive force generated due to the residual vibration of the vibration portion 61 of the liquid sensor 60, and the axis of abscissa denotes a time. The waveform of analog signals of voltage is generated from the residual vibration of the vibration portion 61 of the liquid sensor 60. Next, the analog signal is converted into digital values (binary values) corresponding to the frequency of the signal. In the example shown in FIG. 16, the time for generating four pulses from the fourth pulse to the eighth pulse of the analog signal is measured.

More specifically, after the vibration portion 61 is compulsorily vibrated by applying a driving pulse to the liquid sensor 60, the number of times that the voltage waveform due to the residual vibration crosses a predetermined reference voltage from a lower voltage side to a high voltage side is counted. Digital signals having a high status from the fourth count to the eighth count are generated. The time from the fourth count to the eighth count is measured by the use of a predetermined clock pulse.

Comparing FIG. 16(*a*) with FIG. 16(*b*), it can be seen that FIG. 16(*a*) has the time longer than that of FIG. 16(*b*) from the fourth count to the eighth count. In other words, the time from the fourth count to the eighth count is different depending upon existence of the ink in the cavity 43 of the liquid sensor 60. The consumption status of ink can be detected by the use of the difference in time.

The counting is started from the fourth count because the counting should be started after the residual vibration (free vibration of the liquid sensor 60. The counting from the fourth count is merely an example and may be started from any count. Here, the signals from the fourth count to the eighth count are detected and then the time from the fourth count to the eighth count is measured by the use of predetermined clock pulses. On the basis of the measured time, the resonance frequency can be obtained. The clock pulses need not be counted up to the eighth count and may be counted up to any count.

In FIG. 16, the time from the fourth count to the eighth count is measured, but the time of another count interval may be measured depending upon circuit structures from which the frequencies should be detected. For example, when the quality of ink is stable and the variation in amplitude of peaks is small, the resonance frequency may be obtained by detecting the time from the fourth count to the sixth count so as to speed up the detection. When the quality of ink is unstable and the variation in amplitude of pulses is large, the time from the fourth count to the twelfth count may be measured so as to detect the residual vibration accurately.

In the liquid sensor 60 according to the present embodiment, it can be detected whether the liquid level crosses the mounting position level (strictly the position of the cavity 43) of the liquid sensor 60, by the use of the variation in frequency or amplitude of the residual vibration after the vibration portion 61 of the liquid sensor 60 is compulsorily vibrated.

Figure 17:
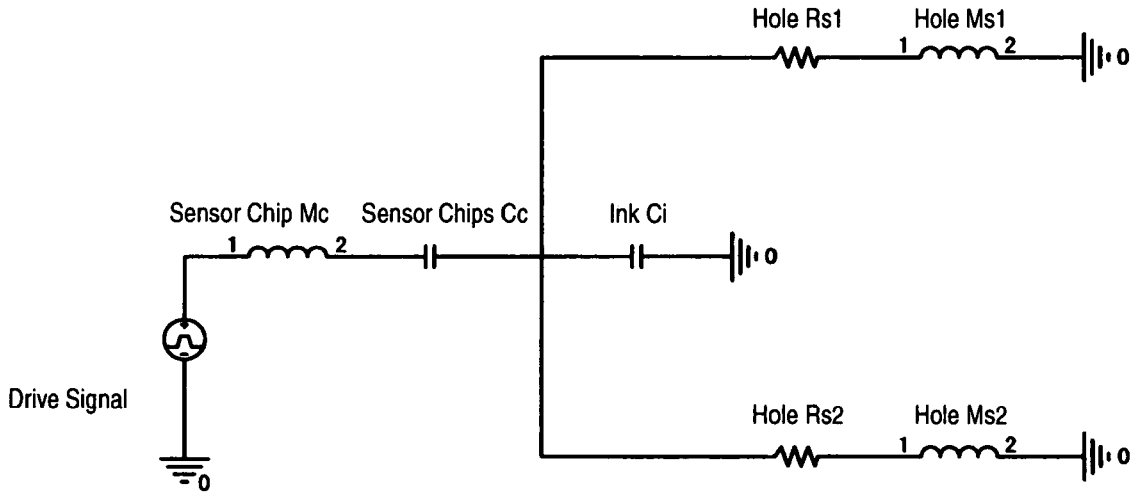
FIG. 17 is a diagram illustrating an example of an equivalent circuit for simulation approaching vibration of a vibration part.

FIG. 17 is an equivalent circuit diagram for simulation approaching the vibration of the vibration portion 61 of the liquid sensor 60.

In FIG. 17, inertance Mc of the vibration portion 61 (sensor chip) and inertances Ms1 and Ms2 of the ink supply path 19 and the ink discharge path 20 (hole) are denoted as coils, compliance Cc of the vibration portion 61 (sensor chip) and compliance Ci of ink are denoted as capacitors, resistances Rs1 and Rs2 of the ink supply path 19 and the ink discharge path 20 (hole) are denoted as resistors, and the supply-side buffer chamber 15 and the discharge-side buffer chamber 16 communicating the ink supply path 19 and the ink discharge path 20 are denoted as ground.

The compliance Cc of the vibration portion 61 is calculated by the use of structural finite element analysis method. The inertance Mc of the vibration portion 61 is approximated by the use of a serial system of inertance and compliance and the approximate value can be calculated from the following approximation expression.

$$Mc=1/(4\pi 2)\times 1/(f2)\times 1/Cc$$

Here, f is an inherent period of the vibration portion 61 and can be obtained through the use of the structural finite element analysis method or actual measurement.

The compliance of ink Ci can be obtained from the following expression.

$$Ci=C\times Vi$$

Here C is a compression ratio of ink and Vi is a volume of ink. The compression ratio of water is 4.5e−10/Pa.

The inertances Ms of the ink supply path 19 and the ink discharge path 20 (hole) can be obtained through the use of a fluid finite element analysis method or when the flow path (hole) is cylindrical, it can be easily calculated from the following expression.

$$Ms=\beta\times L/\pi/r2$$

Here, β is a viscosity of ink, L is a length of the flow path (hole), and r is a radius of the flow path (hole).

The vibration of the vibration portion 61 can be simulated by approximating the equivalent circuit shown in FIG. 17 by the use of the calculated value.

As a result of simulating the vibration of the vibration portion 61 by the use of the equivalent circuit, it can be seen that the vibration is simple and the unnecessary vibration mode is not generated when Ms1, Ms2, Rs1, and Rs2 are approximately equal to each other. Accordingly, in the invention, the space formed by the cavity 43, the ink supply path 19, and the ink discharge path 20 is formed to be symmetrical about the center axis C of the cavity 43.

In order to allow the supply-side buffer chamber 15 and the discharge-side buffer chamber 16 to serve as a buffer, it is preferable that the compliance of the buffer chambers 15 and 16 is set to ten or more times greater than the compliance Cc of the vibration portion 61 so as to little enhance the pressure in the respective buffer chambers 15 and 16 due to the vibration of the vibration portion 61. In order not to generate unnecessary vibration, it is preferable that the inertance of the buffer chambers 15 and 16 is set to 1/10 or less times less than the inertance Ms of the flow path (hole).

<Second Aspect>

Now, an ink cartridge (liquid container) having a liquid detecting function according to a second aspect of the invention will be described with reference to the drawings.

Figure 18:
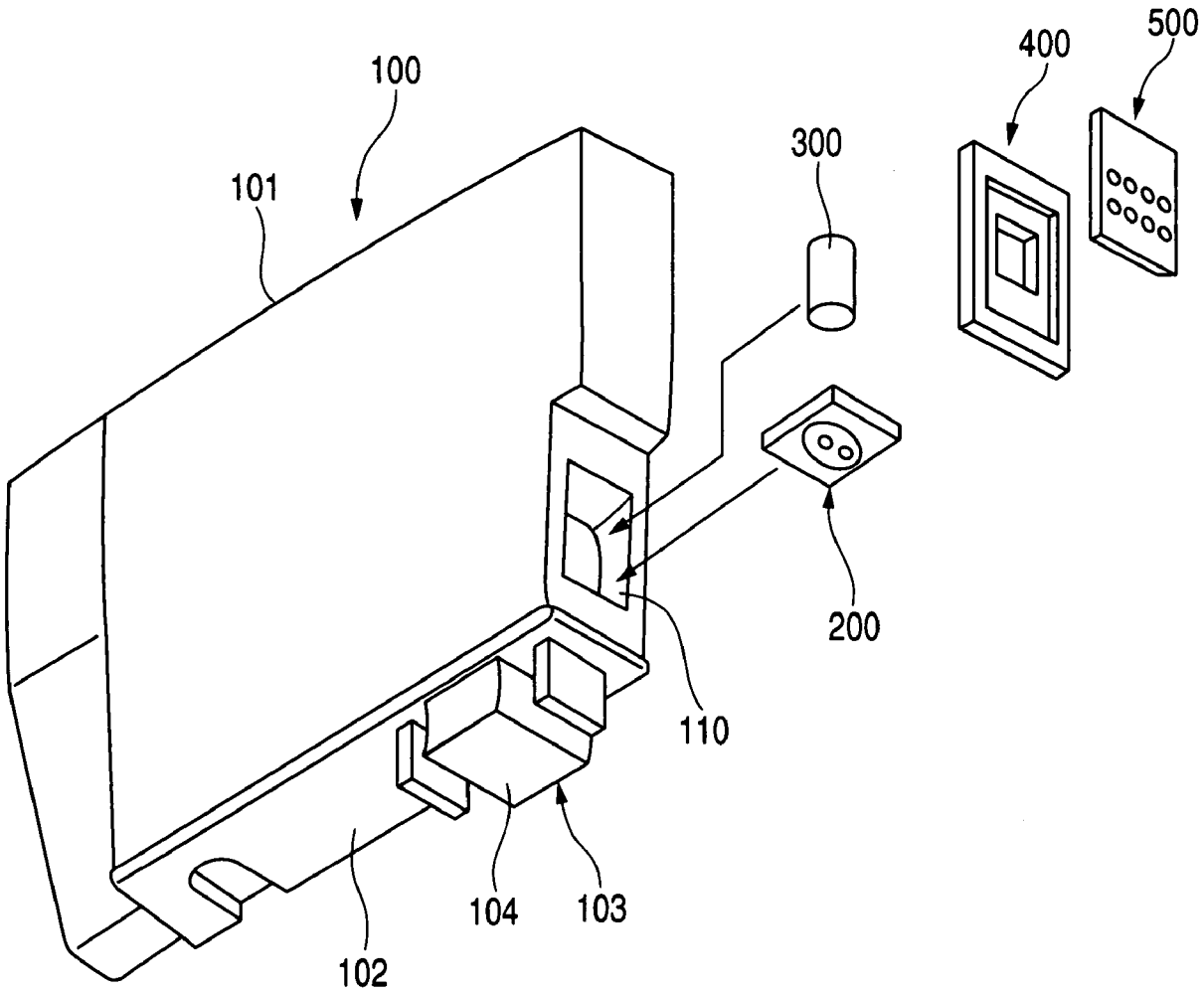
FIG. 18 is an exploded perspective view illustrating a schematic configuration of an ink cartridge according to a second aspect of the invention.

FIG. 18 is a perspective view illustrating a schematic configuration of an ink cartridge 100. A sensor unit 200 which is a main element for performing a liquid detecting function is built in the ink cartridge 100.

The ink cartridge 100 includes a resin cartridge case (container body) 101 having an ink reservoir (not shown) therein and a resin cover 102 disposed to cover the lower end surface of the cartridge case 101. The cover 102 serves to protect various seal films attached onto the lower end surface of the cartridge case 101. An ink delivery portion 103 is projected from the lower end surface of the cartridge case 101 and a cover film 104 for protecting an ink outlet port (not shown) is attached onto the lower end surface of the ink delivery portion 103.

A sensor receiving recess (sensor receiving portion) 110 for receiving the sensor unit 200 is formed in a narrow side surface of the cartridge case 101. The sensor unit 200 and a compression coil spring (pressurizing spring) 300 are received in the sensor receiving recess 110. The compression coil spring (hereinafter, simply referred to as spring) 300 serves to secure a sealing property between the sensor unit 200 and the cartridge case 100 by pressurizing the sensor unit 200 against a sensor receiving wall 120 (see FIGS. 19 to 21) on the bottom portion of the sensor receiving recess 110 and crushing a seal ring 270 (see FIGS. 19 to 21).

The sensor receiving recess 110 is formed by opening the narrow side surface of the cartridge case 101 and the sensor unit 200 and the spring 300 are inserted into the opening of the side surface. The opening of the side surface of the sensor receiving recess 110 is closed with a seal cover 400 in which a substrate 500 is attached to the outside thereof, with the sensor unit 200 and the spring 300 received therein.

Figure 19:
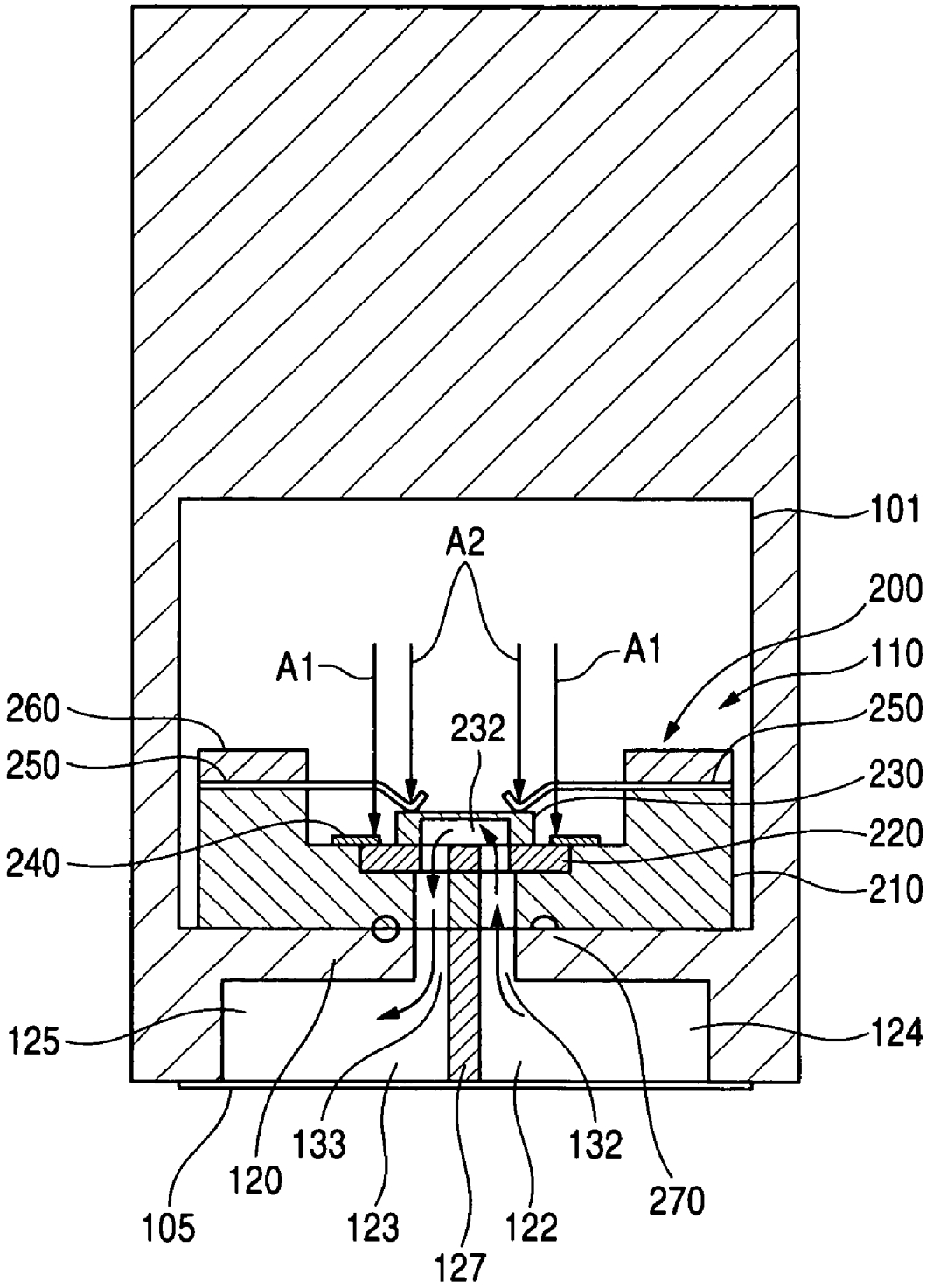
FIG. 19 is a cross-sectional view illustrating a portion where a sensor unit is fitted to the ink cartridge according to the second aspect of the invention, as seen from the front side.
Figure 20:
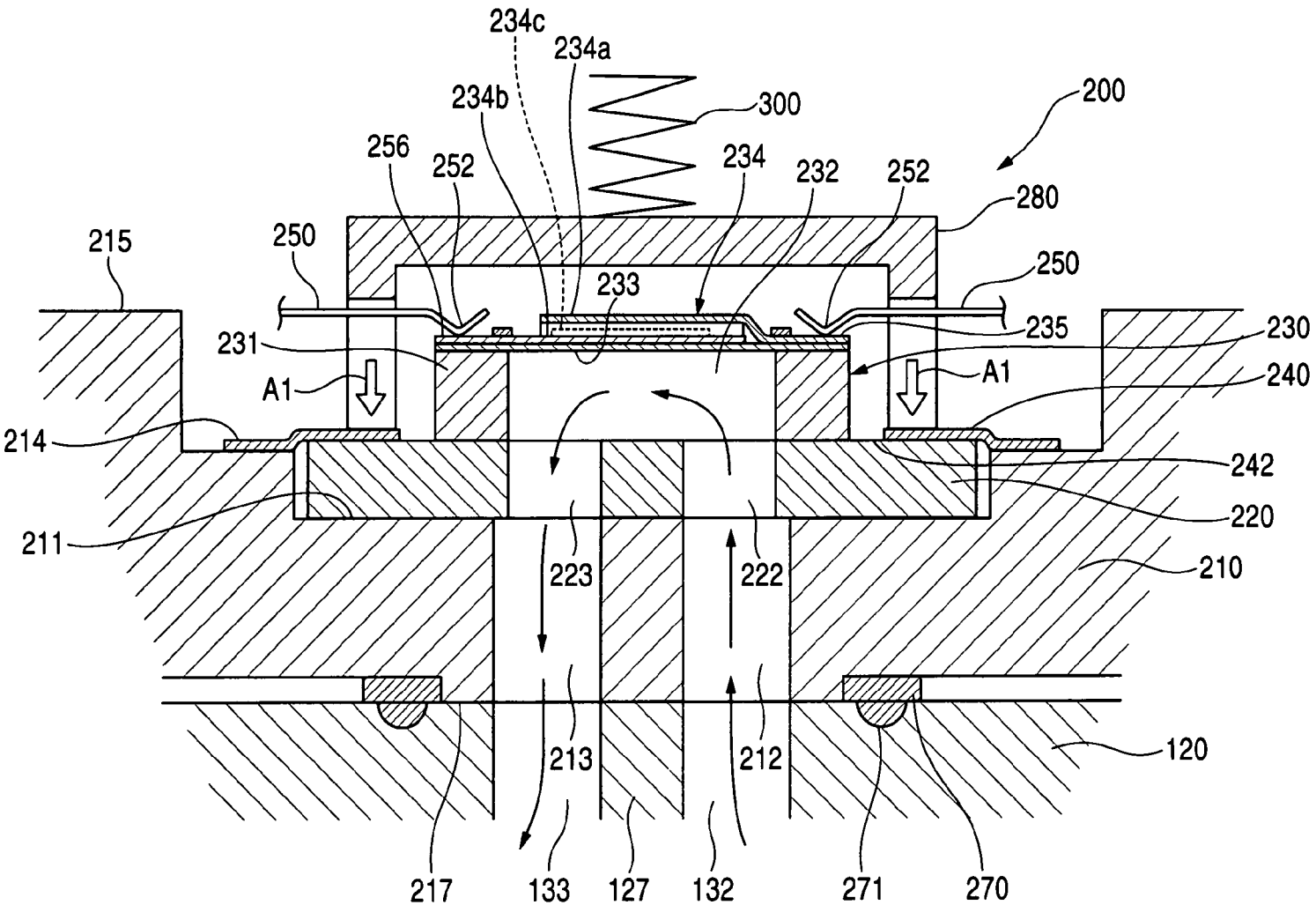
FIG. 20 is an enlarged view illustrating important parts of an ink cartridge according to a first embodiment of the second aspect of the invention.

FIG. 19 is a cross-sectional view illustrating a portion where the sensor unit 200 and the spring 300 are inserted into the sensor receiving recess 110, as seen from the front side, and FIG. 20 is an enlarged view illustrating an example of important parts thereof. In FIG. 19, some parts including the spring 300 are not shown.

The sensor receiving wall 120 for receiving the lower end of the sensor unit 200 is provided on the inner bottom portion of the sensor receiving recess 110 of the cartridge case 101. The sensor unit 200 is placed on the flat top surface of the sensor receiving wall 120 and is a portion on which the seal ring (ring-shaped seal member) 270 at the lower end of the sensor unit 200 is pressed with an elastic force of the spring 300.

A pair of upstream and downstream sensor buffer chambers 122 and 123, which are horizontally partitioned by a partition wall 127, are provided below the sensor receiving wall 120. The sensor receiving wall 120 is provided with a pair of openings (flow paths) 132 and 133 to correspond to the sensor buffer chambers 122 and 123. A delivery path for delivering the reserved ink, which is not shown, is provided inside the cartridge case 101 and the sensor unit 200 is provided in the vicinity of the end (in the vicinity of the ink outlet port) of the delivery path.

In this case, the upstream buffer chamber 122 communicates with the upstream side of the delivery path through a opening 124 (not shown particularly) and the downstream sensor buffer chamber 123 communicates with the downstream side of the delivery path close to the ink outlet port through a opening 125 (not shown particularly). The bottom surfaces of the sensor buffer chambers 122 and 123 are opened, not closed with a rigid wall, and the opening is covered with a seal film 105 made of resin.

The sensor unit 200 includes a resin unit base 210 of a plate shape having a recessed portion 211 thereon, a metal sensor base 220 of a plate shape received in the recessed portion 211 on the top surface of the unit base 210, a sensor chip 230 mounted on and fixed to the top surface of the sensor base 220, an adhesive film 240 for fixing the sensor base 220 to the unit base 210, a pair of terminal plates 250 disposed on the unit base 210, a pressing cover 260 of a plate shape for pressurizing the terminal plates 250, a rubber seal ring 270 disposed on the bottom surface of the unit base 210, and a pressing cover member 280 disposed on the top surface of the sensor base 220 to cover the sensor chip 230 so as to deliver the weight of the spring 300 to the unit base 210.

Describing details of the respective elements, as shown in FIG. 20, the unit base 210 includes the recessed portion 211 into which the sensor base 220 is inserted at the center of the top surface thereof, as a base body for supporting the sensor base 220, and an mounting wall 215 having a height greater by a step than that of the top surface wall 214 at the outside of the top surface wall 214 around the recessed portion 211. The bottom surface of the recessed portion 211 is provided with an entrance-side flow path 212 and an exit-side flow path 213 (liquid reserving space) including circular openings. The bottom surface of the unit base 210 is provided with a projected portion 217 into which the seal ring 217 is inserted and the entrance-side flow path 212 and the exit-side flow path 213 are positioned on the projected portion 217. The seal ring 217 is formed out of a rubber ring packing and has a ring-shaped projected portion 271 having a semi-circular section on the bottom surface thereof.

The sensor base 220 is formed out of a metal plate such as stainless steel having rigidity greater than that of resin so as to enhance an acoustic characteristic of a sensor. The sensor base 220 includes an entrance-side flow path 222 and an exit-side flow path 223 (liquid reserving space) composed of two openings to correspond to the entrance-side flow path 212 and the exit-side flow path 213 of the unit base 210.

An adhesive layer 242 is formed on the top surface of the sensor base 220, for example, by attachment of a double-sided adhesive film or application of adhesive. The sensor chip 230 is mounted on and fixed to the adhesive layer 242. That is, the sensor base 220 serves as a base body for supporting the sensor chip 230.

The sensor chip 230 has a sensor cavity 232 for receiving ink (liquid) which is a detection target and has a structure that the bottom surface of the sensor cavity 232 is opened so as to receive the ink, the top surface is closed with a vibration plate 233, and a piezoelectric element 234 is disposed on the top surface of the vibration plate 233.

Specifically speaking, the sensor chip 230 includes a ceramic chip body 231 having the sensor cavity 232 of a circular opening shape at the center thereof, the vibration plate 233 which is formed on the top surface of the chip body 231 to constitute the bottom wall of the sensor cavity, the piezoelectric element 234 stacked on the vibration plate 233, and terminals 235 and 236 stacked on the chip body 231.

The piezoelectric element 234 includes upper and lower electrode layers 234*a* and 234*b* connected to the terminals 235 and 236, respectively, and a piezoelectric layer 234*c* formed between the upper and lower electrode layers 234*a* and 234*b*. The piezoelectric element serves to detecting the ink end, for example, on the basis of difference in characteristic due to existence or non-existence of the ink in the sensor cavity 232. The piezoelectric element 234*c* may be made of lead zirconate titanate (PZT), lead lanthanum zirconate titanate (PLZT), or a leadless piezoelectric film not containing lead.

The sensor chip 230 is integrally fixed to the sensor base 220 with the adhesive layer 242 by placing the bottom surface of the chip body 231 on the upper center of the sensor base 220. At the same time, the space between the sensor base 220 and the sensor chip 230 is sealed with the adhesive layer 242. The entrance-side flow paths 222 and 212 and the exit-side flow paths 223 and 213 (liquid reserving spaces) of the sensor base 220 and the unit base 210 communicate with the sensor cavity 232 of the sensor chip 230. Accordingly, the ink enters the sensor cavity 232 through the entrance-side flow paths 212 and 222 and is discharged from the sensor cavity 232 through the exit-side flow paths 223 and 213.

In this way, the metal sensor base 220 mounted with the sensor chip 230 is received in the recessed portion 211 on the top surface of the unit base 210. Then, the sensor base 220 and the unit base 210 are integrally fixed to each other by covering them with a resin adhesive film 240 from the upside thereof.

That is, the adhesive film 240 has an opening 241 at the center thereof and thus exposes the sensor chip 230 to the central opening 241 by covering them with the adhesive film in the state where the sensor base 220 is received in the recessed portion 211 on the top surface of the unit base 210. By bonding the inner circumference of the adhesive film 240 to the top surface of the sensor base 220 through the adhesive layer 242 and bonding the outer circumference to the top surface wall 214 around the recessed portion 211 of the unit base 210, that is, by bonding the adhesive film 240 to the top surfaces of two components (the sensor base 220 and the unit base 210), the sensor base 220 and the unit base 210 are fixed to each other and sealed.

In this case, the top surface of the sensor base 220 is projected upwardly from the recessed portion 211 of the unit base 210 and the adhesive film 240 is bonded to the top surface of the sensor base 220 at a position higher than the bonding position of the top surface wall 214 around the recessed portion 211 of the unit base 210. In this way, by setting the height of the film bonding surface on the sensor base 220 to be higher than the height of the film bonding surface on the unit base 210, the sensor base 220 can be pressed with the adhesive film 240 by level difference, thereby strengthening the fixing force of the sensor base 220 to the unit base 210. They may be provided without level difference.

The respective terminal plates 250 have a spring member 252 projected from a middle side edge of a base strip and are disposed on the top surface of the mounting wall 215 of the unit base 210. By placing the pressurizing member 260 thereon, the terminal plates 250 are interposed between the unit base 210 and the pressurizing member 260 and in this state, the spring members 252 are in electrical contact with the terminals 235 and 236 on the top surface of the sensor chip 230. The pressurizing member 260 has a flat frame shape which is placed on the top surface of the mounting walls 215 of the unit base 210 with the terminal plates 250 therebetween.

As shown in FIG. 20, the pressing cover 280 is disposed on the sensor chip 230 without contacting the sensor chip 230 and the spring members 252 of the terminal plates 250. The pressing cover 280 serves to protect the sensor chip 230 and to deliver the weight of the spring 300 (indicated by an arrow A1 in FIGS. 19 and 20) to the top surface of the sensor base 220 to bypass the sensor chip 230. The bottom of the pressing cover is placed on the portion to which the adhesive film 240 is bonded and the weight A1 of the spring 300 can be applied to the sensor base 220 from the upside of the adhesive film 240. When the weight A1 of the spring 300 is applied to the sensor base 220, the weight A1 is delivered to the unit base 210 below and serves as a force for crushing the seal ring 270.

In this case, the seal ring 270 is designed to have a diameter as small as possible so as not to unnecessarily enlarge the sealing space and is positioned right under the sensor base 220 or the sensor chip 230. Therefore, by applying the weight A1 of the spring 300 to the sensor base 220 having a small area, the pressurizing force of the spring 300 effectively acts on the seal ring 270 right under the sensor base.

The sensor unit 200 has the above-mentioned configuration and is received in the sensor receiving recess 110 of the cartridge case 100 together with the compressed spring 300. In this received state, by pressurizing the pressing cover 280 with the spring 300, the weight A1 delivered to the unit base 210 through the sensor base 220 crushes the seal ring 270 disposed on the bottom surface of the unit base 210 and brings the seal ring into close contact with the sensor receiving wall 120 in the sensor receiving recess 110. Accordingly, the sealing property is secured between the sensor unit 200 and the cartridge case 101.

Under the condition that the sealing property is secured by the above-mentioned assembly, the upstream buffer chamber 122 in the cartridge case 101 communicates with the entrance-side flow paths 212 and 222 in the sensor unit 200 through the opening 132 of the sensor receiving wall 120 and the downstream buffer chamber 123 in the cartridge case 101 communicates with the exit-side flow paths 213 and 223 in the sensor unit 200 through the opening 133 of the sensor receiving wall 120. The entrance-side flow paths 212 and 222, the sensor cavity 232, and the exit-side flow paths 213 and 223 are arranged in series in the delivery path in the cartridge case 101 in that order from the upstream side.

Here, the upstream flow paths communicating with the sensor cavity 232 includes the upstream buffer chamber 122 having a large flow-path section, the opening 132, and the entrance-side flow paths 212 and 222 in the sensor unit 200 having a small flow-path section (upstream narrow flow path). The downstream flow path communicating with the sensor cavity 232 includes the downstream buffer chamber 123 having a large flow-path section, the opening 133, and the exit-side flow paths 213 and 223 in the sensor unit 200 having a small flow-path section (downstream narrow flow path).

According to the embodiment described above, since the space between the sensor unit 200 and the sensor receiving wall 120 is sealed while crushing the seal ring 270 by interposing the seal ring 270 having elasticity between the sensor unit 200 and the sensor receiving wall 120 and pressurizing the sensor unit 200 against the sensor receiving wall 120 by the use of the spring 300, an assembly order that the sensor unit 200 is separately assembled in advance and then the sensor unit 200 is fitted into the cartridge case 101 later can be employed. Accordingly, the assembly can be carried out more simply than the case employing an adhesive.

Since the deviation in size between the sensor unit 200 and the sensor receiving wall 120 can be absorbed with the elasticity of the seal ring 270, it is possible to carry out the reliable sealing with simple assembly. Since the liquid reserving space (the entrance-side flow paths 212 and 222 and the exit-side flow paths 213 and 223) sealed with the seal ring 270 is secured in the front of (at the opening side) the sensor cavity 232, it is little affected by the wave motion of ink or the bubbles in the ink.

Since the pressurizing force of the spring 300 is applied to the unit base 210 through the sensor base 220, the surface pressure of the sealing surface between the sensor base 220 and the unit base 210 can be together enhanced, thereby enhancing the sealing property therebetween. That is, since the weight of the spring 300 is applied to the adhesive film 240 on the top surface of the sensor base 220, the adhesive film 240 can be more strongly bonded, thereby improving the sealing ability. In this case, since the unnecessary weight is not applied to the sensor chip 230, the detection characteristic is not affected thereby.

Since the weight A1 of the spring 300 is delivered to the sensor base 220 through the pressing cover 280, it is possible to protect the sensor chip 230 which is an important element and to freely determine combinations of the spring 300 and the sensor base 220, thereby enabling an easy design.

Since it is sufficient only if the spring 300 can be received in the sensor receiving recess 110 in the state that it is compressed, the spring 300 can be easily inserted together with the sensor unit 200.

In addition, only by inserting the sensor base 220 mounted with the sensor chip 230 into the unit base 210 from the upside and bonding the adhesive film 240 onto the top surfaces of the two arranged components, that is, on both top surfaces of the sensor base 220 and the unit base 210, the fixation and sealing between two components made of different materials (the metal sensor base 220 and the resin unit base 210) can be simultaneously carried out. Accordingly, the workability of assembly is very excellent. Since the adhesive film 240 is bonded to two components, the sealing between the components can be carried out without being affected by the size accuracy of the components. For example, when the adhesive film 240 is heated, pressed, and then fused by the use of a mass production machine, the sealing ability can be improved only by managing the temperature and pressure of the mass production machine, thereby accomplishing the stabilization at the time of mass production. Since the adhesive film 240 having a large influence on the sealing ability can be easy in application and excellent in space efficiency, it is possible to accomplish decrease in size of the sensor unit 200.

Since the entrance-side flow paths 212 and 222 and the exit-side flow paths 213 and 223 of the sensor cavity 232 are formed in the sensor base 220 and the unit base 210, respectively, and the ink flows in the sensor cavity 232 through the entrance-side flow paths 212 and 222 and is discharged through the exit-side flow paths 213 and 223, the ink always passes through the sensor cavity 232, thereby preventing erroneous detection due to the liquid or bubbles staying in the sensor cavity 232.

Since the height of the bonding surface of the adhesive film 240 with respect to the unit base 210 is set to be smaller than the height of the bonding surface with respect to the sensor base 220, the sensor base 220 can be pressed with the adhesive film 240 by level difference, thereby strengthening the fixing force of the sensor base 220 to the unit base 210. They may be provided without level difference.

Since the sensor unit 200 is disposed in the vicinity of the end of the delivery path in the cartridge case 101 and the entrance-side flow paths 212 and 222, the sensor cavity 232, and the exit-side flow paths 213 and 223 of the sensor unit 200 are disposed in series in the delivery path in that order from the upstream side, it is possible to accurately detect the amount of remaining liquid in the ink cartridge 100.

Figure 21:
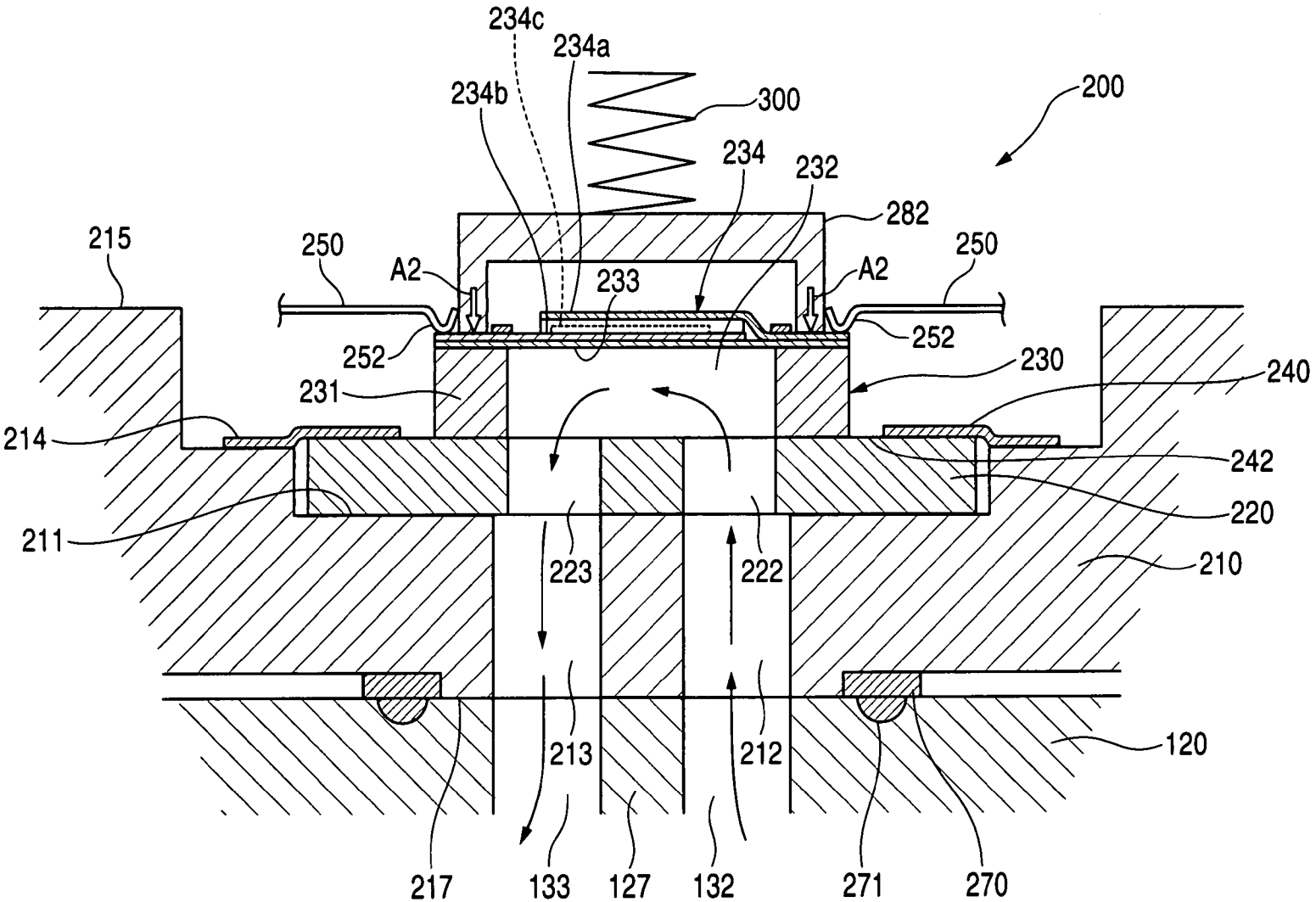
FIG. 21 is an enlarged view illustrating important parts of an ink cartridge according to a second embodiment of the second aspect of the invention.

FIG. 21 shows configurations of important parts according to a second embodiment of the second aspect of the invention. In FIG. 21, the elements similar to those of the embodiment shown in FIGS. 18 to 20 are denoted by the same reference numerals and description thereof will be omitted.

In the first embodiment, the weight Al of the spring 300 is applied to the sensor base 220 through the pressing cover 280, but in the present embodiment, the weight A2 of the spring 300 is applied to the chip body 231 of the sensor chip 230 through the pressing cover 282. As a result, the weight A2 of the spring 300 can be delivered to the unit base 210 through the pressing cover 282, the chip body 231 of the sensor chip 230, and the sensor base 220 and can serve as a force crushing the seal ring 270 (that is, a force for securing the sealing ability).

In this case, the pressing cover 282 is pressed on the chip body 231 at the position not unnecessarily affecting the vibration plate 233 or the piezoelectric element 234. At this time, the pressing cover should not hinder the contact between the spring members 252 of the terminal plates 250 and the spring members the terminals 235 and 236. For this reason, by bringing the bottom of the pressing cover 282 into contact with the chip body 231 at the position other than the contact portion between the spring members 252 and the terminals 235 and 236 or by pressurizing the bottom of the pressing cover 282 onto the chip body 231 from the upside of the spring members 252 contacting the terminals 235 and 236, the spring members 252 can come in close contact with the terminals 235 and 236 with the force of the spring 300 acting on the pressing cover 282.

In this way, even when the weight A2 of the spring 300 is applied to the chip body 231 of the sensor chip 230, the advantages similar to the above-mentioned embodiment can be obtained.

Next, an ink cartridge (liquid container) having a liquid detecting function according to a third embodiment of the second aspect of the invention will be described with reference to the drawings.

Figure 22:
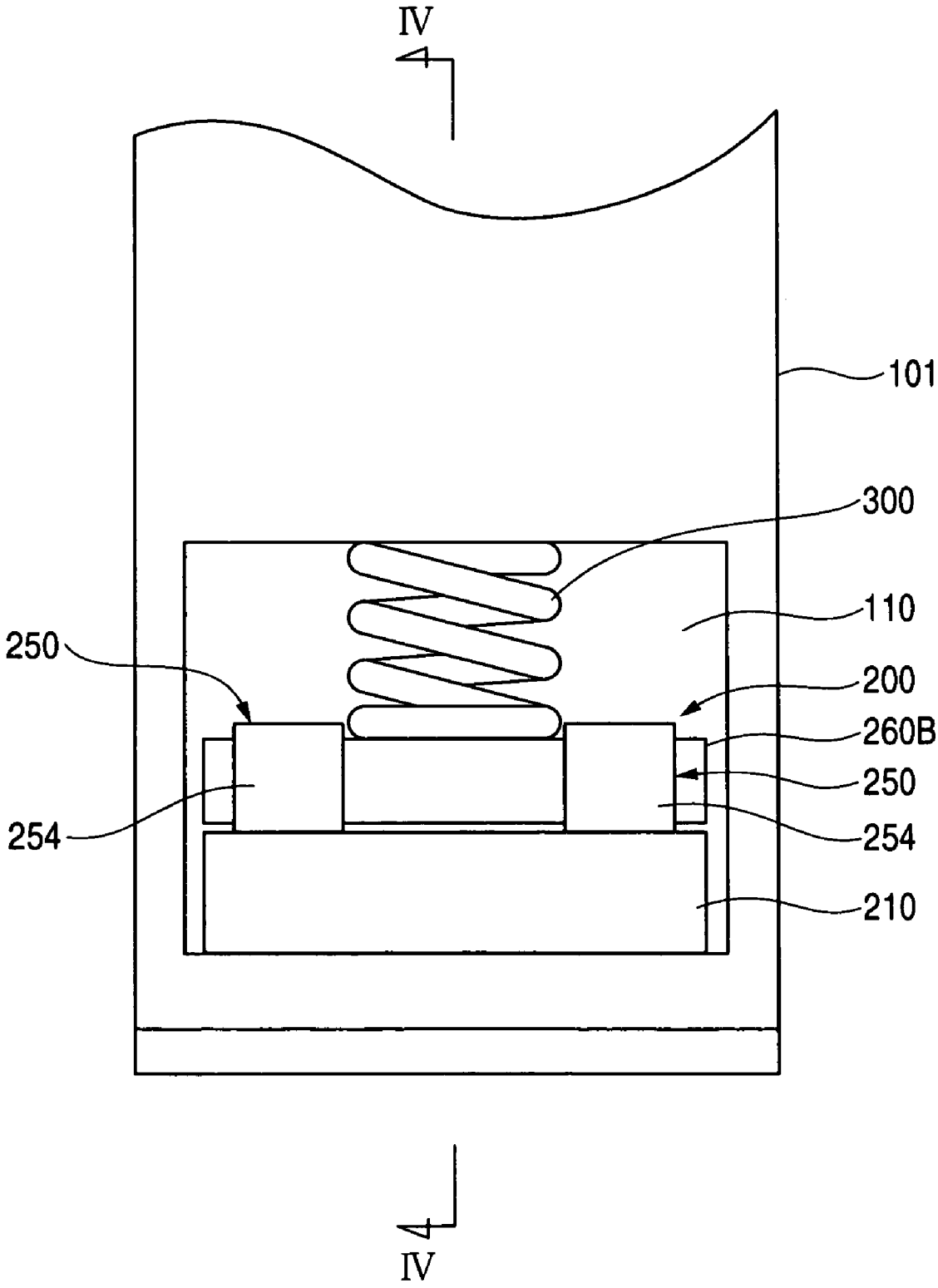
FIG. 22 is a front view illustrating a portion where the sensor unit is fitted to an ink cartridge according to a third embodiment of the second aspect of the invention.
Figure 23:
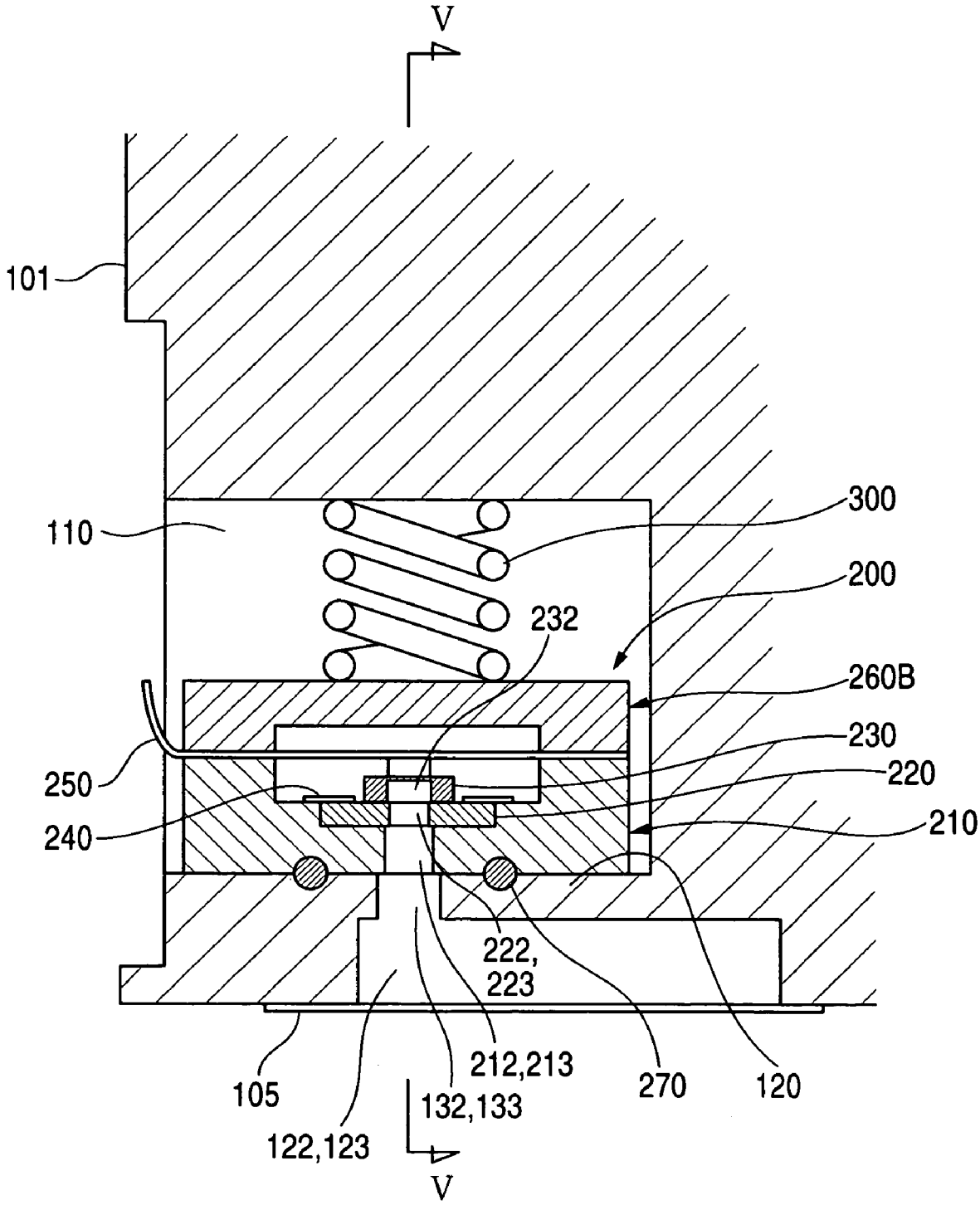
FIG. 23 is a cross-sectional view taken along Arrow IV-IV of FIG. 22.
Figure 24:
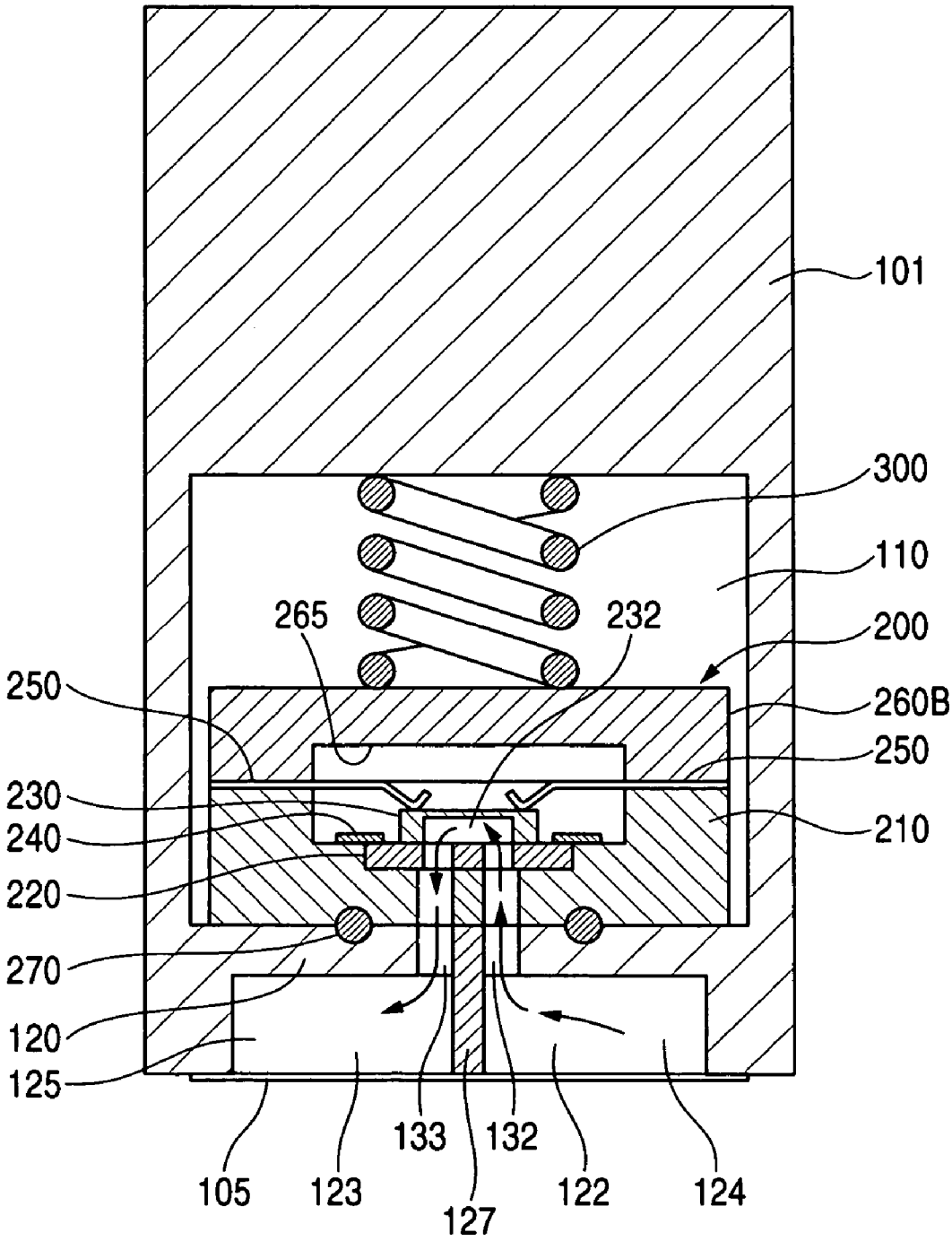
FIG. 24 is a cross-sectional view taken along Arrow V-V of FIG. 23.
Figure 25:
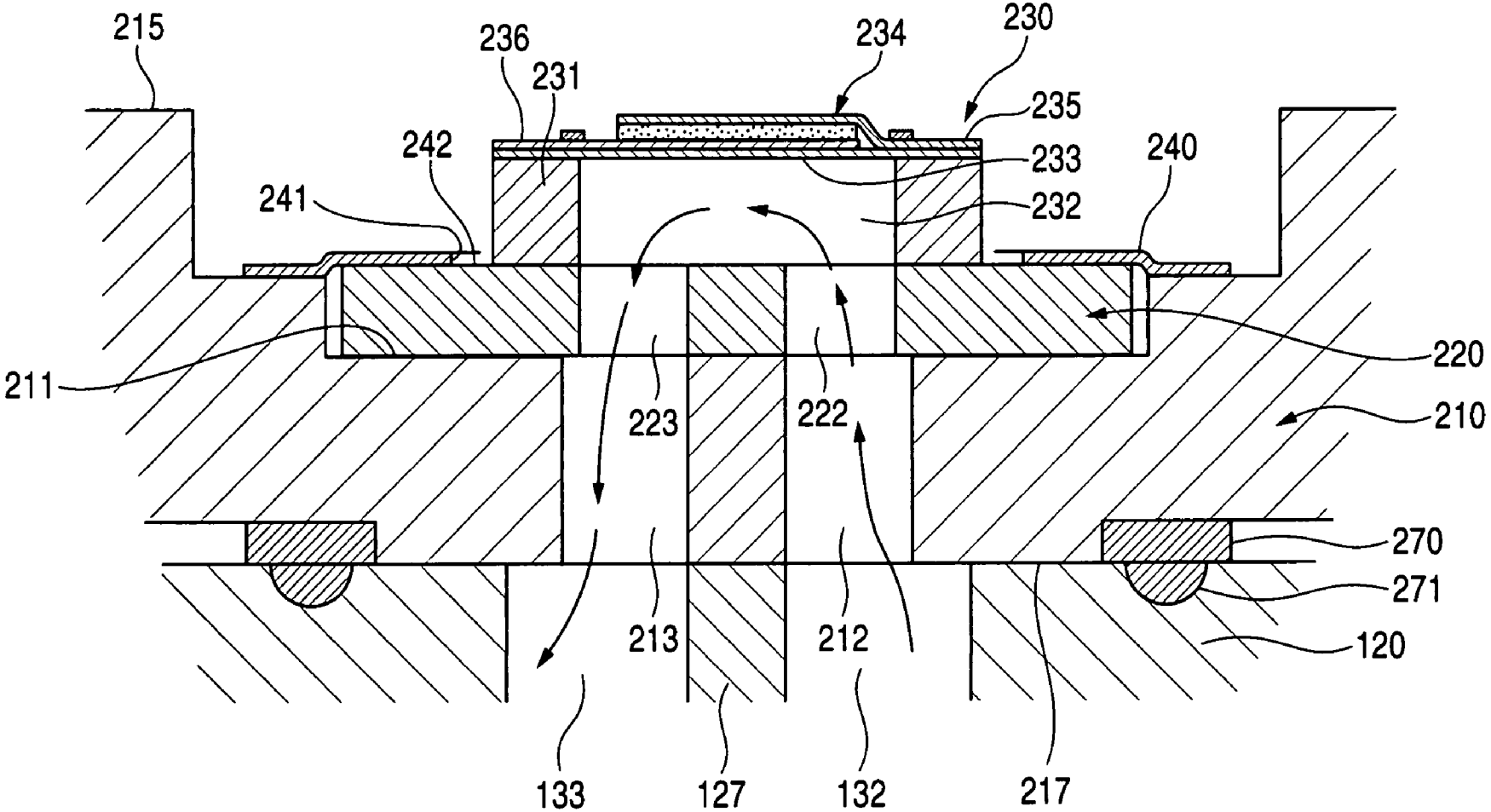
FIG. 25 is an enlarged view illustrating important parts of FIG. 24.

FIG. 22 is a front view illustrating a portion where the sensor unit 200 and the spring 300 are inserted into the sensor receiving recess 110, FIG. 23 is a cross-sectional view taken along Arrow IV-IV of FIG. 22, FIG. 24 is a cross-sectional view taken along Arrow V-V of FIG. 23, and FIG. 25 is an enlarged view illustrating important parts of FIG. 24. In the drawings, the elements similar to the first embodiment described above are denoted by the same reference numerals and description thereof will be omitted.

In the first embodiment and the second embodiment of the second aspect of the invention, the weight of the spring 300 is applied to the sensor base 220 or the sensor body 231 through the pressing covers 280 and 282. However, in the third embodiment, the weight of the spring 300 is applied to the unit base 210 through a pressing cover 260B.

Specifically, the sensor unit 200 includes a resin unit base 210 of a plate shape having a recessed portion 211 on the top surface thereof, a metal sensor base 220 of a plate shape received in the recessed portion 211 on the top surface of the unit base 210, a sensor chip 230 mounted on and fixed to the top surface of the sensor base 220, an adhesive film 240 for fixing the sensor base 220 to the unit base 210, a pair of terminal plates 250 disposed on the unit base 210, a pressing cover (cover member) 260B of a plate shape for pressurizing the terminal plates 250 and protecting the sensor chip 230, and a rubber seal ring 270 disposed on the bottom surface of the unit base 210.

Describing details of the respective elements, as shown in FIG. 25, the unit base 210 includes the recessed portion 211 into which the sensor base 220 is inserted at the center of the top surface thereof and an mounting wall 215 having a height greater by a step than that of the top surface wall 214 at the outside of the top surface wall 214 around the recessed portion 211. The bottom wall of the recessed portion 211 is provided with an entrance-side flow path 212 and an exit-side flow path 213 (liquid reserving spaces) including circular openings. The bottom surface of the unit base 210 is provided with a projected portion 217 into which the seal ring 217 is inserted and the entrance-side flow path 212 and the exit-side flow path 213 are positioned on the projected portion 217. The seal ring 217 is formed out of a rubber ring packing and has a ring-shaped projected portion 271 having a semi-circular section on the bottom surface thereof.

The respective terminal plates 250 have a spring member 252 projected from a middle side edge of a base strip and a bent piece 254 formed at the end of the strip, which are disposed on the top surface of the mounting wall 215 of the unit base 210. By placing the pressing cover 260B thereon, the terminal plates 250 are interposed between the unit base 210 and the pressing cover 260B and in this state, the spring members 252 are in electrical contact with the terminals 235 and 236 on the top surface of the sensor chip 230.

The pressing cover 260B has a flat plate shape which is placed on the top surface of the mounting walls 215 of the unit base 210 with the base portions 251 of the terminal plates 250 interposed therebetween and includes a recessed portion 265 which is disposed on the bottom surface thereof to avoid interference with the spring members 252 of the terminal plates 250 or the sensor chip 230. The pressing cover 260B is placed on the top surface of the unit base 210 while pressurizing the terminal plates 250 from the upside, thereby protecting the sensor base 220 and the sensor chip 230 received in the recessed portion 211 on the top surface of the unit base 210.

The sensor unit 200 has the above-mentioned configuration and is received in the sensor receiving recess 110 of the cartridge case 100 together with the spring 300 in the state where the spring is compressed. In the received state, by downwardly pressurizing the pressing cover 260B with the spring 300, the seal ring 270 disposed on the bottom surface of the sensor unit 200 is crushed and pressed onto the sensor receiving wall 120 in the sensor receiving recess 110, thereby securing the sealing property between the sensor unit 200 and the cartridge case 101. In this case, since the pressurizing force of the spring 300 is delivered to the unit base 210 through the pressing cover 260B, the pressurizing force is not applied to the sensor base 220 and the sensor chip 230 at all. That is, the spring 300 gives the pressurizing force only to the unit base 210 through a force delivery path bypassing the sensor base 220 and the sensor chip 230.

According to the present embodiment described above, the advantages similar to the first embodiment can be obtained. In addition, since the pressurizing force of the spring 300 passes through the pressing cover 260B but is applied directly to the unit base 210 opposed to the sensor receiving wall 120, the influence of the pressurizing force cannot be given to the sensor base 220 or the sensor chip 230, thereby enhancing the detection sensitivity.

Further, since it is sufficient only if the spring 300 is compressed and received in the sensor receiving recess 110, the spring can be easily inserted together with the sensor unit 200.

Since the pressing cover 260B is disposed on the unit base 210, it is possible to protect the sensor chip 230 and the sensor base 210 which are important elements for the vibration characteristic. Since the weight of the spring 300 is applied to the unit base 210 through the pressing cover 260B, it is possible to freely determine the combinations of the spring 300 and the unit base 210, thereby enabling easy design.

Figure 26:
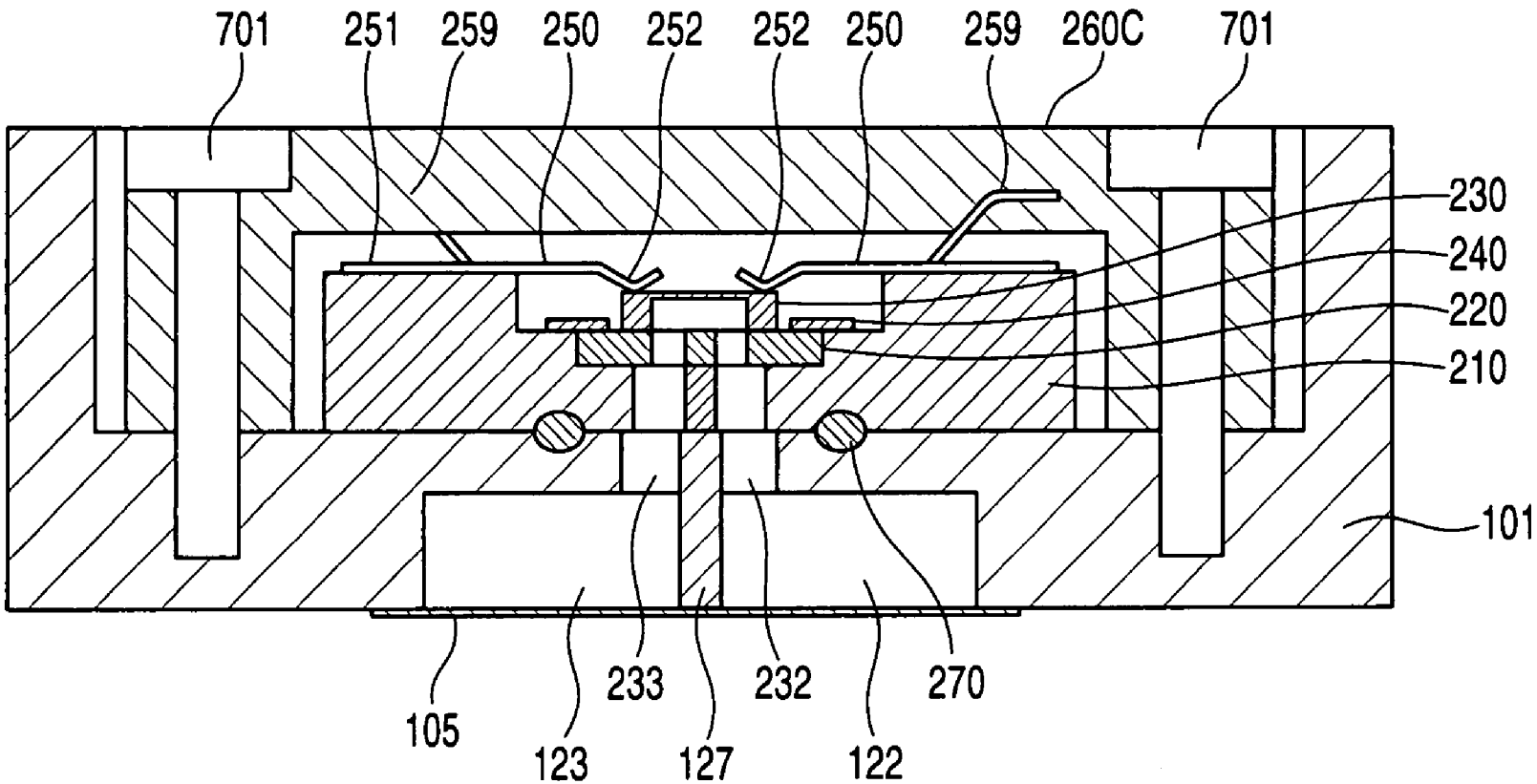
FIG. 26 is a cross-sectional view illustrating important parts of an ink cartridge according to a fourth embodiment of the second aspect of the invention.
Figure 27:
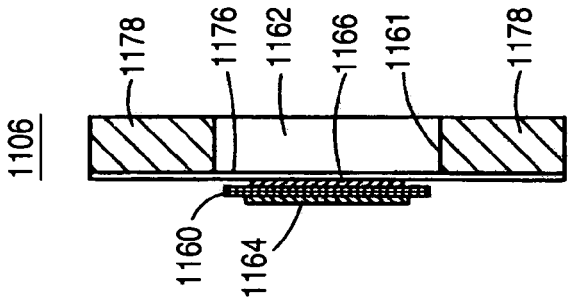
FIG. 27 is a diagram illustrating a conventional liquid sensor, where (a) is a plan view, (b) is a cross-sectional view taken along Line B-B of (a), and (c) is a cross-sectional view taken along Line C-C of (a).
Figure 27:
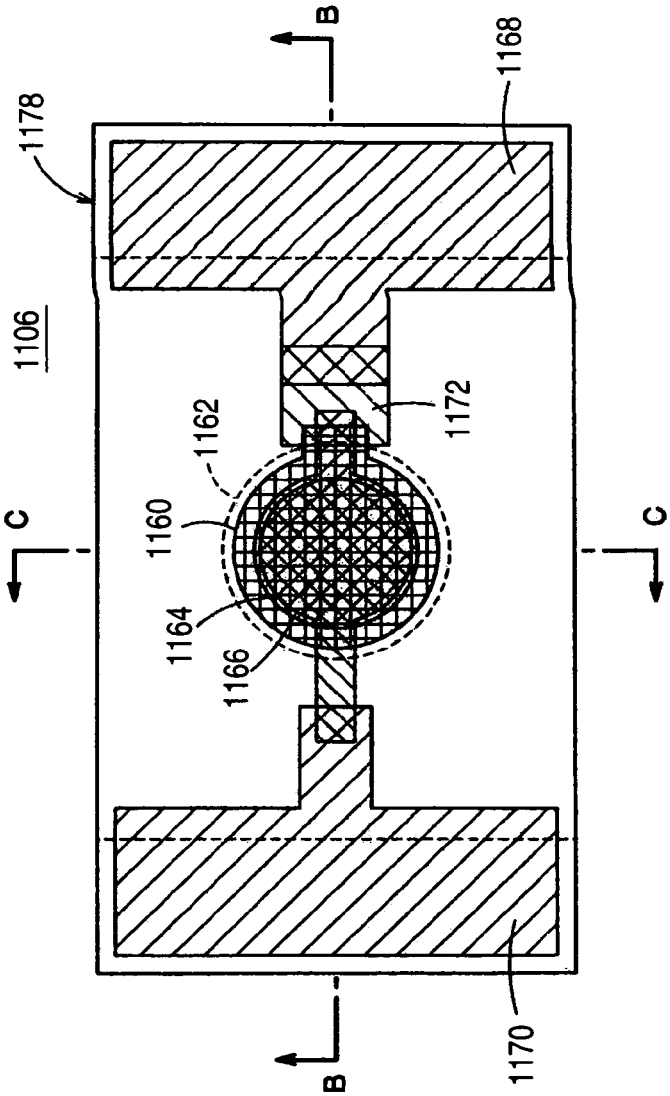
Figure 27:
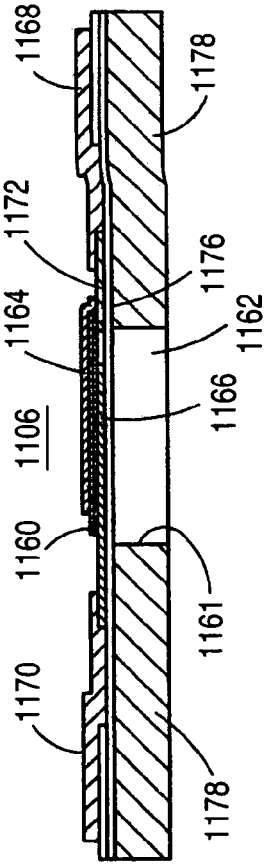
Figure 28:
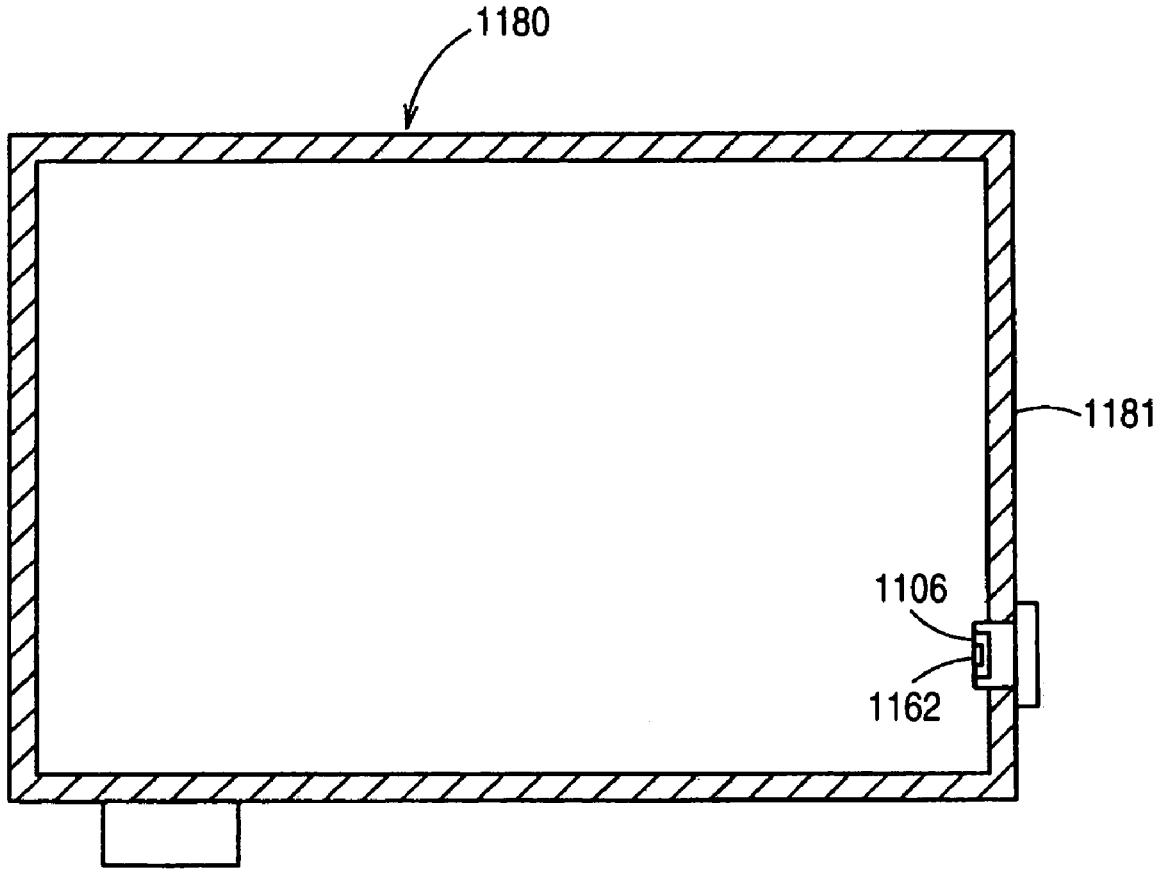
FIG. 28 is a cross-sectional view illustrating a conventional ink cartridge employing the conventional liquid sensor shown in FIG. 27.

FIG. 26 shows important parts according to a fourth embodiment of the second aspect of the invention. In FIG. 26, the elements similar to the embodiments shown in FIGS. 18 to 21 are denoted by the same reference numerals and description thereof will be omitted.

In the present embodiment, a pressing cover 260C covering the sensor chip 230 and the sensor base 210 is disposed above the unit base 210 so as not to come in contact with the unit base 210 and the pressing cover 260C is fixed to the cartridge case 101 with screws 701. Leaf springs (pressurizing springs) 259 for pressurizing the unit base 210 to crush the seal ring 270 are interposed between the pressing cover 260C and the unit base 210, in the state where the leaf spring is compressed.

In this case, the leaf springs 259 are integrally formed in the respective terminal plates 250 and may apply a predetermined pressurizing force only to the unit base 210 in a regular assembling process. The terminal plates 250 are provided with the spring members 252 coming in elastic contact with the terminals 235 and 236 (see FIG. 6) of the sensor chip 230, but the leaf springs 259 are disposed at the positions where the spring force thereof does not act on the spring members 252 at all.

As shown in the figure, an end of the respective leaf springs 259 may be inserted at the time of forming the pressing cover 260C and the terminal plates 250 may be integrally formed in the pressing cover 260C. In this case, it is not necessary to particularly support the terminal plates 250.

The leaf springs 259 may be manufactured and provided separately from the terminal plates 250 and pressurizing springs other than the leaf springs 259 may be provided as long as the space permits.

In this way, since the pressing cover 260C is fixed to the cartridge case 101 with the screws 701 and the leaf springs 259 (pressurizing springs) are interposed between the cover member 260B and the unit base 210 in the state where the leaf springs are compressed, it is possible to perform the compact assembly of the pressurizing springs. Further, since the leaf springs 259 are integrally formed with the terminal plates 250 electrically connected to the terminals 235 and 236 of the sensor chip 230, it is possible to perform the compact assembly and to reduce the number of components, thereby reducing the number of assembly steps./

Next, a principle for detecting ink by the use of the sensor unit 200 according to the second aspect of the invention will be described.

When the ink in the ink cartridge 101 is consumed, the reserved ink is sent to the printing head 12 of the inkjet printer from the ink delivery portion 103 through the sensor cavity 232 of the sensor unit 200.

At this time, when the ink sufficiently remains in the ink cartridge 100, the sensor cavity 232 is filled with the ink. On the other hand, when the amount of ink remaining in the ink cartridge 100 is reduced, the sensor cavity 232 is not filled with the ink.

Therefore, the sensor unit 200 detects difference in acoustic impedance due to the variation in such a state. Accordingly, it is possible to detect whether the ink sufficiently remains or whether a part of the ink is consumed and the amount of remaining ink is reduced.

Specifically, when a voltage is applied to the piezoelectric element 234, the vibration plate 233 is deformed with the deformation of the piezoelectric element 234. When the application of the voltage is released after compulsorily deforming the piezoelectric element 234, flexural vibration remains in the vibration plate 233 for a moment. The residual vibration is free vibration of the vibration plate 233 and the medium in the cavity 232. Therefore, by allowing the voltage applied to the piezoelectric element 234 to have a pulse waveform or a rectangular waveform, it is possible to easily obtain resonance between the vibration plate 233 and the medium after the application of the voltage.

The residual vibration is vibration of the vibration plate 233 and accompanies the deformation of the piezoelectric element 234. For this reason, the piezoelectric element 234 generates the back electromotive force with the residual vibration. The back electromotive force is detected externally through the terminal plates 250.

Since the resonance frequency can be specified by the detected back electromotive force, it is possible to detect the existence of ink in the ink cartridge 100 on the basis of the resonance frequency.

What is claimed is:

1. A mounting structure of a liquid sensor comprising:

a vibration cavity forming base portion which has a first surface and a second surface opposed to each other and in which a cavity for receiving a medium as a detection target is formed to be open toward the first surface side and a bottom surface of the cavity can vibrate;

a sensor including a piezoelectric element having a first electrode formed on the second surface side of the vibration cavity forming base portion, a piezoelectric layer formed on the first electrode, and a second electrode formed on the piezoelectric layer;

a mounting target member which is mounted with the sensor, the mounting target member having an upstream space which communicates with the cavity through an upstream flow path and a downstream space which communicates with the cavity through a downstream flow path; and an elastic seal member which is disposed between the sensor and the mounting target member and which seals a space between the sensor and the mounting target member, wherein the sensor further includes, on the first surface side, a flow path forming base portion which is stacked on the vibration cavity forming base portion and in which a liquid supply path for supplying liquid as the detection target to the cavity and a liquid discharge path for discharging liquid as the detection target from the cavity are formed, and wherein the elastic seal member, in which a supply-side opening allowing the liquid supply path and the upstream space to communicate with each other and a discharge-side opening allowing the liquid discharge path and the downstream space to communicate with each other are formed, seals a space between the liquid supply path and the upstream space and a space between the liquid discharge path and the downstream space, respectively.

2. The mounting structure according to claim 1, wherein an opening of the supply-side opening is larger than an opening of the liquid supply path and an opening of the discharge-side opening is larger than an opening of the liquid discharge path.

3. The mounting structure according to claim 2, wherein an opening diameter of the supply-side opening is set two or more times greater than an opening diameter of the liquid supply path and an opening diameter of the discharge-side opening is set two or more times greater than an opening diameter of the liquid discharge path.

4. The mounting structure according to claim 2, wherein the supply-side opening and the liquid supply path are disposed concentrically and the discharge-side opening and the liquid discharge path are disposed concentrically.

5. The mounting structure according to claim 1, wherein openings of the liquid supply path and the liquid discharge path are set to the same size and openings of the supply-side opening and the discharge-side opening are set to the same size.

6. The mounting structure according to claim 5, wherein the liquid supply path and supply-side opening and the liquid discharge path and discharge-side opening are symmetrical about the center of the cavity.

7. The mounting structure according to claim 1, further comprising a bias member that fixes the sensor to the mounting target member by biasing the sensor toward the mounting target member.

8. The mounting structure according to claim 1, further comprising a holding member which is mounted on the outer circumference of the elastic seal member to hold the elastic seal member externally.

9. The mounting structure according to claim 1, wherein the mounting target member is a buffer member which has, as the upstream space, a supply-side buffer chamber communicating with the liquid supply path and, as a downstream space, a discharge-side buffer chamber communicating with the liquid discharge path.

10. The mounting structure according to claim 9, wherein the supply-side buffer chamber and the discharge-side buffer chamber are symmetrical about the center of the cavity.

11. The mounting structure of a liquid sensor according to claim 9, wherein the supply-side buffer chamber and the discharge-side buffer chamber have a volume ten or more times greater than a volume of the cavity.

12. The mounting structure according to claim 9, wherein the buffer member is mounted on a container body having a liquid delivery opening for sending out liquid reserved therein, the supply-side buffer chamber communicates with a liquid reservoir chamber for reserving liquid, and the discharge-side buffer chamber communicates a liquid delivery space communicating with the liquid delivery opening for sending out the liquid reserved in the inner space of the container body.

13. A liquid container comprising:

a container body having a liquid delivery opening for sending out liquid reserved therein; and mounting structure according to claim 1, wherein the mounting target member serves as a part of the container body, and the liquid delivery opening is communicated with the downstream space.

14. The liquid container according to claim 13, wherein the sensor further includes a flow path forming base portion which is stacked on the first surface side of the vibration cavity forming base portion and in which a liquid supply path for supplying liquid as a detection target to the cavity and a liquid discharge path for discharging the liquid as the detection target from the cavity are formed, and wherein the elastic seal member, in which a supply-side opening allowing the liquid supply path and the upstream space to communicate with each other and a discharge-side opening allowing the liquid discharge path and the downstream space to communicate with each other are formed, seals a space between the liquid supply path and the upstream space and a space between the liquid discharge path and the downstream space, respectively.

15. The liquid container according to claim 13, wherein the elastic seal member is disposed in a portion other than a flow path wall of a flow path space in which the cavity, the upstream flow path, and the downstream flow path communicate with each other.

16. A mounting structure of a liquid sensor comprising:

a vibration cavity forming base portion which has a first surface and a second surface opposed to each other and in which a cavity for receiving a medium as a detection target is formed to be open toward the first surface side and a bottom surface of the cavity can vibrate;

a sensor including a piezoelectric element having a first electrode formed on the second surface side of the vibration cavity forming base portion, a piezoelectric layer formed on the first electrode, and a second electrode formed on the piezoelectric layer;

a mounting target member which is mounted with the sensor, the mounting target member having an upstream space which communicates with the cavity through an upstream flow path and a downstream space which communicates with the cavity through a downstream flow path; and an elastic seal member which is disposed between the sensor and the mounting target member and which seals a space between the sensor and the mounting target member, wherein the elastic seal member is disposed in a portion other than a flow path wall of a flow path space in which the cavity, the upstream flow path, and the downstream flow path communicate with each other, and wherein a flow path projection in which the upstream flow path and the downstream flow path are opened is formed to be projected from the mounting target member and the elastic seal member seals the space between the sensor and the mounting target member at the outer circumference of the flow path projection.

17. The mounting structure according to claim 16, wherein a ring-shaped projection surrounding a periphery of openings of the upstream flow path and the downstream flow path is formed on a surface of the flow path projection opposed to the sensor.

18. The mounting structure according to claim 16, wherein the upstream flow path and the downstream flow path are symmetrical about the center of the cavity.

19. The mounting structure according to claim 16, wherein the upstream flow path and the downstream flow path have a flow path area smaller than that of the cavity and are set to have such a length that fluidal mass exists therein.

20. The mounting structure according to claim 16, further comprising a bias member that fixes the sensor to the mounting target member by biasing the sensor toward the mounting target member.

21. The mounting structure according to claim 16, wherein the mounting target member is a buffer member which has, as an upstream space, a supply-side buffer chamber communicating with the cavity through the upstream flow path and, as a downstream space, a discharge-side buffer chamber communicating with the cavity through the downstream flow path.

22. The mounting structure according to claim 21, wherein the supply-side buffer chamber and the discharge-side buffer chamber are symmetrical about the center of the cavity.

23. The mounting structure according to claim 21, wherein the supply-side buffer chamber and the discharge-side buffer chamber have a volume ten or more times greater than a volume of the cavity.

24. The mounting structure according to claim 21, wherein the buffer member is mounted on a container body having a liquid delivery opening for sending out liquid reserved therein, the supply-side buffer chamber communicates with a liquid reservoir chamber for reserving liquid, and the discharge-side buffer chamber communicates a liquid delivery space communicating with the liquid delivery opening for sending out the liquid reserved in the inner space of the container body.

25. A liquid container comprising:

a container body having a liquid delivery opening for sending out liquid reserved therein; and the mounting structure according to claim 16, wherein the mounting target member serves as a part of the container body, and the liquid delivery opening is communicated with the downstream space.

26. The liquid container according to claim 25, wherein the sensor further includes a flow path forming base portion which is stacked on the first surface side of the vibration cavity forming base portion and in which a liquid supply path for supplying liquid as a detection target to the cavity and a liquid discharge path for discharging the liquid as the detection target from the cavity are formed, and wherein the elastic seal member, in which a supply-side opening allowing the liquid supply path and the upstream space to communicate with each other and a discharge-side opening allowing the liquid discharge path and the downstream space to communicate with each other are formed, seals a space between the liquid supply path and the upstream space and a space between the liquid discharge path and the downstream space, respectively.

27. The liquid container according to claim 25, wherein the elastic seal member is disposed in a portion other than a flow path wall of a flow path space in which the cavity, the upstream flow path, and the downstream flow path communicate with each other.

* * * * *